US007106661B2

(12) United States Patent
Watanabe et al.

(10) Patent No.: US 7,106,661 B2
(45) Date of Patent: Sep. 12, 2006

(54) CALENDAR TIMEPIECE

(75) Inventors: Mamoru Watanabe, Chiba (JP); Katsuyoshi Takizawa, Chiba (JP); Shigeo Suzuki, Chiba (JP); Takeshi Tokoro, Chiba (JP); Takashi Takahashi, Chiba (JP)

(73) Assignee: Seiko Instruments Inc., (JP)

( * ) Notice: Subject to any disclaimer, the term of this patent is extended or adjusted under 35 U.S.C. 154(b) by 178 days.

(21) Appl. No.: 10/716,103

(22) Filed: Nov. 18, 2003

(65) Prior Publication Data

US 2004/0130970 A1 Jul. 8, 2004

(30) Foreign Application Priority Data

Nov. 20, 2002 (JP) ..... 2002-337025

(51) Int. Cl.
*G04B 19/24* (2006.01)
*G04B 19/20* (2006.01)

(52) U.S. Cl. ..... 368/38; 368/37

(58) Field of Classification Search ..... 368/28, 368/37, 38, 35, 36, 34
See application file for complete search history.

(56) References Cited

U.S. PATENT DOCUMENTS 3,675,411 A * 7/1972 Sakuma ..... 368/27
4,082,950 A * 4/1978 Chen ..... 250/343
4,744,068 A * 5/1988 Nikles et al. ..... 368/190
5,384,755 A 1/1995 Ferenczy ..... 368/35
5,903,519 A * 5/1999 Takahashi et al. ..... 368/35
6,814,483 B1 * 11/2004 Watanabe et al. ..... 368/127
6,850,467 B1 * 2/2005 Watanabe et al. ..... 368/28
2001/0028604 A1 * 10/2001 Watanabe et al. ..... 368/28
2004/0130970 A1 * 7/2004 Watanabe et al. ..... 368/37

FOREIGN PATENT DOCUMENTS

CH 61353683 4/1961
CH 90674913 8/1990
EP 0834786 4/1998
EP 1296204 3/2003

* cited by examiner

*Primary Examiner*—Andrew H. Hirshfeld
*Assistant Examiner*—Leo T. Hinze
(74) *Attorney, Agent, or Firm*—Adams & Wilks

(57) ABSTRACT

A calendar timepiece has a main plate, a time indicator mounted on the main plate for undergoing rotational movement to indicate time information, a date indicator mounted for undergoing rotation to indicate date information, and a date indicator driving wheel mounted on the main plate for undergoing rotation. A date jumper is disposed on the main plate and has a train wheel comprised of a date indicator setting portion for controlling rotation of the date indicator by engagement with the inner teeth portion of the date indicator. The date indicator setting portion has a first setting portion for contacting a tip of a first tooth of the date indicator, a second setting portion, and a third setting portion for contacting a tip of a second tooth of the date indicator. Each of the first, second, and third setting portions has a generally linear surface portion disposed at an angle relative to one another.

9 Claims, 33 Drawing Sheets

CALENDAR TIMEPIECE

BACKGROUND OF THE INVENTION

1. Field of the Invention

The present invention generally relates to a calendar timepiece. Particularly, the invention relates to a timepiece with a calendar which incorporates a movement having a small-sized and thin-sized construction.

2. Description of the Prior Art (1) Conventional Calendar Mechanism Disclosed in Patent Literature 1: JP-A-10-104365 (Pages 3–5, FIG. 1)

According to a conventional timepiece with calendar, an hour wheel is brought in mesh with an intermediate date indicator driving wheel of an intermediate date indicator driving wheel & pinion. An intermediate date indicator driving pinion of the intermediate date indicator driving wheel & pinion is brought in mesh with a date indicator driving wheel. A date indicator is rotatably integrated to a main plate. The date indicator is rotated by a date indicator driving finger of the date indicator driving wheel. The date indicator driving wheel includes the date indicator driving finger for rotating the date indicator and a day indicator driving finger for rotating a day indicator. A date indicator setting portion of a date jumper is engaged with an inner teeth portion of the date indicator to set rotation of the date indicator. A date jumper spring portion of the date jumper is extended in a direction reverse to a direction of rotating the date indicator with the date indicator setting portion as a reference (for example, refer to Patent Literature 1).

(2) Conventional Calendar Mechanism Disclosed in Patent Literature 2: JP-UM-A50-76863 (Pages 2–5, FIG. 1)

Further, according to another conventional timepiece with calendar, a calendar feed member having a calendar feed finger engaged with a cam provided at a date indicator driving wheel is urged in accordance with shift of an engagement point from a lower portion to a higher portion of the cam. Further, the calendar feed finger drives a calendar indicating member by an amount of one date by rotating the calendar feed member by discharging a biasing force when the engagement point is rapidly shifted from a highest portion to a lowest portion of the cam (for example, refer to Patent Literature 2).

(3) Conventional Calendar Mechanism Disclosed in Nonpatent Literature 1: "The Theory of Horology" by Charles-Andre Reymondin et al., The Swiss Federation of Technical Colleges. 1999. Pgs. 194–198.

Further, according to another conventional calendar mechanism of a timepiece, a 24 hour wheel operates a date lever. A pin of the date lever is pressed to a tooth portion of a date indicator by a return spring. A date lever spring presses the date lever to a finger of the 24 hour wheel. At midnight, the finger of the 24 hour wheel leaves a front end of the date lever and the date lever is swiftly returned to an original position by the return spring. At this occasion, the pin of the date lever rotates the date indicator (see, for example, nonpatent literature 1).

(4) Other Conventional Calendar Mechanisms:

(4•1) Structure of Calendar Apparatus

With reference to FIG. 24 and FIG. 25, according to another conventional calendar mechanism, a date indicator 920 is rotatably integrated to a main plate 902 on a back side (dial side) of a movement. A date indicator driving finger 930 is integrally provided with a date indicator driving wheel 906. The date indicator driving finger 930 rotates the date indicator 920 by rotating the date indicator driving wheel 906. A date indicator setting transmission wheel 912 is brought in mesh with a date corrector setting wheel 914. The date corrector setting wheel 914 is pivotably integrated to a circular arc long hole 902*h* of the main plate 902. A date corrector cam 916 is integrally provided with the date corrector setting wheel 914. Referring to FIG. 25, when the date corrector setting wheel 914 is disposed at a first position pivoted in one direction in a state in which a winding stem 910 is disposed at 1 stage, the date corrector cam 916 is brought in mesh with an inner teeth portion 920*a* of the date indicator 920. When the date corrector setting wheel 914 is disposed at a second position pivoted to other direction, the date corrector cam 916 is not brought in mesh with the inner teeth portion 920*a* of the date indicator 920. In the state in which the winding stem 910 at 1 stage, the inner teeth portion 920*a* of the date indicator 920 can be rotated by the date corrector cam 916 by rotating the date corrector setting wheel 914 and the date corrector cam 916 via rotation of the date indicator setting transmission wheel 912.

In reference to FIG. 24 and FIG. 25 and FIG. 29, a date jumper 940 is provided at the main plate 902. The date jumper 940 includes a base portion 941, a date indicator setting portion 942 and a date jumper spring portion 944. The base portion 941 is fixed to the main plate 902. The date indicator setting portion 942 of the date jumper 940 is engaged with the inner teeth portion 920*a* of the date indicator 920 to set rotation of the date indicator 920. In FIG. 24, a rotating direction of the date indicator 920 is the clockwise direction.

(4•2) Structure of Date Feeding Mechanism

In reference to FIG. 24 and FIG. 29, the date indicator driving wheel 906 is rotatably integrated to the main plate 902. The date indicator driving finger 930 includes a central portion 931 integrally provided to the date indicator driving wheel 906, a spring portion 932 in a shape of a circular arc extended from the central portion 931 and a date indicator feeding portion 933 for rotating the date indicator 920. A clearance 931*b* is provided between an inner peripheral portion of the spring portion 932 and an outer peripheral portion of the central portion 931. As shown by an arrow mark in FIG. 29, the date indicator 920 is rotated in the clockwise direction. Similarly, as shown by an arrow mark in FIG. 29, also the date indicator driving wheel 906 is rotated in the clockwise direction.

In reference to FIG. 29, FIG. 29 shows a state in which the date indicator feeding portion 933 of the date indicator driving finger 930 is rotated along with the date indicator driving wheel 906 and is just brought into contact with the inner teeth portion 920*a* of the date indicator 920. The state is defined as a state in which a date indicator rotating angle is 0 degree, that is, "state of point A" in FIG. 28.

The inner teeth portion 920*a* of the date indicator 920 includes 31 pieces of trapezoidal teeth. A preceding tooth in view of the rotating direction of the date indicator 920 in the inner teeth portion 920*a* of the date indicator 920 with which the date indicator setting portion 942 of the date jumper 940 is brought into contact is defined as a first tooth 920*f* and a succeeding tooth is defined as a second tooth 920*g*.

The date indicator setting portion 942 of the date jumper 940 includes a first setting portion 942*a* and a second setting portion 942*b*. In a state shown in FIG. 29, the first setting portion 942*a* is brought into contact with a circular arc at a tooth tip of the first tooth 920*f* and the second setting portion 942*b* is brought into contact with a circular arc of a tooth tip of the second 920*g*.

(4•3) Operation of Date Indicator Feeding:

When the date indicator driving wheel 906 and the date indicator driving finger 930 are rotated further from the state shown in FIG. 29, the clearance 931*b* between the inner peripheral portion of the spring portion 932 of the date indicator driving finger 930 and the outer peripheral portion of the central portion 931 is narrowed to bring about a state shown in FIG. 30. FIG. 30 shows "state of point B" in FIG. 28. From the state shown in FIG. 29 to the state shown in FIG. 30, the first setting portion 942*a* of the date jumper 940 stays to be brought into contact with the circular arc of the tooth tip of the first tooth 920*f* and the second setting portion 942*b* stays to be brought into contact with the circular arc of the tooth tip of the second tooth 920*g*. Therefore, from the state shown in FIG. 29 to the state shown in FIG. 30, the date indicator 920 is not rotated.

When the date indicator driving wheel 906 and the date indicator driving finger 930 are further rotated further from the state shown in FIG. 30, the date indicator driving finger 930 rotates the date indicator 920 in a direction shown by an arrow mark to bring about a state shown in FIG. 31. FIG. 31 shows "state of point C" in FIG. 28. In the state shown in FIG. 31, the clearance 931*b* between the inner peripheral portion of the spring portion 932 of the date indicator driving finger 930 and the outer peripheral portion of the central portion 931 stays to be narrowed. From the state shown in FIG. 30 to the state shown in FIG. 31, the first setting portion 942*a* of the date jumper 940 leaves the tooth tip of the first tooth 920*f* and the circular arc of the tooth tip of the second tooth 920*g* slides along the second setting portion 942*b*. Therefore, in the state shown in FIG. 31, the circular arc of the tooth tip of the second tooth 920*g* is brought into contact with the second setting portion 942*b* immediately before an intersection of the first setting portion 942*a* and the second setting portion 942*b*. When the date indicator 920 is rotated from "state of point B" to "state of point C" in FIG. 28, date indicator feeding resistance is increased.

When the date indicator driving wheel 906 and the date indicator driving finger 930 are further rotated further from the state shown in FIG. 31, the date indicator driving finger 930 rotates the date indicator 920 in a direction shown by an arrow mark to bring about a state shown in FIG. 32. FIG. 32 shows "state of point D" in FIG. 28. In the state shown by FIG. 32, the clearance 931*b* between the inner peripheral portion of the spring portion 932 of the date indicator driving finger 930 and the outer peripheral portion of the central portion 931 stays to be narrowed. That is, the state is a state in which a force for rotating the date indicator 920 is stored in the date indicator driving finger 930.

From the state shown in FIG. 31 to the state shown in FIG. 32, the intersection of the first setting portion 942*a* and the second setting portion 942*b* of the date jumper 940 slides on a linear portion of the trapezoidal tooth tip of the second tooth 920*g*. When the date indicator 920 is rotated from "state of point C" to "state of point D" in FIG. 28, the date indicator feeding resistance is rapidly reduced. That is, between "state of point C" and "state of point D" in FIG. 28, the force for rotating the date indicator 920 stored in the date indicator driving finger 930 becomes much larger than a force necessary for rotating the date indicator 920 (that is, date indicator feeding resistance) and the date indicator 920 starts rotating rapidly.

When the date indicator driving finger 930 is further rotated from the state shown in FIG. 32, the date indicator driving finger 930 rotates the date indicator 920 in a direction shown by an arrow mark to bring about a state shown in FIG. 33. FIG. 33 shows "state of point E" in FIG. 28. The date indicator feeding resistance in rotating the date indicator 920 from "state of point D" to "state of point E" in FIG. 28 is the force necessary for rotating the date indicator 920. In the state shown in FIG. 33, the clearance 931*b* between the inner peripheral portion of the spring portion 932 of the date indicator driving finger 930 and the outer peripheral portion of the central portion 931 is widened. From the state shown in FIG. 32 to the state shown in state shown in FIG. 33, the intersection of the first setting portion 942*a* and the second setting portion 942*b* of the date jumper 940 slides on the linear portion of the trapezoidal tooth tip of the second tooth 920*g*. When the date indicator 920 is rotated from "state of point D" to "state of point E" in FIG. 28, although the force of the date indicator driving finger 930 exerted to the date indicator 920 is slightly reduced, the force for rotating the date indicator 920 stored to the date indicator driving finger 930 is much larger than the force necessary for rotating the date indicator 920 (that is, the date indicator feeding resistance) and therefore, rotation of the date indicator 920 is not stopped.

When the date indicator driving wheel 906 and the date indicator driving finger 930 are further rotated further from the state shown in FIG. 33, the date indicator driving finger 930 rotates the date indicator 920 in the direction shown by the arrow mark. Under the state, the clearance 931*b* between the inner peripheral portion of the spring portion 932 of the date indicator driving finger 930 and the outer peripheral portion of the central portion 931 stays to be widened. When the intersection of the first setting portion 942*a* and the second setting portion 942*b* of the date jumper 940 passes the linear portion of the trapezoidal tooth tip of the second tooth 920*g* from the state shown in FIG. 33, the date indicator 920 is further rotated in the direction shown by the arrow mark by spring force of the date jumper spring portion 944 of the date jumper 940. Further, the date indicator feeding resistance becomes "0". When the date indicator 920 is rotated further from "state of point E" in FIG. 28, the force of the date indicator driving finger 930 exerted to the date indicator 920 is further reduced. According to the conventional calendar mechanism, the date indicator 920 can be rotated by an amount of one date by rotating the date indicator driving wheel 906 by about 9.6 degrees. That is, according to the conventional calendar mechanism, a date feeding time period is about 36 minutes.

(4•4) Operation of Date Correction:

In reference to FIG. 26, in carrying out date correction, when the winding stem 910 is rotated in the first direction in the state in which the winding stem 310 is disposed at 1 stage, the date corrector setting transmission wheel 912 is rotated in a direction shown by an, arrow mark. When the date corrector setting transmission wheel 912 is rotated in the direction shown by the arrow mark, the date corrector setting wheel 914, is moved to the first position pivoted in one direction (position at which the date corrector cam 916 is brought in mesh with the inner teeth portion 920*a* of the date indicator 920). When the date corrector setting wheel 914 is disposed at the first position pivoted in one direction, the date corrector cam 916 is brought in mesh with the inner teeth portion 920*a* of the date indicator 920. By rotating the winding stem 910 in the first direction under the state, date correction can be carried out by rotating the date indicator 920 in a direction shown by an arrow mark.

As shown by FIG. 27, although a front end of the date corrector cam 916 is sharpened, there is a linear portion at a front end of the inner teeth portion 920*a* of the date indicator 920 and therefore, there is a concern that the front end of the date corrector cam 916 and the linear portion of the front end of the inner teeth portion 920*a* of the date indicator 920 interfere with each other.

When the winding stem 910 is rotated in the second direction reverse to the first direction in the state in which the winding stem 910 is disposed at 1 stage, the date corrector setting transmission wheel 912 is rotated in a direction reverse to the direction shown by the arrow mark. When the date corrector setting transmission wheel 912 is rotated in the direction reverse to the direction shown by the arrow mark, the date corrector setting wheel 914 is moved to the second position pivoted in other direction (position at which the date corrector cam 916 is not brought in mesh with the inner teeth portion 920*a* of the date indicator 920). Even when the winding stem 910 is rotated in the second direction, the date indicator 920 is not rotated and date correction cannot be carried out.

However, the following problems are associated with the conventional calendar mechanisms of the timepieces with calendar.

(1) According to the conventional calendar mechanism disclosed in patent literature 1, a long period of time exceeding one hour is needed for feeding the date indicator.

(2) According to the conventional calendar mechanism disclosed in patent literature 2, shapes of parts are complicated, very high machining accuracy of parts is requested and a long period of time is needed for fabricating, assembling and adjusting of parts.

(3) According to the conventional calendar mechanism disclosed in nonpatent literature 1, a number of parts are needed. Further, a long period of time is needed for fabricating, assembling and adjusting of parts.

(4) According to the other conventional calendar mechanism shown in FIG. 24 through FIG. 33, since the shape of the tooth of the date indicator is trapezoidal, when date correction is carried out, there is present a long dead point (time band at which date correction cannot be carried out). Further, according to the calendar mechanism, when the date indicator correcting mechanism of the pivoting type is used, there is brought about a phenomenon in which the corrector tooth of the date corrector setting wheel interferes with the straight portion of the tooth of the date indicator and the date correction cannot be carried out.

SUMMARY OF THE INVENTION

It is an object of the invention to provide a timepiece with calendar including a calendar mechanism capable of feeding a date indicator in a short period of time by a simple mechanism.

Further, it is another object of the invention to provide a timepiece with calendar including a date correcting mechanism capable of firmly carrying out date correction without presence of a long dead point.

According to the invention, in a timepiece with calendar including a main plate constituting a base plate of a movement, a center wheel & pinion rotated with a rotating center thereof disposed at the main plate for displaying time information, a switching apparatus for correcting the time information, a dial for indicating the time information and a date indicator for indicating a date, an inner teeth portion of the date indicator includes 31 pieces of triangular teeth. The timepiece with calendar according to the invention includes a date indicator driving wheel arranged on the side of the dial of the main plate and has a rotating center thereof at the main plate for rotating the date indicator. A date indicator driving finger is provided integrally with the date indicator driving wheel, the date indicator driving finger has a central portion provided integrally with the date indicator driving wheel, a spring portion in a shape of a circular arc extended from the central portion and a date indicator feeding portion provided at a front end of the spring portion for rotating the date indicator. The timepiece with calendar according to the invention is comprised to further include a date jumper arranged on the side of the dial of the main plate and has a train wheel setting portion for setting the date indicator, wherein the date jumper includes a base portion, a date indicator setting portion and a date jumper spring portion and the date indicator setting portion of the date jumper is engaged with the inner teeth portion of the date indicator to set rotation of the date indicator. The date indicator setting portion of the date jumper includes a first setting portion, a second setting portion and a third setting portion, and the second setting portion is provided between the first setting portion and the third setting portion. Further, the timepiece with calendar according to the invention is comprised such that in a state in which the date jumper sets the date indicator, the first setting portion is brought into contact with a circular arc of a tooth tip of a first tooth of the date indicator and the third setting portion is brought into contact with a circular arc of a tooth tip of a second tooth of the date indicator contiguous to the first tooth.

It is preferable that the timepiece with calendar according to the invention further includes a calendar corrector setting wheel arranged on the side of the dial plate of the main plate and provided pivotably with a rotating center thereof disposed at the main plate for correcting the date indicator.

Further, according to the timepiece with calendar of the invention, it is preferable that in the date indicator setting portion of the date jumper, an angle made by the first setting portion and the second setting portion falls in a range of 120 degrees through 135 degrees and an angle made by the second setting portion and the third setting portion falls in a range of 140 degrees through 155 degrees.

Further, according to the timepiece with calendar of the invention, when a straight line connecting the rotating center of the center wheel & pinion and a center of the circular arc of the tooth tip of the first tooth is defined as a first tooth tip reference line, a straight line connecting the rotating center of the center wheel & pinion and a center of the circular arc of the tooth tip of the second tooth is defined as a second tooth tip reference line, an angle made by the first tooth tip reference line and the second tooth tip reference line is designated by a notation T1, an angle made by a straight line connecting an intersection of the first setting portion and the second setting portion and the rotating center of the center wheel & pinion and the first tooth tip reference line is designated by a notation T2, and an angle made by a straight line connecting an intersection of the second setting portion and the third setting portion and the rotating center of the center wheel & pinion and the first tooth tip reference line is designated by a notation T3, where (T1−T3) is comprised to be smaller than (T3−T2) and (T3−T2) is comprised to be smaller than T2. By this construction, the date indicator can firmly be fed in a short period of time and, after feeding the date indicator, the date indicator can firmly be set by the date jumper.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
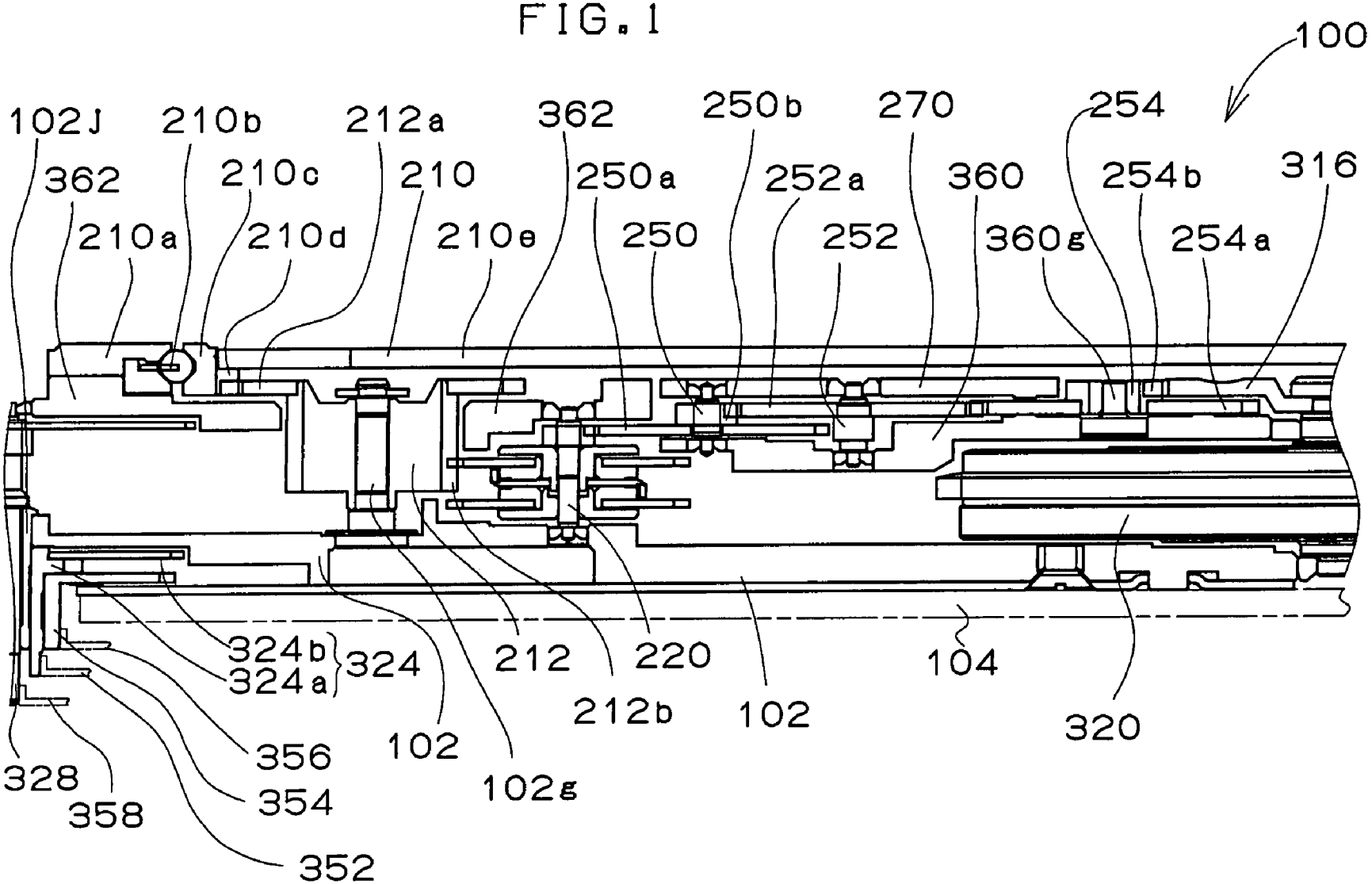
FIG. 1 is an outline partially sectional view showing a self-winding mechanism including an oscillating weight, a first intermediate wheel and a switching transmission wheel according to an embodiment of a timepiece with calendar of the invention.
Figure 2:
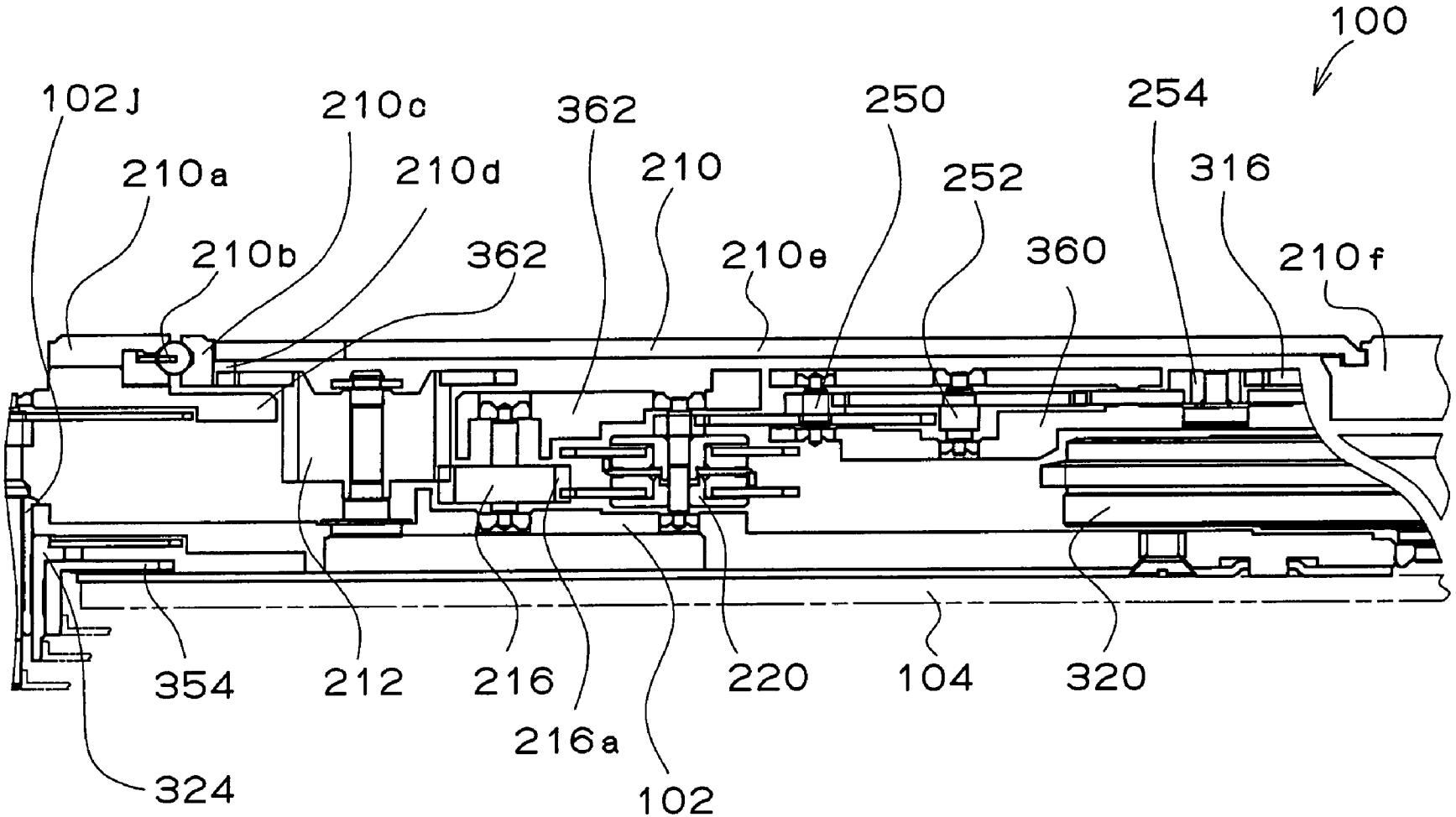
FIG. 2 is an outline partially sectional view showing the self-winding mechanism including the oscillating weight, the first intermediate wheel, a second intermediate wheel and the switching transmission wheel according to the embodiment of the timepiece with calendar of the invention.

Embodiments of a timepiece with calendar according to the invention will be explained with reference to the drawings as follows.

(1) Structure of Top Side of Movement:

First, an explanation will be given of structures of a top train wheel, an escaping mechanism and a speed control mechanism arranged on a top side of a "movement" (side of main plate opposed to a dial) in an embodiment of a timepiece with calendar according to the invention. "Movement" signifies a machine body of a timepiece including a mechanism for driving the timepiece.

With reference to FIG. 1 through FIG. 3, and FIG. 7 through FIG. 9, in the timepiece with calendar of the invention, a movement 100 includes a main plate 102 constituting a base plate of the movement 100. A winding stem 310 is rotatably integrated to a winding stem guide hole of the main plate 102. A dial 104 (shown in FIG. 1, FIG. 2, FIG. 8, FIG. 9 by imaginary lines) is attached to the movement 100.

Generally, in both sides of the main plate, a side thereof having the dial is referred to as "back side" of the movement (or, "back side of main plate") and a side thereof opposed to the side having the dial plate is referred to as "top side" of the movement (or, "top side of main plate"). A train wheel integrated to "top side" of the movement is referred to as "top train wheel" and a train wheel integrated to "back side" of the movement is referred to as "back train wheel". In reference to FIG. 7, an escapement•speed control apparatus including a balance with hairspring 340, and escape wheel & pinion 330 and a pallet fork 342 and a top train wheel including a second wheel & pinion 328, a third wheel & pinion 326, a center wheel & pinion 325 and a movement barrel complete 320 are arranged on the "top side" of a movement 100. Further, a barrel bridge 360 for rotatably supporting an upper shaft portion of the movement barrel complete 320 and an upper shaft portion of the center wheel & pinion 325, a train wheel bridge 362 for rotatably supporting an upper shaft portion of the third wheel & pinion 326, an upper shaft portion of the second wheel & pinion 328 and an upper shaft portion of the escape wheel & pinion 330 and a pallet bridge 366 for rotatably supporting an upper shaft portion of the pallet fork 342 and a balance bridge 366 for rotatably supporting an upper shaft portion of the balance with hairspring 340 are arranged on the "top side" of the movement 100.

(2) Structures and Operation of Escapement•Speed Control Apparatus and Top Train Wheel:

Next, structures of the escapement•speed control apparatus and the top train wheel will be explained in the embodiment of the timepiece with calendar of the invention. A position of the winding stem 310 in an axis line direction is determined by a switching apparatus (details thereof will be given later) including a setting lever, a yoke, a yoke spring, a yoke holder and the like. When the winding stem 310 is rotated in a state in which the winding stem 310 is disposed at a first winding stem position (0 stage) most proximate to an inner side of the movement 100 along the rotational axis line direction, a winding pinion (not illustrated) is rotated via rotation of a clutch wheel (not illustrated). A crown wheel (not illustrated) is comprised to rotate by rotation of the winding pinion. A ratchet wheel 316 is rotated by rotation of the crown wheel. The movement barrel complete 320 is provided with a barrel wheel 320*d*, a barrel shaft 320*f* and a mainspring 322. The mainspring 322 contained in the movement barrel complete 320 is comprised to be wound up by rotating the ratchet wheel 316.

The center wheel & pinion 325 is comprised to rotate by rotation of the movement barrel complete 320. The center wheel & pinion 325 includes a center wheel 325*a* and a center pinion 325*b*. The barrel wheel 320*d* is comprised to be brought in mesh with the center pinion 325*b*. The third wheel & pinion 326 is comprised to rotate by rotation of the center wheel & pinion 325. The third wheel & pinion 326 includes a third wheel 326*a* and the third pinion 326*b*. The second wheel & pinion 328 is comprised to rotate by one rotation in 1 minute by rotation of the third wheel & pinion 326. The second wheel & pinion 328 includes a second wheel 328*a* and a second pinion 328*b*. The third wheel 326*a* is comprised to be brought in mesh with the second pinion 328*b*. The escape wheel & pinion 330 is comprised to rotate by rotation of the second wheel & pinion 328 while being controlled by the pallet fork 342. The escape wheel & pinion 330 includes an escape wheel 330*a* and an escape pinion 330*b*. The second wheel 328*a* is comprised to be brought in mesh with the escape pinion 330*b*. The movement barrel complete 320, the center wheel & pinion 325, the third wheel & pinion 326 and the second wheel & pinion 328 constitute the top train wheel.

The escapement•speed control apparatus for controlling rotation of the top train wheel includes the balance with hairspring 340, the escape wheel & pinion 330 and the pallet fork 342. That is, the escape wheel & pinion 330, the pallet fork 342 and the balance with hairspring 340 constitute escapement•speed control apparatus. The balance with hairspring 340 includes a balance shaft 340*a*, a balance wheel 340*b* and a hairspring 340*c*. The hairspring 340*c* is a thin plate spring of a mode in a spiral shape (helical shape) having a plural winding number. The balance with hairspring 340 is rotatably supported by the main plate 102 and the balance bridge 366.

A minute indicator 324 includes a minute wheel 324*a* and a cannon pinion 324*b*. The minute wheel 324*a* is comprised to be brought in mesh with the third pinion 326*b*. The minute wheel 324*a* and the cannon pinion 324*b* are comprised to rotate integrally. The cannon pinion 324*b* and the minute wheel 324*a* are provided with a slip mechanism comprised such that the cannon pinion 324*b* can be slipped relative to the minute wheel 324*a*. A minute wheel & pinion 348 is comprised to rotate by rotation of the third wheel & pinion 326 via rotation of the minute indicator 324. The minute wheel & pinion 348 includes a minute wheel 348*a* and a minute pinion 348*b*. The cannon pinion 324*b* is comprised to be brought in mesh with the minute wheel 348*a*. An hour wheel 354 is comprised to be brought in mesh with the minute pinion 348*b*. The hour wheel 354 is comprised to rotate by one rotation in 12 hours by rotation of the minute wheel & pinion 348. The minute indicator 324, the minute wheel & pinion 348 and the hour wheel 354 constitute the back train wheel.

The movement barrel complete 320 and the center wheel & pinion 325 are rotatably supported by the main plate 102 and the barrel bridge 360. That is, an upper shaft portion of the movement barrel complete 320, an upper shaft portion of the center wheel & pinion 325 and an upper shaft portion of the escape wheel & pinion 330 are rotatably supported by the train wheel bridge 362. Further, a lower shaft portion of the movement barrel complete 320 and a lower shaft portion of the center wheel & pinion 325 are rotatably supported by the main plate 102. The third wheel & pinion 326, the second wheel & pinion 328 and the escape wheel & pinion 330 are rotatably supported by the main plate 102 and the train wheel bridge 362. That is, an upper shaft portion of the third wheel & pinion 326, an upper shaft portion of the second wheel & pinion 328 and an upper shaft portion of the escape wheel & pinion 330 are rotatably supported by the train wheel bridge 362.

Further a lower shaft portion of the third wheel & pinion 326 and a lower shaft portion of the escape wheel & pinion 330 are rotatably supported by the main plate 102. A lower shaft portion of the second wheel & pinion 328 is rotatably supported in a center hole of a center pipe 102*j* fixed to the main plate 102. The pallet fork 342 is rotatably supported by the main plate 102 and a pallet bridge 364. That is, an upper shaft portion of the pallet fork 342 is supported rotatably by the pallet bridge 364. A lower shaft portion of the pallet fork 342 is rotatably supported by the main plate 102.

The minute indicator 324 is rotated by one rotation in 1 hour by rotation of the movement barrel complete 320 via rotation of the center wheel & pinion 325 and the third wheel & pinion 326. A minute hand 352 attached to the cannon pinion 324*b* of the minute indicator & pinion 324 indicates "minute". The second wheel & pinion 328 is rotated by one rotation in 1 minute by rotation of the center wheel & pinion 325 via rotation of the third wheel & pinion 326. A second hand 358 attached to the second wheel & pinion 328 indicates "second". The hour wheel 354 is rotated by one rotation for 12 hours based on rotation of the minute indicator 324 via rotation of the minute wheel 348. An hour hand 356 attached to the hour wheel 354 indicates "hour".

Figure 13:
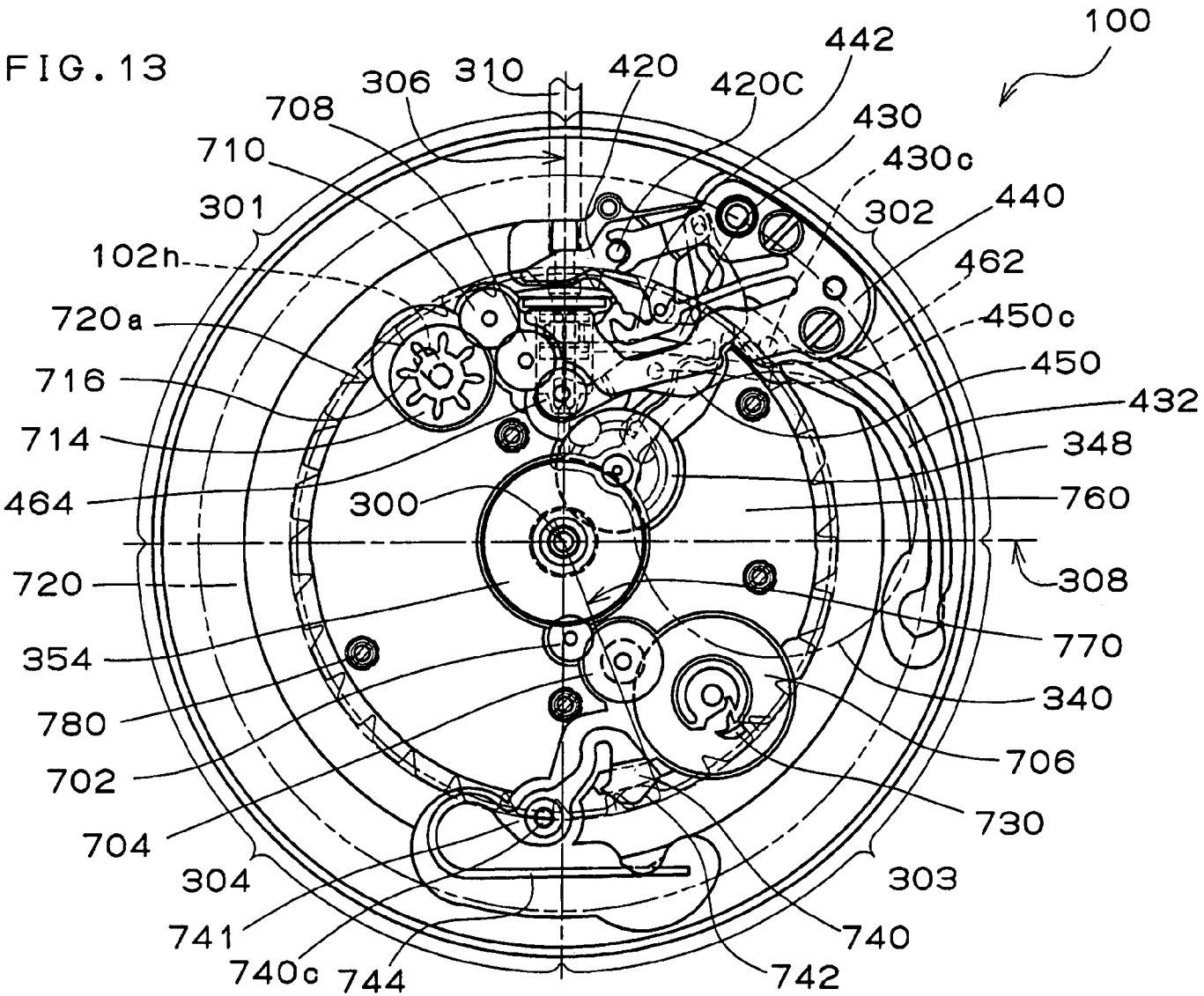
FIG. 13 is a plane view showing an outline shape of a back side of the movement in a state in which the winding stem is disposed at 0 stage to start feeding a date indicator according to the embodiment of the time piece with calendar of the invention.

When the winding stem 310 is rotated in a state in which the winding stem 310 is pulled to dispose at a third winding stem position (second stage), the minute wheel 348 can be rotated via rotation of a clutch wheel 462 (refer to FIG. 13) and a setting wheel 464 (refer to FIG. 13). When the minute wheel 348 is rotated under the state, the cannon pinion 324*b* and the hour wheel 354 can be rotated and therefore, time of the timepiece can be corrected. Under the state, the cannon pinion 324*b* can be slipped relative to the minute wheel 324*a* by the slip mechanism provided to the cannon pinion 324*b* and the minute wheel 324*a*.

(3) Structure of Self-Winding Mechanism:

Next, a structure of self-winding mechanism will be explained in the embodiment of the timepiece with calendar of the invention. In reference to FIG. 1 through FIG. 3, the self-winding mechanism includes an oscillating weight 210, a first intermediate wheel & pinion 212 rotated based on rotation of the oscillating weight 210, a second intermediate wheel 216 rotated based on rotation of the first intermediate wheel & pinion 212, a switching transmission wheel 220 rotated in one direction based on rotation of the first intermediate wheel & pinion 212 and the second intermediate wheel 216, a first reduction wheel & pinion 250 rotated based on rotation of the switching transmission wheel 220, a second reduction wheel & pinion 252 rotated based on the first reduction wheel & pinion 250, and a third reduction wheel & pinion 254 rotated based on rotation of the second reduction wheel & pinion 252. The oscillating wheel 210 includes an inner ring 210*a* fixed to the train wheel bridge 362, a plurality of balls 210*b*, an outer ring 210*c*, an oscillating weight pinion 210*d* integrally provided with the outer ring 210*c*, an oscillating weight body 210*e* fixed to the outer ring 210*c*, and an oscillating heavy weight 210*f* fixed to the oscillating weight body 210*e*. The outer ring 210*c* is comprised to be rotatable relative to the inner ring 210*a* via the ball 210*b*.

The first intermediate wheel & pinion 212 includes a first intermediate wheel 212*a* and a first intermediate pinion 212*b*. The first intermediate wheel & pinion 212 is provided rotatably relative to a first intermediate wheel pin 102*g* which is provided the main plate 102. The oscillation weight pinion 210*d* is comprised to be brought in mesh with the first intermediate wheel 212*a*. The second intermediate wheel 216 includes a second intermediate wheel gear 216*a*. The second intermediate wheel gear 216*a* is comprised to be brought in mesh with the first intermediate pinion 212*b*. An upper shaft portion of the second intermediate wheel 216 and an upper shaft portion 220*a* of the switching transmission wheel 220 are provided rotatably by the wheel train bridge 362. A lower shaft portion of the second intermediate wheel 216 and a lower shat portion 220*e* of the switching transmission wheel 220 are provided rotatably by the main plate 102.

The first reduction wheel & gear 250 includes a first reduction wheel 250*a* and a first reduction pinion 250*b*. The second reduction wheel 252 includes a second reduction wheel gear 252*a*. The first reduction pinion 252*b* is comprised to be brought in mesh with the second reduction wheel gear 252*a*. The third reduction wheel 254 includes a third reduction wheel 254*a* and a third reduction pinion 254*b*. The second reduction wheel gear 252*a* is comprised to be brought in mesh with the first reduction pinion 250*b* and the third reduction wheel 254*a*. An upper shaft portion of the first reduction wheel & pinion 250 and an upper shaft portion of the second reduction wheel 252 are provided rotatably by a reduction bridge 270. A lower shaft portion of the first reduction wheel & pinion 250 and a lower shaft portion of the second reduction wheel 252 are provided rotatably by the barrel bridge 360. The third reduction wheel & pinion 254 is provided rotatably by a third reduction wheel pin 360*g* provided at the barrel bridge 360. The third reduction pinion 254*b* is comprised to be brought in mesh with the ratchet wheel 316.

(4) Structure of Switching Transmission Wheel:

In reference to FIG. 1 through FIG. 4, the switching transmission wheel 220 includes a switching transmission pinion 222, a switching upper stage wheel 230 provided rotatably relative to the switching transmission pinion 222, a switching upper spacer 236 fixed to the switching transmission pinion 222, a switching finger 238 fixed to the switching transmission pinion 222, a switching lower stage wheel 240 provided rotatably relative to the switching transmission pinion 222, and a switching lower spacer 246 fixed to the switching transmission pinion 222. The switching transmission pinion 222 includes an upper shaft portion 222*a*, a pinion portion 222*b*, a first stage portion 222*c*, a second stage portion 222*d*, and a lower shaft portion 222*e*. The switching upper spacer 236 is fixed to the first stage portion 222*c*. The switching lower spacer 246 is fixed to the second stage portion 222*d*.

The switching upper stage portion 230 includes a switching upper wheel body 232 brought in mesh with the first intermediate pinion 212*b* and a switching upper finger wheel 234 having a ratchet wheel 234*h* and fixed to the switching upper wheel body 232. The switching upper wheel body 232 and the switching upper finger wheel 234 are comprised to be rotatable relative to the switching upper spacer 236 between a flange portion of the switching upper seat 236 and the switching finger 238. The switching lower stage wheel 240 includes a switching lower wheel body 242 brought in mesh with the second intermediate wheel 216*a* of the second intermediate wheel & gear 216 and a switching lower finger wheel 244 having a ratchet wheel 244*h* and fixed to the switching lower wheel body 242. The switching lower wheel body 242 and the switching lower finger wheel 244 are comprised to be rotatable relative to the switching lower seat 246 between a flange portion of the switching lower spacer 246 and the switching finger 233.

Figure 4:
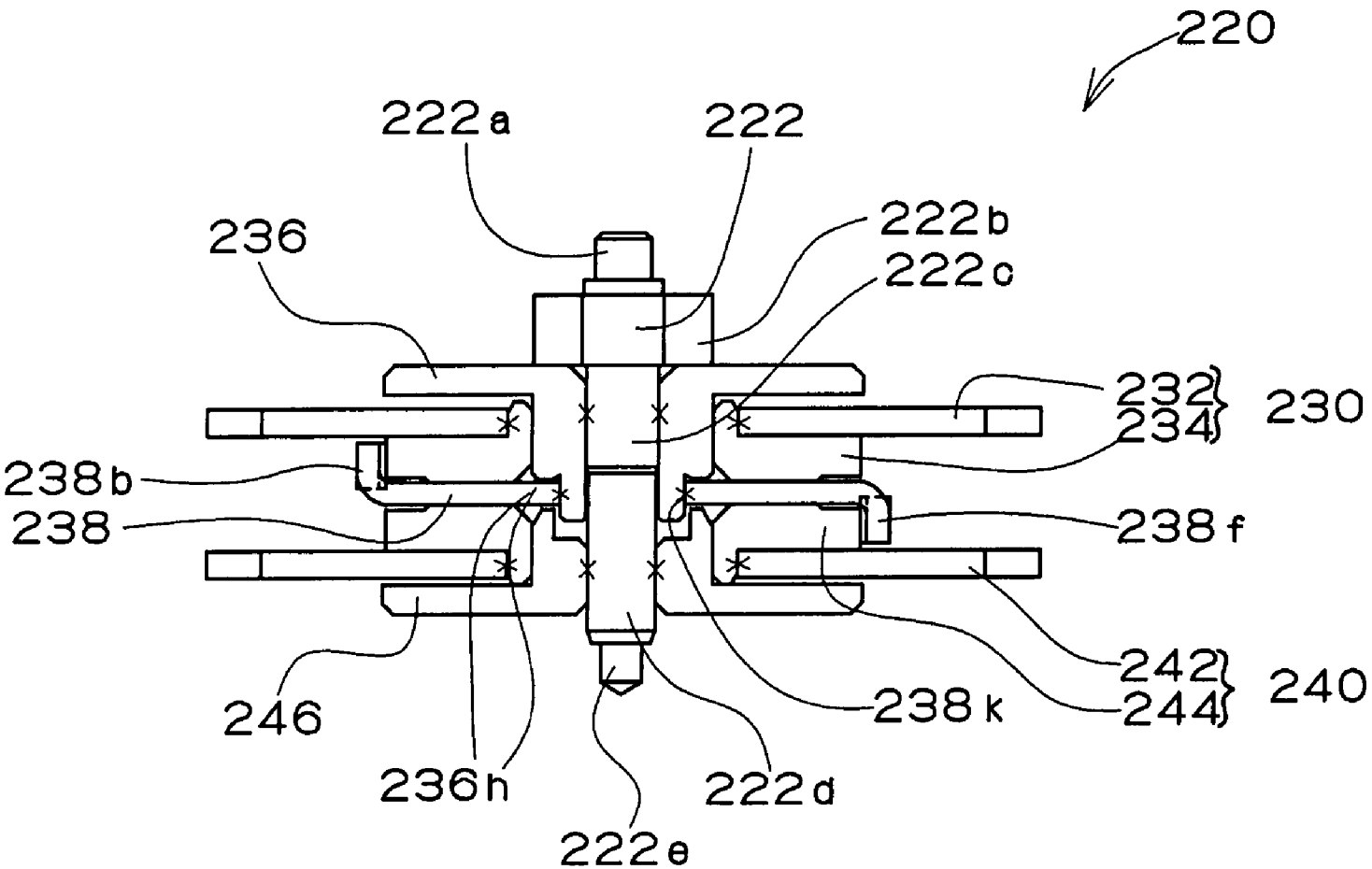
FIG. 4 is a sectional view showing a structure of the switching transmission wheel according to the embodiment of the timepiece with calendar of the invention.
Figure 5:
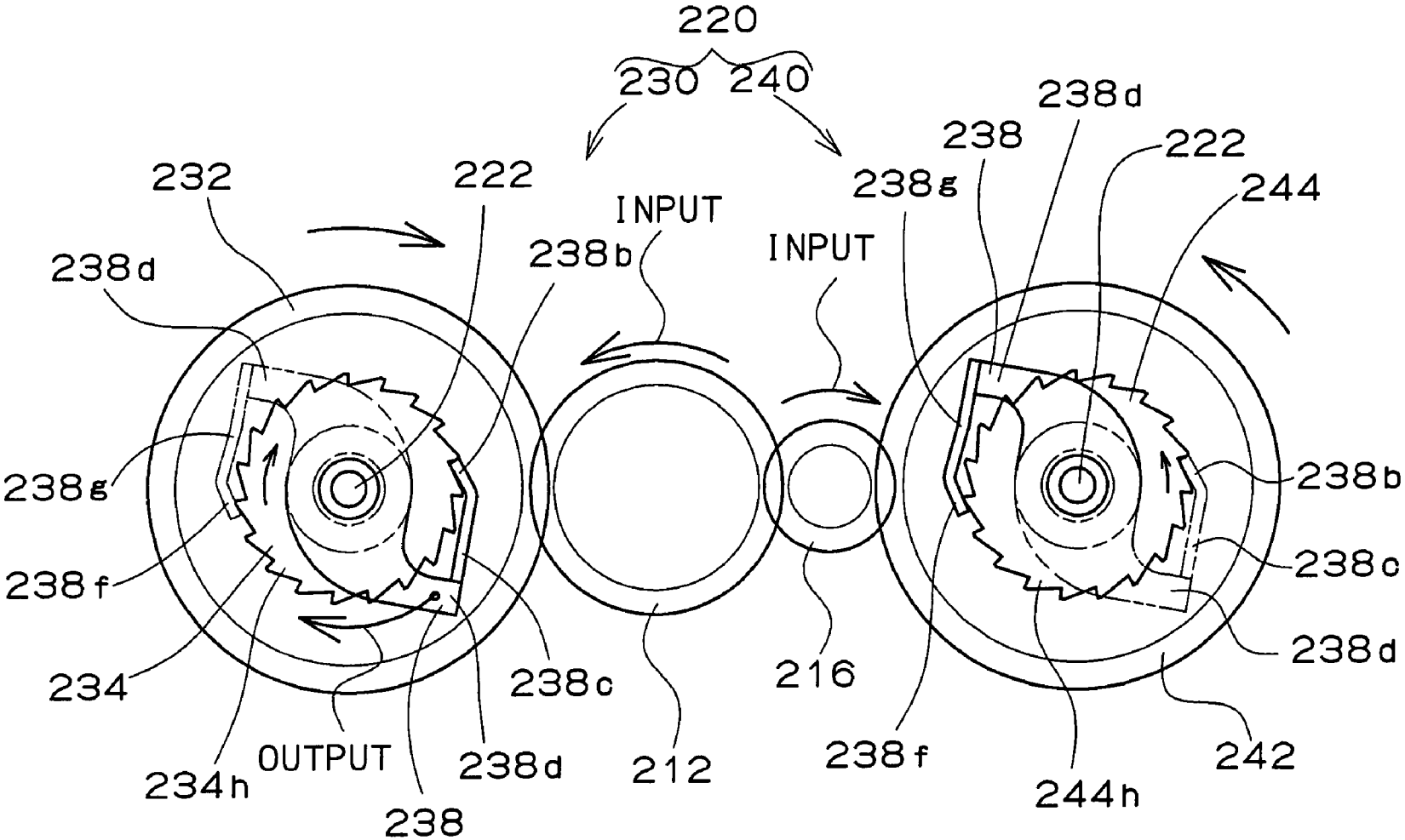
FIG. 5 is a plane view showing operation principle of the switching transmission wheel when the first intermediate wheel is rotated in the counterclockwise direction according to the embodiment of the timepiece with calendar of the invention.
Figure 6:
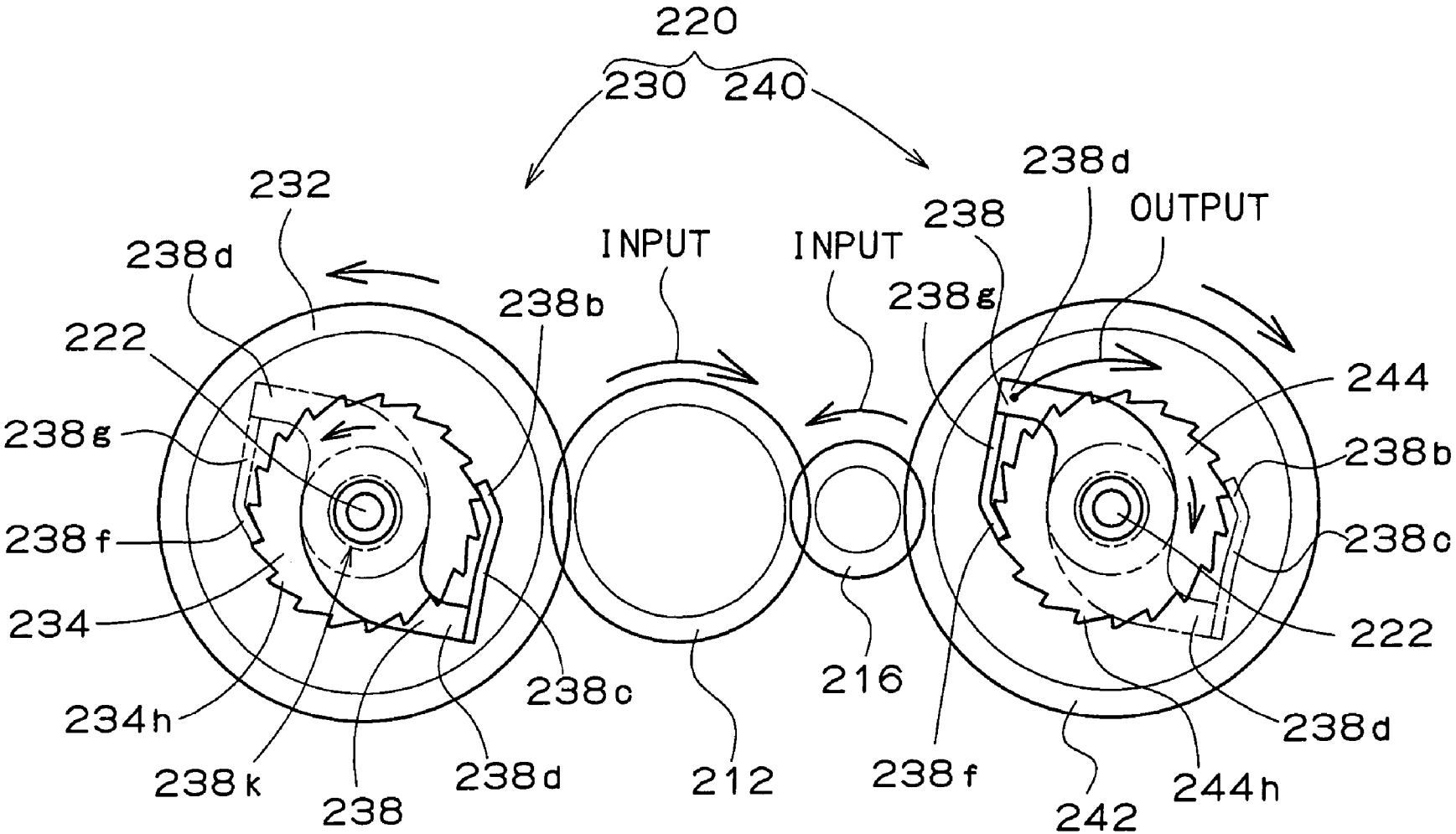
FIG. 6 is a plane view showing the operation principle of the switching transmission wheel when the first intermediate wheel is rotated in the clockwise direction according to the embodiment of the timepiece with calendar of the invention.

In reference to FIG. 4 through FIG. 6, the switching finger 238 includes an upper operating portion 238*b*, an upper spring portion 238*c*, a base portion 238*d*, a lower operating portion 238*f*, a lower spring portion 238*g*, and a center hole 238*k* provided at the base portion 238*d*. The upper spring portion 238*c* of the switching finger 238 is provided between the upper operating portion 238*b* and the base portion 238*d* and the lower spring portion 238*g* of the switching finger 238 is provided between the lower operating portion 238*f* and the base portion 238*d*.

The switching finger 238 is made of an elastic material of stainless steel or the like. The center hole of the base portion 238*d* is fixed to the switching upper spacer 238. Therefore, the switching finger 238 is comprised to rotate integrally with the switching reduction pinion 222. The upper operating portion 238*b* of the switching finger 238 is comprised to be able to be brought in mesh with the ratchet wheel 234*h* of the switching upper finger wheel 234. The lower operating portion 238*f* of the switching finger 238 is comprised to be able to be brought in mesh with the ratchet wheel 244*h* of the switching lower finger wheel 244. The upper spring portion 238*c* of the switching finger 238 may preferably be comprised to be orthogonal in an upper direction relative to the base portion 238*d*. The upper operating portion 238*b* of the switching finger 238 is formed at a front end portion of the upper spring portion 238*c*. By the constitution, the upper operating portion 238*b* of the switching finger 238 is firmly pressed to the ratchet wheel 234*h* of the switching upper finger wheel 234 by elastic force of the upper spring portion 238*c*.

The lower spring portion 238*g* of the switching finger 238 may preferably be comprised to be orthogonal in a lower direction relative to the base portion 238*d*. The lower operating portion 238*f* of the switching finger 238 is formed at a front end portion of the lower spring portion 238*g*. By the constitution, the lower operating portion 238*f* of the switching finger 238 is firmly pressed to the ratchet wheel 244*h* of the switching lower finger wheel 244 by elastic force of the lower spring portion 238*g*. A planar shape of the switching finger 238 when projected to a plane in parallel with the base portion 238*d* may preferably be a shape of point symmetry with the center hole 238*k* of the switching finger 238 as a reference. By the constitution, the switching finger 238 is pressed to the ratchet wheel 234*h* of the switching upper finger wheel 234 and the ratchet wheel 244*h* of the switching lower finger wheel 244 firmly with excellent balance.

(5) Operation of Self-Winding Mechanism:

Next, operation of a self-winding mechanism will be explained in the embodiment of the timepiece with calendar of the invention. An explanation will be given of operation when the oscillating weight 210 is rotated in the clockwise direction in reference to FIG. 3 and FIG. 5. When the oscillating weight 210 is rotated in the clockwise direction, the first intermediate wheel 212 is rotated in the counterclockwise direction. When the first intermediate wheel 212 is rotated in the counterclockwise direction, the switching upper wheel body 232 is rotated in the clockwise direction. When the switching upper wheel body 232 is rotated in the clockwise direction, also the switching upper finger wheel 234 is rotated in the clockwise direction. Under the state, the upper operating portion 238*b* of the switching finger 238 is brought in mesh with the ratchet wheel 234*h* of the switching upper finger wheel 234. Therefore, by rotating the switching upper finger wheel 234 in the clockwise direction, also the switching finger 238 is rotated in the clockwise direction and therefore, also the switching transmission pinion 222 is rotated in the clockwise direction.

Further, when the first intermediate wheel 212 is rotated in the counterclockwise direction, the second intermediate wheel 216 is rotated in the clockwise direction. When the second intermediate wheel 216 is rotated in the clockwise direction, the switching lower wheel body 242 is rotated in the counterclockwise direction. When the switching lower wheel body 242 is rotated in the counterclockwise direction, also the switching lower finger wheel 244 is rotated in the counterclockwise direction. Under the state, the lower operating portion 238*f* of the switching finger 238 is operated to escape from the ratchet wheel 244*h* of the switching lower finger wheel 244. Therefore, the switching reduction pinion 222 cannot be rotated by rotating the switching lower wheel body 242.

Figure 3:
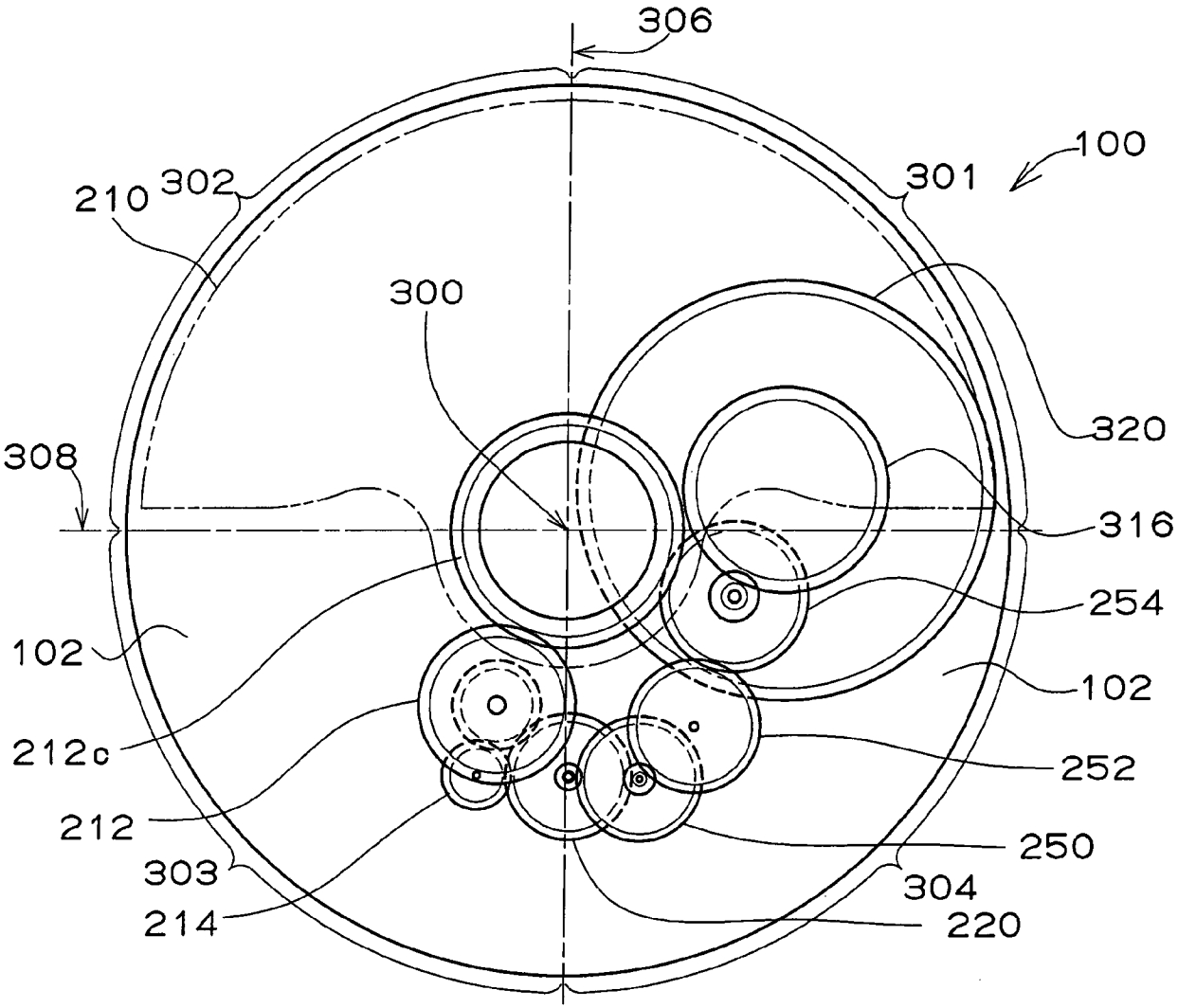
FIG. 3 is a plane view showing an outline constitution of the self-winding mechanism according to the embodiment of the timepiece with calendar of the invention.

Next, an explanation will be given of an operation when the oscillating weight 210 is rotated in the counterclockwise direction in reference to FIG. 3 and FIG. 6. When the oscillating weight 210 is rotated in the counterclockwise direction, the first intermediate wheel 212 is rotated in the clockwise direction. When the first intermediate wheel 212 is rotated in the clockwise direction, the switching upper wheel body 232 is rotated in the counterclockwise direction. When the switching upper wheel body 232 is rotated in the counterclockwise direction, also the switching upper finger wheel 234 is rotated in the counterclockwise direction. Under the state, the upper operating portion 238*b* of the switching finger 238 is operated to escape from the ratchet wheel 234*h* of the switching upper finger wheel 234. Therefore, the switching transmission pinion 222 cannot be rotated by rotating the switching upper wheel body 232.

Further, when the first intermediate wheel 212 is rotated in the clockwise direction, the second intermediate wheel 216 is rotated in the counterclockwise direction. When the second intermediate wheel 216 is rotated in the counterclockwise direction, the switching lower wheel body 242 is rotated in the clockwise direction. When the switching lower wheel body 242 is rotated in the clockwise direction, also the switching lower finger wheel 244 is rotated in the clockwise direction. Under the state, the lower operating portion 238*f* of the switching finger 238 is brought in mesh with the ratchet wheel 244*h* of the switching lower finger wheel 244. Therefore, by rotating the switching lower finger wheel 244 in the clockwise direction, also the switching finger 238 is rotated in the clockwise direction and therefore, the switching transmission pinion 222 is also rotated in the clockwise direction.

As has been explained above, according to the self-winding mechanism of the timepiece with calendar of the invention, the switching transmission pinion 222 can be rotated in a constant direction, that is, in the clockwise direction when the oscillating weight 210 is rotated in the clockwise direction and when the rotating weight 210 is rotated in the counterclockwise direction. Such an operation is firmly carried out by the switching transmission wheel 220 of the self-winding mechanism of the timepiece according to the invention having the switching finger 238.

According to the self-winding mechanism of the timepiece with calendar of the invention, regardless of the direction of oscillating the oscillating weight 210, the rotating direction of the switching transmission pinion 222 is constant and therefore, based on rotation of the switching transmission pinion 222, the ratchet wheel 316 can be rotated only in one direction via the first reduction wheel & pinion 250 and the third reduction wheel & pinion 252. In reference to FIG. 3 and FIG. 8, by rotating the ratchet wheel 316, the mainspring 322 in the movement barrel complete 320 can be wound up only in one direction.

(5) Structure of Operation of Modified Example of Self-Winding Mechanism:

Next, an explanation will mainly be given of a structure and operation of a modified example of a self-winding mechanism in the embodiment of the timepiece with calendar of the invention. The following explanation is carried out only with regard to a difference between the structure and the operation of the modified example of the self-winding mechanism of the timepiece according to the invention and the structure and the operation of the above-described embodiment of the self-winding mechanism of the timepiece of the invention. Therefore, the explanation of the above-described embodiment of the self-winding mechanism of the timepiece of the invention will be applied to portions which are not described below.

Figure 10:
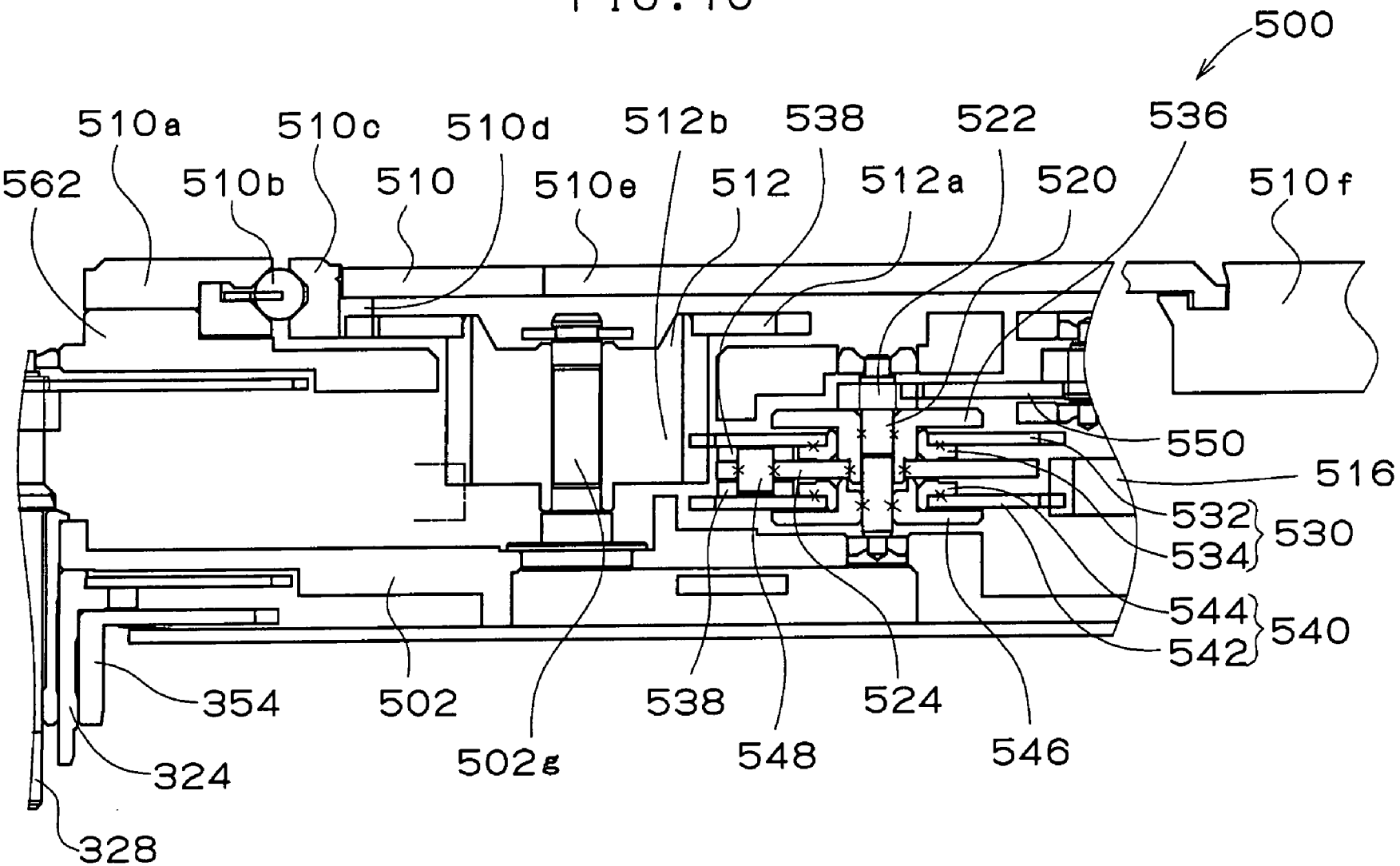
FIG. 10 is a plane view showing an outline constitution of a modified example of a self-winding mechanism according to the embodiment of the timepiece with calendar of the invention.

In reference to FIG. 10, according to the modified example of the self-winding mechanism of the timepiece with calendar of the invention, the self-winding mechanism includes an oscillating weight 510, a first intermediate wheel 512 rotated based on rotation of the oscillating weight 510, a second intermediate wheel 516 rotated based on rotation of the first intermediate wheel & pinion 512, and a switching transmission wheel 520 rotated in one direction based on rotation of the first intermediate wheel 512 and the second intermediate wheel 516. The oscillating weight 510 includes an inner ring 510*a* fixed to a train wheel bridge 562, a plurality of balls 510*b*, an outer ring 510*c*, an oscillating weight pinion 510*d* provided integrally with the outer ring 510*c*, an oscillating weight body 510*e* fixed to the outer ring 510*c*, and an oscillating heavy weight 510*f* fixed to the oscillating weight body 510*e*.

The outer ring 510*c* is comprised to be rotatable relative to the inner ring 510*a* via the ball 510*b*. The first intermediate wheel & pinion 512 includes a first intermediate wheel 512*a* and a first intermediate pinion 512*b*. The first intermediate wheel & pinion 512 is provided rotatably relative to a first intermediate wheel pin 502*g* provided at a main plate 502. The oscillating weight pinion 510*d* is brought in mesh with the first intermediate wheel 512*a*. The switching transmission wheel 520 includes a switching transmission pinion 522, a switching upper stage wheel 530, a switching upper spacer 536 fixed to the switching transmission pinion 522, a switching middle spacer 524 fixed to the switching transmission pinion 522, a switching lower stage wheel 540, and a switching lower spacer 546 fixed to the switching transmission pinion 522.

The switching upper stage wheel 530 includes a switching upper wheel body 532 brought in mesh with the first intermediate pinion 512*b*, and a switching upper finger wheel 534 having a ratchet wheel 534*h* and fixed to the switching upper wheel body 532. The switching upper wheel body 532 and the switching upper finger wheel 534 are comprised to be rotatable relative to the switching upper spacer 536 between a flange portion of the switching upper spacer 536 and the switching middle spacer 524. The switching lower stage wheel 540 includes a switching lower wheel body 542 brought in mesh with a second intermediate wheel gear of the second intermediate wheel 516 and a switching lower finger wheel 544 having a ratchet wheel 544*h* and fixed to the switching lower wheel body 542. The switching lower wheel body 542 and the switching lower finger wheel 544 are comprised to be rotatable relative to the switching lower spacer 546 between a flange portion of the switching lower spacer 546 and the switching middle spacer 524.

A switching transmission wheel pin 526 is fixed to the switching middle spacer 524. An upper clutch finger 538 is arranged between the switching upper wheel body 532 and the switching middle spacer 524 to be rotatable with the switching transmission wheel pin 526 as a rotating center. Upper ratchet fingers 538*b* and 538*c* of the upper clutch finger 538 are comprised to be able to be brought in mesh with the ratchet wheel 534*h* of the switching upper finger wheel 534. A lower clutch finger 548 is arranged between the switching lower wheel body 542 and the switching middle spacer 524 to be able to rotate with the switching transmission wheel pin 526 as the rotating center. Lower ratchet fingers 548*b* and 548*c* of the lower clutch finger 548 are comprised to be able to be brought in mesh with the ratchet wheel 544*h* of the switching lower finger wheel 544.

Figure 11:
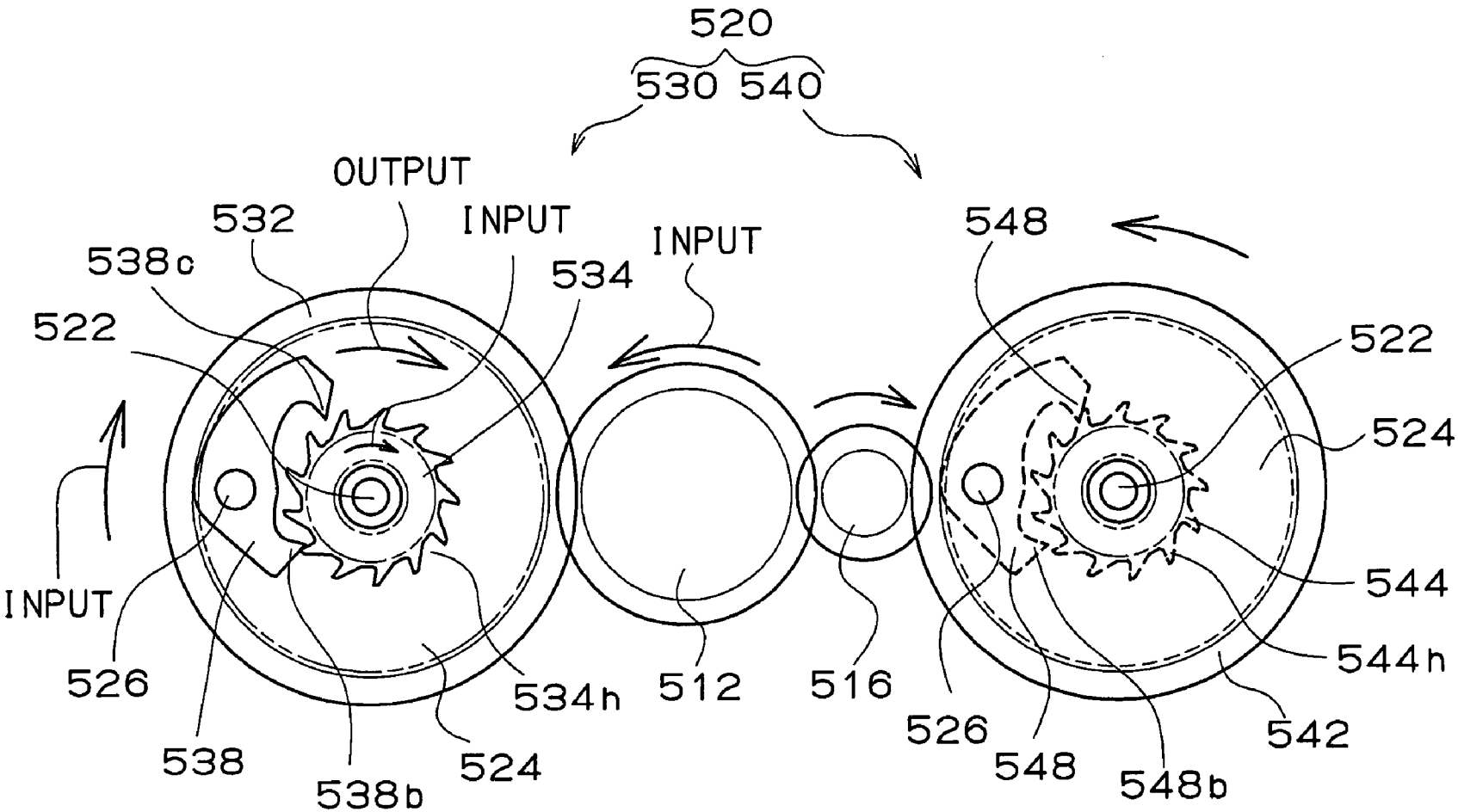
FIG. 11 is a plane view showing operation principle of a switching transmission wheel when a first intermediate wheel is rotated in the counterclockwise direction in the modified example of the self-winding mechanism according to the embodiment of the timepiece with calendar of the invention.

An explanation will be given of operation when the oscillating weight 510 is rotated in the clockwise direction in reference to FIG. 11. When the oscillating weight 510 is rotated in the clockwise direction, the first intermediate wheel 512 is rotated in the counterclockwise direction. When the first intermediate wheel 512 is rotated in the counterclockwise direction, the switching upper wheel body 532 is rotated in the clockwise direction. When the switching upper wheel body 532 is rotated in the clockwise direction, also the switching upper finger wheel 534 is rotated in the clockwise direction. Under the state, an upper ratchet finger 538*b* is brought in mesh with the ratchet wheel 534*h* of the switching upper finger wheel 534, the switching middle spacer 524 is rotated in the clockwise direction and therefore, also the switching reduction pinion 522 is rotated in the clockwise direction. Further, when the first intermediate wheel 512 is rotated in the counterclockwise direction, the second intermediate wheel 516 is rotated in the clockwise direction. When the second intermediate wheel 516 is rotated in the clockwise direction, the switching lower wheel body 542 is rotated in the counterclockwise direction. When the switching lower wheel body 542 is rotated in the counterclockwise direction, also the switching lower finger wheel 544 is rotated in the counterclockwise direction. Under the state, the lower ratchet fingers 548*b* and 548*c* are operated to escape from the ratchet wheel 544*h* of the switching lower finger wheel 544 and therefore, the switching reduction pinion 522 cannot be rotated by rotating the switching lower wheel body 542.

Figure 12:
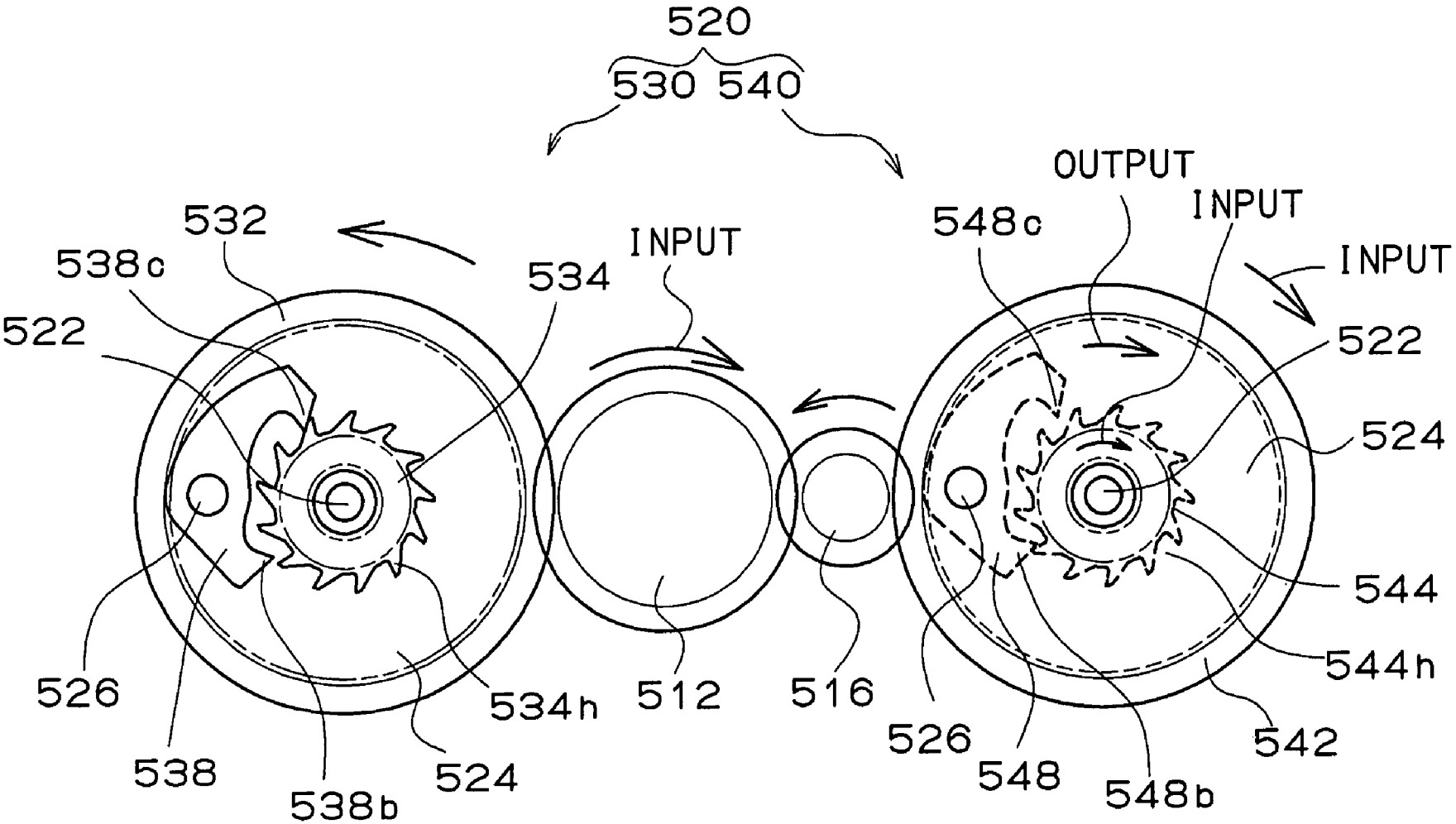
FIG. 12 is a plane view showing the operation principle of the switching transmission wheel when the first intermediate wheel is rotated in the clockwise direction in the modified example of the self-winding mechanism according to the embodiment of the timepiece with calendar of the invention.

Next, an explanation will be given of operation when the oscillating weight 510 is rotated in the counterclockwise direction in reference to FIG. 12. When the oscillating weight 510 is rotated in the counterclockwise direction, the first intermediate wheel & pinion 512 is rotated in the clockwise direction. When the first intermediate wheel & pinion 512 is rotated in the clockwise direction, the switching upper wheel body 532 is rotated in the counterclockwise direction. When the switching upper wheel body 532 is rotated in the counterclockwise direction, also the switching upper finger wheel 534 is rotated in the counterclockwise direction. Under the state, the upper ratchet fingers 538*b* and 538*c* are operated to escape from the ratchet wheel 534*h* of the switching upper finger wheel 534 and therefore, the switching transmission pinion 522 cannot be rotated by rotating the switching upper wheel body 532. Further, when the first intermediate wheel & pinion 512 is rotated in the clockwise direction, the second intermediate wheel 516 is rotated in the counterclockwise direction. When the second intermediate wheel 516 is rotated in the counterclockwise direction, the switching lower wheel body 542 is rotated in the clockwise direction. When the switching lower wheel body 542 is rotated in the clockwise direction, also the switching lower finger wheel 544 is rotated in the clockwise direction. Under the state, the lower ratchet finger 548*b* is brought in mesh with the ratchet wheel 544*h* of the switching lower finger wheel 544, the switching middle spacer 524 is rotated in the clockwise direction and therefore, the switching reduction pinion 522 is also rotated in the clockwise direction. Therefore, according to the self-winding mechanism, the switching reduction pinion 522 can be rotated in a constant direction, that is, in the clockwise direction when the oscillating weight 510 is rotated in the clockwise direction and when the oscillating weight 510 is rotated in the counterclockwise direction.

According to the above-described modified example of the self-winding mechanism, regardless of the direction of rotating the oscillating weight 510, the rotating direction of the switching reduction pinion 522 is constant and therefore, the ratchet wheel 316 can be rotated only in one direction via rotation of a transmission train wheel including the first reduction wheel 550 and the like based on rotation of the switching transmission pinion 522. Further, the mainspring in the movement barrel complete 320 can be wound up only in one direction by rotating the ratchet wheel 316.

Figure 7:
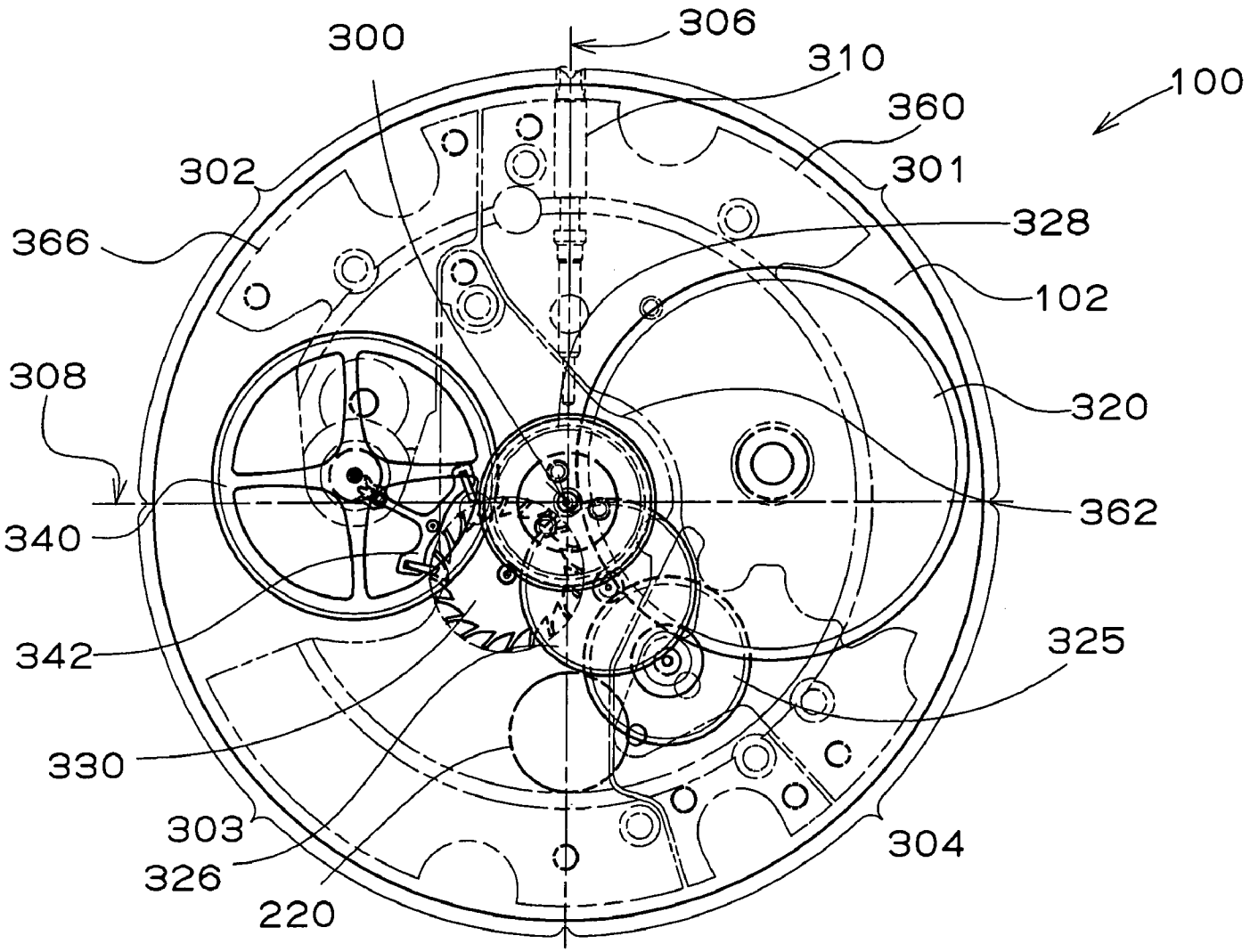
FIG. 7 is a plane view showing an outline shape of a top side of a movement according to the embodiment of the timepiece with calendar of the invention (in FIG. 7, portions of parts of the self-winding mechanism and the like are omitted and bridge members are indicated by imaginary lines)
Figure 8:
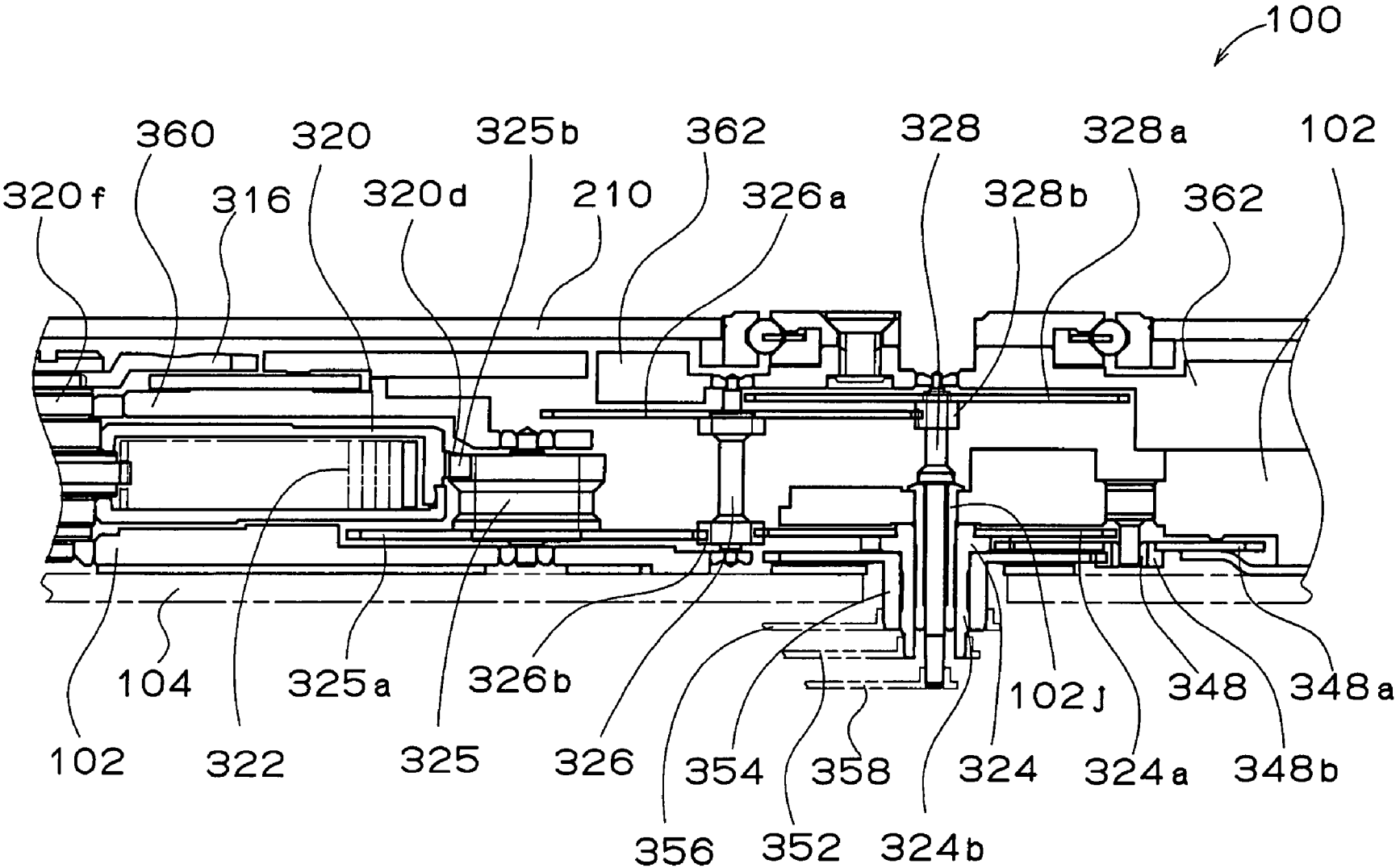
FIG. 8 is an outline partially sectional view showing a portion from a movement barrel complete to an hour wheel according to the embodiment of the timepiece with calendar of the invention.
Figure 9:
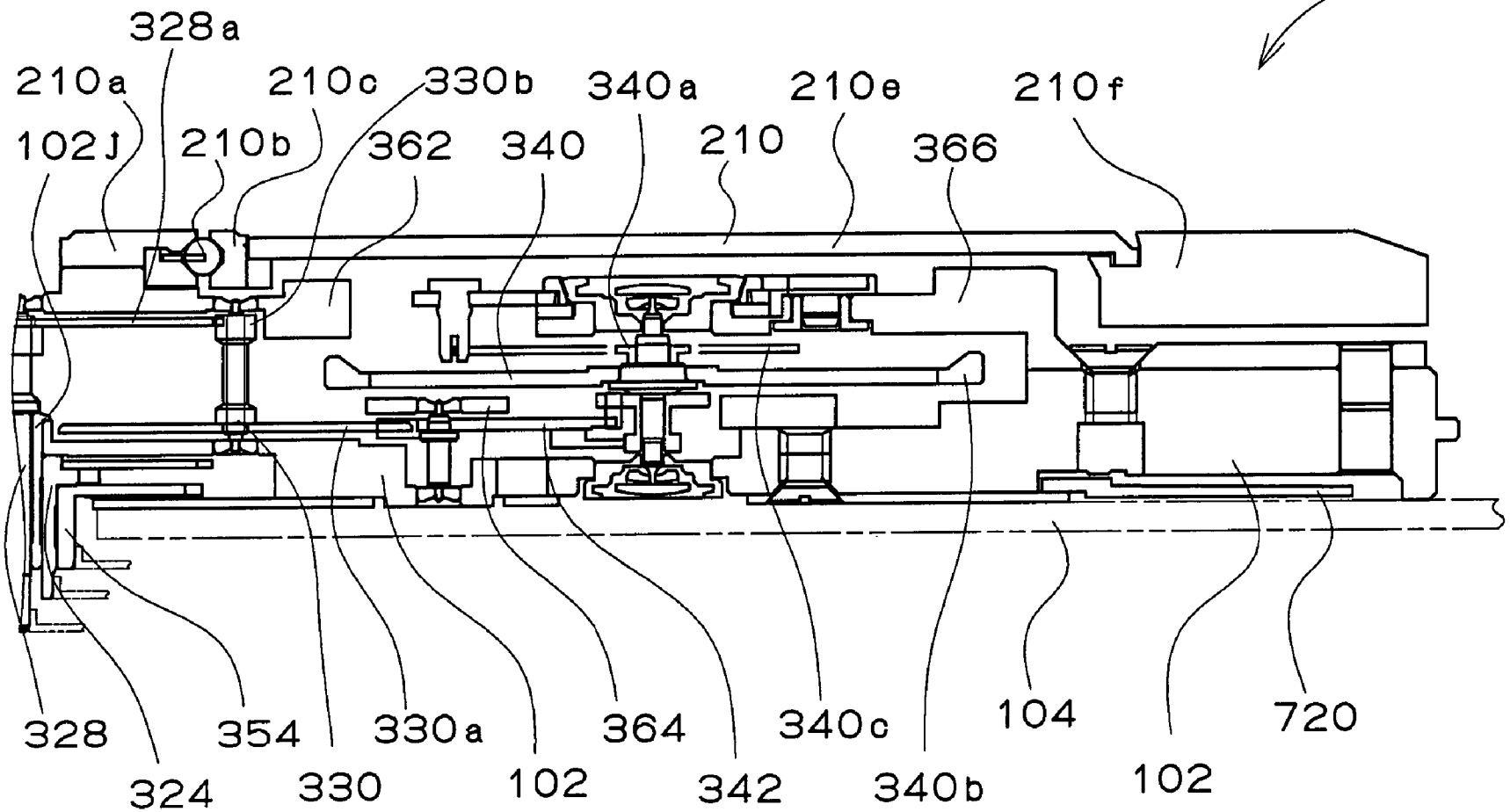
FIG. 9 is an outline partially sectional view showing a portion from an escape wheel & pinion to a balance with hair spring according to the embodiment of the timepiece with calendar of the invention.

(7) Arrangement of Part on Top Side of Movement:

In FIG. 1 and FIG. 7, at the main plate 102, there are defined the main plate reference vertical axis line 306 passing the rotating center 300 of the minute indicator 324 and substantially in parallel with the center axis line of the winding stem 310 and the main plate reference horizontal axis line 308 passing the rotating center 300 of the minute indicator 324 and orthogonal to the main plate reference vertical axis line 306. The main plate 102 is provided with the first region 301 disposed on one side of the main plate reference vertical axis line 306 and on the side of the main plate reference horizontal axis line 308 proximate to the winding stem 310. The main plate 102 is provided with the second region 302 disposed on other side of the main plate reference vertical axis line 306 and on the side of the main plate reference horizontal axis line 308 proximate to the winding stem 310. The main plate 102 is provided with the third region 303 disposed on the other side of the main plate reference vertical axis line 306 at which the second region 302 is present and on the side of the main plate reference horizontal axis line 308 remote from the winding stem 310. The main plate 102 is provided with the fourth region 304 disposed on the one side of the main plate reference vertical axis line 306 at which the first region is present and on the side of the main plate reference horizontal axis line 308 remote from the winding stem 310.

Although in FIG. 7, the first region 301 and the fourth region 304 are disposed on the right side of the main plate reference vertical axis line 306, the regions may be defined to dispose on the left side of the main plate reference vertical axis line 306. Naturally, in this case, the second region 302 and the third region 303 are defined to dispose on the right side of the main plate reference vertical axis line 306. In FIG. 3 and FIG. 7, the rotating center of the movement barrel complete 320 is disposed in the first region 301. By constituting in this way, the mainspring having large torque and capable of continuing for a long period of time can effectively be arranged on the top side of the movement. The rotational center of the movement barrel complete 320 may be disposed in the fourth region 304. The rotating center of the escape wheel & pinion 330 is disposed in the third region 303. The pivoting center of the pallet fork 342 is disposed in the third region 303. The rotating center of the balance with hairspring 340 is disposed in the second region 302. By constituting in this way, the large movement barrel complete can be used. Further, by the constitution, the balance with hairspring having large moment of inertia having further excellent time accuracy can effectively be arranged on the top side of the movement.

The rotating center of the balance with hairspring 340 may be disposed in the third region 303. That is, although the rotating center of the balance with hairspring 340 maybe disposed in the third region 303 or may be disposed in the second region 302, the balance with hairspring 340 is arranged to overlap the main plate reference horizontal axis line 308 between the second region 302 and the third region 303. By constituting in this way, the large third wheel & pinion 326 can effectively be arranged on the top side of the movement.

The rotating center of the switching transmission wheel 220 is disposed in the fourth region 304. However, the rotating center of the switching transmission wheel 220 may be disposed in the third region 303. That is, although the rotating center of the switching transmission wheel 220 may be disposed in the third region 303 or may be disposed in the fourth region 304, the switching transmission wheel 220 is arranged to overlap the main plate reference vertical axis line 306 between the third region 303 and the fourth region 304. By constituting in this way, on the top side of the movement, the switching transmission wheel 220 can effectively be arranged not to interfere with the top train wheel.

The rotating center of the second wheel & pinion 328 operated for indicating second is the same as the rotating center 300 of the minute indicator 324. That is, the embodiment of the timepiece with calendar of the invention shows a center three hands wrist watch. The rotating center of the second wheel & pinion 328 maybe disposed at a position separate from the rotating center 300 of the minute indicator 324. The third wheel & pinion 326 transmits rotation of the center wheel & pinion 325 to the second wheel & pinion 328. The rotating center of the third wheel & pinion 326 is disposed in the fourth region 304. By constituting in this way, the large third wheel & pinion 326 can effectively be arranged on the top side of the movement. Here, a number of train wheels is not restricted to that in the above-described but one or more of transmission wheels may further be added. Further, the pivoting center 420*c* of the setting lever 420 is comprised to dispose in the second region 302 and the pivoting center 430*c* of the yoke 430 is comprised to dispose in the second region 302.

Although it is preferable to arrange the above-described respective parts to constitute the structure shown in FIG. 7, the above-described respective parts may be arranged to constitute a structure of mirror symmetry with a structure shown in FIG. 7 relative to the main plate reference vertical axis line 306. For example, it may be comprised such that the rotating center of the movement barrel complete 320 is disposed in the second region 302, the rotating center of the escape wheel & pinion 330 is disposed in the fourth region 304, the pivoting center of the pallet fork 342 is disposed in the fourth region 304 and the rotating center of the balance with hairspring 340 is disposed in the first region 301. That is, according to the structure in mirror symmetry with the structure shown in FIG. 7, the rotating center of the balance with hairspring 340 may be disposed in the first region 301 or may be disposed in the fourth region 304, however, the balance with hairspring 340 is arranged to overlap the main plate reference horizontal axis line 308 between the first region 301 and the fourth region 304. Further, according to the structure in mirror symmetry with the structure shown in FIG. 7, it is comprised that the pivoting center 420*c* of the setting lever 420 is disposed in the first region 301 and the pivoting center 430*c* of the yoke 430 is disposed in the first region 301. By constituting in this way, similar to the constitution of FIG. 7, the small-sized and thin timepiece with calendar can be realized.

(8) Structure of Switching Apparatus:

Next, a structure of a switching apparatus will be explained in the embodiment of the timepiece with calendar according to the invention. In reference to FIG. 13, on the back side (dial side) of the movement 100, a pivoting center 420*c* of the setting lever 420 is disposed in the second region 302. A pivoting center 430*c* of the yoke 430 is disposed in the second region 302. A pivoting center 450*c* of the operating lever 450 is disposed in the second region 302. The yoke holder 440 presses portions of respectives of the setting lever 420, the yoke 430 and the operating lever 450 to the main plate 102. The setting lever 420, the yoke 430, the yoke holder 440 and the operating lever 450 are integrated to the back side of the main plate 102. The setting wheel 464 is rotatably attached to the operating lever 450. The clutch wheel 462 is coaxially attached to the winding stem 310.

It is preferable that the yoke holder 440 is fabricated by an elastically deformable material, for example, fabricated by stainless steel. It is preferable that the yoke 430 is fabricated by an elastically deformable material, for example, fabricated by stainless steel. A hat-like portion 442 of the yoke holder 440 is engaged with the setting lever positioning pin of the setting lever 420 to position the setting lever 420 in the rotating direction and set a switching weight of the winding stem 310.

An operating lever positioning pin for determining the position of the operating lever 450 is provided at the setting lever 420. An operating lever guide hole for receiving the operating lever positioning pin is provided at the operating lever 450. The operating lever positioning pin is comprised to move in the operating lever guide hole by rotating the setting lever 420. Thereby, the operating lever 450 is comprised not to rotate when the winding stem 310 is set from 0 stage to 1 state and the operating lever 450 is comprised to rotate when the winding stem 310 is set from 1 stage to 2 stage.

According to the timepiece with calendar of the invention, the hat-like portion 442 of the yoke holder 440 is comprised to be able to pull the winding stem 310 from 0 stage to 1 stage or 2 stage. By spring force of a spring portion 432 of the yoke 430, a guide valley portion of the yoke is pressed to a side face of a front end portion of the setting lever 420. The clutch wheel 462 is comprised to rotate but the clutch wheel 462 is comprised not to be brought in mesh with the setting wheel 464 when the setting stem 310 is rotated in a state in which the setting stem 310 is disposed at 0 stage. The clutch wheel 462 is comprised to rotate and the clutch wheel 462 is brought in mesh with the setting wheel 464 when the winding stem 310 is rotated in a state in which the winding stem 310 is disposed at 1 stage and the setting wheel 464 is comprised to rotate via rotation of the clutch wheel 462 when the winding stem 310 is rotated. The clutch wheel 462 is comprised to rotate when the winding stem 310 is rotated in a state in which the winding stem 310 is disposed at 2 stage. Further, when the winding stem 310 is set from 1 stage to 2 stage, by rotating the operating lever 450, the clutch wheel 462 is brought in mesh with the setting wheel 464 and the setting wheel 464 is brought in mesh with the minute wheel 348. The minute wheel 348 is comprised to rotate via rotation of the clutch wheel 462 and the setting wheel 464 when the winding stem 310 is rotated under the state.

(9) Structure of Calendar Apparatus:

Next, a structure of a calendar apparatus will be explained in the embodiment of the timepiece with calendar of the invention. In reference to FIG. 13, according to the timepiece with calendar of the invention, on the back side (dial side) of the movement 100, at the main plate 102 constituting the base plate of the movement, there are defined a main plate reference vertical axis line 306 passing a rotating center 300 of the minute indicator 324 and the hour wheel 354 and substantially in parallel with the center axis line of the winding stem 310 and a main plate reference horizontal axis line 308 passing the rotating center 300 of the minute indicator 324 and orthogonal to the main plate reference vertical axis line 306. The main plate 102 is provided with a first region 301 disposed on one side of the main plate reference vertical axis line 306 and on a side of the main plate reference horizontal axis line 308 proximate to the winding stem 310. The main plate 102 is provided with a second region 302 disposed on other side of the main plate reference vertical axis line 306 and on a side of the main plate reference horizontal axis line 308 proximate to the winding stem 310. The main plate 102 is provided with a third region 303 disposed on the other side of the main plate reference vertical axis line 306 at which the second region 302 is present and on a side of the main plate reference horizontal axis line 308 remote from the winding stem 310. The main plate 102 is provided with a fourth region 304 disposed on the one side of the main plate reference vertical axis line 306 at which the first region is present and on the side of the main plate reference horizontal axis line 308 remote from the winding stem 310.

Although in FIG. 13, the first region 301 and the fourth region 304 are disposed on the left side of the main plate reference vertical axis line 306, the regions may be defined to dispose on the right side of the main plate reference vertical axis line 306. In this case, the second region 302 and the third region 303 are defined to be disposed on the left side of the main plate reference vertical axis line 306. The hour wheel 354 is brought in mesh with an intermediate date indicator driving wheel & pinion A702. The intermediate date indicator driving wheel & pinion A702 is brought in mesh with an intermediate date indicator driving wheel of an intermediate date indicator driving wheel & pinion B704. An intermediate date indicator driving pinion of the intermediate date indicator driving wheel & pinion B704 is brought in mesh with a date indicator driving wheel 706. A date indicator 720 is rotatably integrated to the main plate 102. A date indicator driving finger 730 is integrally provided with the date indicator driving wheel 706. The date indicator driving finger 730 is comprised to rotate the date indicator 720 by rotating the date indicator driving wheel 706. The date indicator driving wheel 706 integrally formed with the date driving finger 730 constitutes date indicator driving means.

A date corrector setting transmission wheel A708 is brought in mesh with a date corrector setting transmission wheel B710. The date corrector setting transmission wheel B710 is brought in mesh with a date corrector setting wheel 714. The date corrector setting wheel 714 is pivotably integrated to a circular arc long hole 102*h* of the main plate 102. A date corrector setting pinion 716 is provided integrally with the date corrector setting wheel 714. In reference to FIG. 14 and FIG. 15, the date corrector setting pinion 716 is comprised to be brought in mesh with an inner teeth portion 720*a* of the date indicator 720 when the date corrector setting wheel 714 is disposed at a first position pivoted in one direction in a state in which the winding stem 310 is disposed at 1 stage. The date corrector setting pinion 716 is comprised not to be brought in mesh with the inner teeth portion 720*a* of the date wheel 720 when the date corrector setting indicator 714 is disposed at a second position pivoted to other direction. The date corrector setting transmission wheel A708 is comprised to rotate via the clutch wheel 462 and the setting wheel 464 when the setting stem 310 is rotated in a state in which the winding stem 310 is disposed at 1 stage. Under the state, the inner teeth portion 720*a* of the date indicator 720 is comprised to rotate by the date corrector setting pinion 716 by rotating the date corrector setting wheel 714 and the date corrector setting pinion 716 by rotation of the date corrector setting transmission wheel A708 via rotation of the date corrector setting transmission wheel B.

Figure 14:
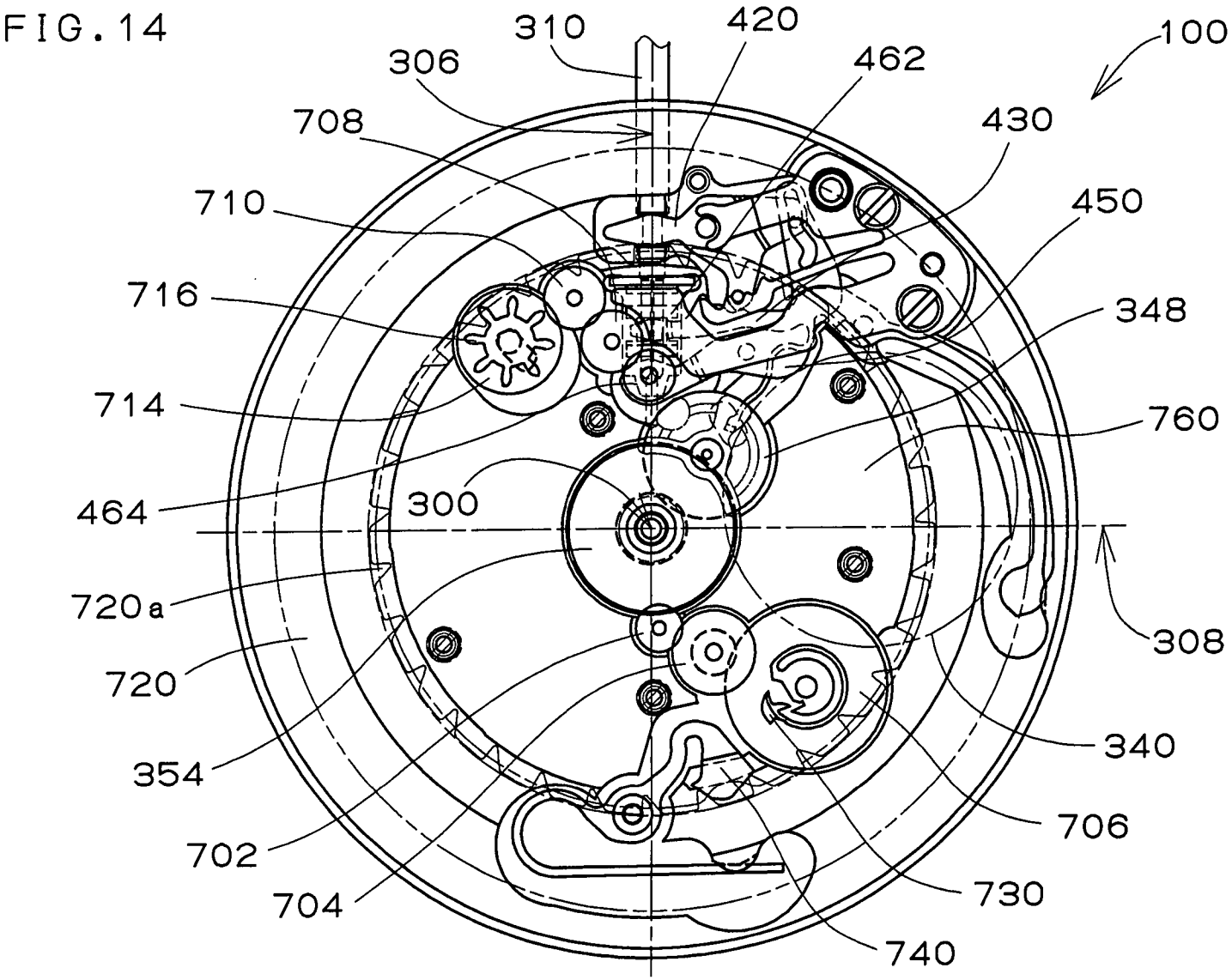
FIG. 14 is a plane view showing an outline shape of the back side of the movement in a state in which the winding stem is disposed at 1 stage to start correcting the date indicator according to the embodiment of the timepiece with calendar of the invention.
Figure 15:
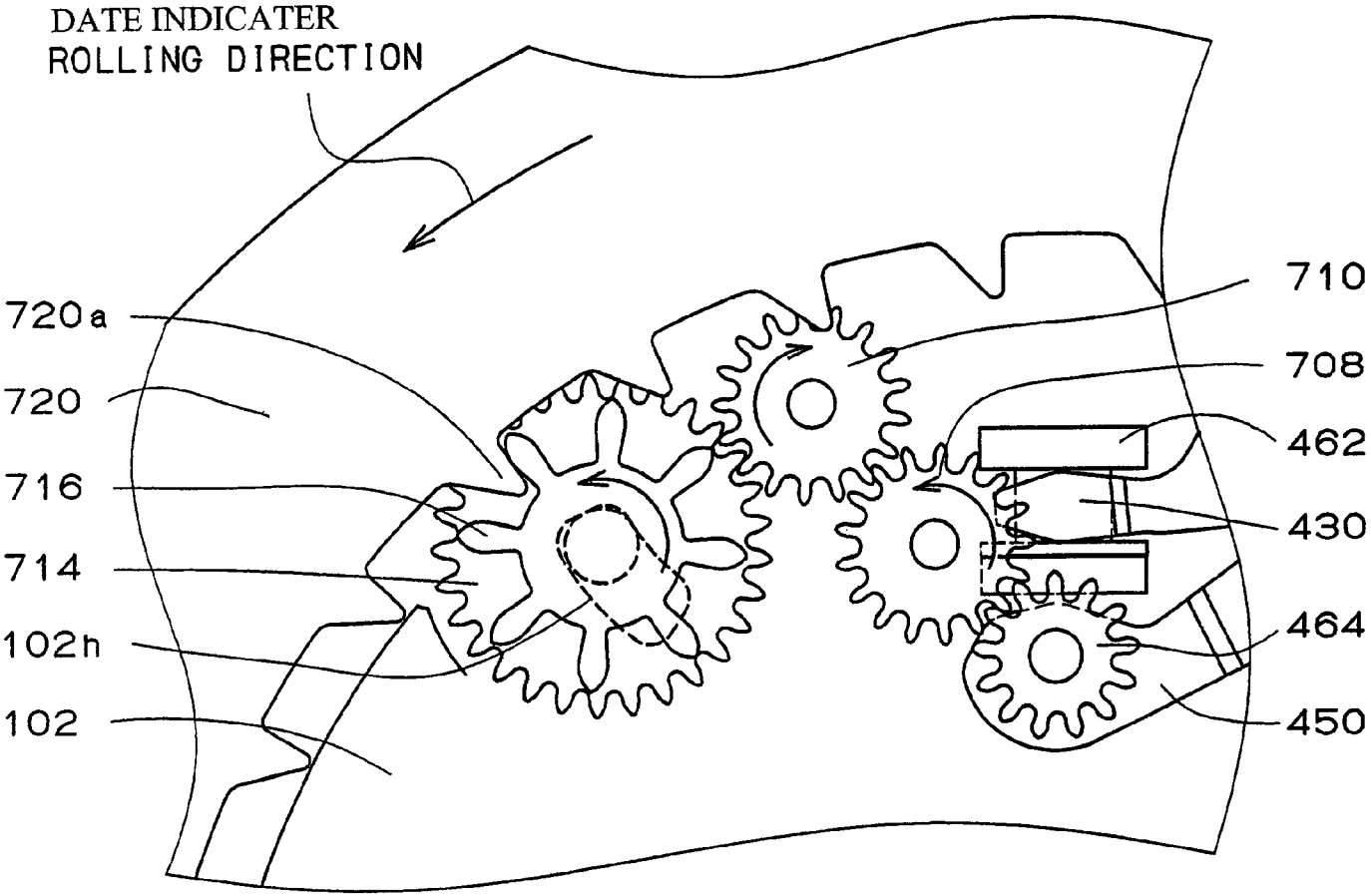
FIG. 15 is a partial plane view showing a date correcting mechanism in a state in which the winding stem is disposed at 1 stage and the date indicator starts correcting in the embodiment of the timepiece with calendar according to the invention.
Figure 18:
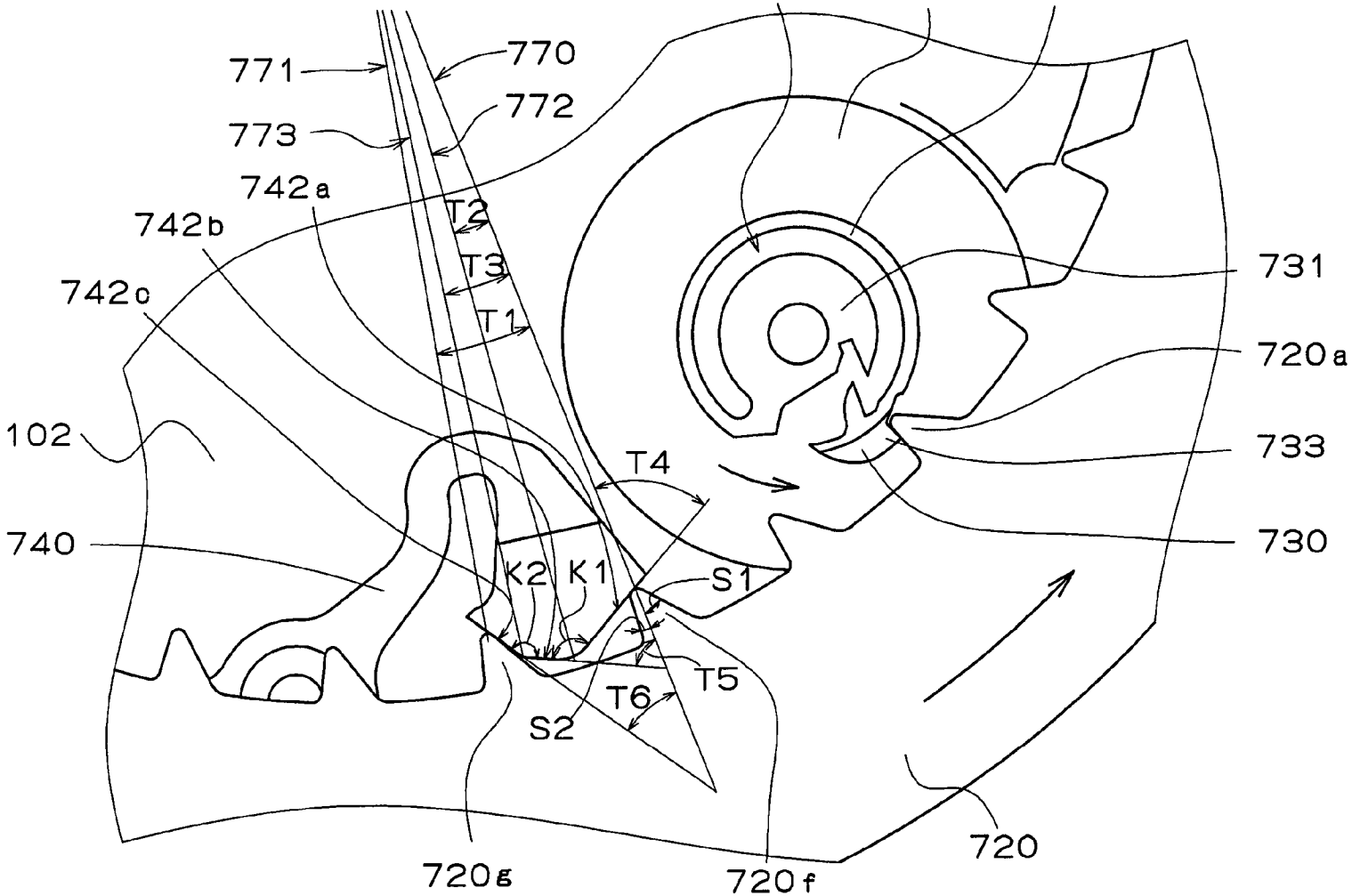
FIG. 18 is a partial plane view showing a relationship between a date indicator driving finger at point A of FIG. 17 and the date indicator in the embodiment of the timepiece with calendar according to the invention.

In reference to FIG. 13, FIG. 14 and FIG. 18, a date jumper 740 is provided at the second region 302 and the third region 303 on the side of the dial 104 of the main plate 102. The date jumper 740 includes a base portion 741, a date indicator setting portion 742, and a date jumper spring portion 744. A hole provided at the base portion 741 is integrated to a date jumper pin provided at the main plate 102. A center of the hole provided at the base portion 741 constitutes a rotating center 740*c* of the date jumper 740. The date indicator or wheel setting portion 742 of the date jumper 740 is engaged with the inner teeth portion 720*a* of the date wheel 720 to set or control rotation of the date wheel 720.

The date jumper spring portion 744 of the date jumper 740 includes a first portion in a linear shape extended in a direction reverse to a direction of rotating the date indicator 720 from the rotating center 740*c* of the date jumper 740, a second portion substantially in a semicircular shape continuous to the first portion and a first portion in a linear shape extended in a direction substantially reverse to that of the first portion continuous to the second portion. That is, the date jumper spring portion 744 of the date jumper 740 may preferably be formed substantially in a "J"-like. By constituting the date jumper spring portion 744 in this way, the date indicator 720 can smoothly be rotated. The date jumper 740 is fabricated by an elastically deformable material. For example, it is preferable to fabricate the date jumper 740 by phosphor bronze or stainless steel. The rotating direction of the date indicator 720 is the counterclockwise direction in FIG. 13. The date jumper 740 constitutes date indicator setting means for setting the date indicator 720. The date jumper 740 may be formed integrally with a date indicator holder 760 or the date jumper 740 may be formed separately from the date indicator holder 760. When the date indicator holder 760 is integrally formed with the date jumper 740, the date indicator holder 760 is fabricated by an elastically deformable material. In this case, it is preferable to fabricate the date indicator holder 760 by, for example, phosphor bronze or stainless steel.

A rotating center of the date corrector setting transmission wheel A708 is disposed in the first region 301. A rotating center of the date corrector setting transmission wheel B710 is disposed in the first region 301. A rotating center of the date corrector setting wheel 716 is disposed in the first region 310. The setting portion 742 of the date jumper 740 for setting the date indicator 720 is disposed in the third region 303. A rotating center of the date indicator driving wheel 706 is disposed in the third region 303. Also a rotating center of the date indicator driving finger 730 is disposed in the third region 303. It is preferable to arrange the setting portion 742 of the date jumper 740 to be proximate to the date indicator driving wheel 706. Further, it is preferable to successively arrange the date jumper 740 and the date indicator driving wheel 706 in the rotating direction of the date indicator 720. Further, it is preferable to dispose the rotating center of the date indicator driving wheel 706 and the rotating center of the date indicator driving finger 730 respectively at vicinities of a substantially middle portion in a circumferential direction in the third region 303.

(10) Structure of Date Feeding Mechanism:

Next, a structure of a date feeding mechanism of the timepiece with calendar of the invention will be explained. In reference to FIG. 13 and FIG. 18, the date indicator driving wheel 706 includes a date indicator driving wheel gear portion rotated based on rotation of the hour wheel 354 and a date indicator driving cylinder portion (not illustrated) provided at a center of a face on a side of the date indicator driving wheel gear portion at which the main plate 102 is disposed. The date indicator driving cylinder portion is rotatably integrated to a date indicator driving wheel integrating shaft of the main plate 102. A portion of a date indicator holder 760 includes a date indicator driving wheel holding portion for holding at least a portion of the date indicator driving wheel 706 rotatably at the main plate 102. By the structure, the date indicator driving wheel 706 can be held at the main plate 102. It is preferable to fabricate the date indicator driving wheel 706 by a metal of brass or the like. A central portion 731 of the date indicator driving finger 730 may preferably be fixed to the date indicator driving wheel 706 by welding, punching or the like. The date indicator driving wheel holder 760 is fixed to the main plate 102 by a plurality of date indicator holding screws 780. It is preferable to provide three pieces of more of the date indicator holding screws 780.

The date indicator driving finger 730 is formed by an elastic material of phosphor bronze, stainless steel or the like. The date indicator driving finger 730 includes the central portion 731 integrally provided to the date indicator driving wheel 706, a spring portion 732 in a shape of a circular arc extended from the central portion 731 and the date indicator feeding portion 733 for rotating the date indicator 720. The date indicator feeding portion 733 is provided at a front end of the spring portion 732. The spring portion 732 is formed in an angular range of substantially 270 degrees. A clearance 731*b* is provided between an inner peripheral portion of the spring portion 732 and an outer peripheral portion of the central portion 731. As shown by an arrow mark in FIG. 18, the date indicator 720 is comprised to rotate in the counterclockwise direction. Similarly, as shown by an arrow mark in FIG. 18, also the date indicator driving wheel 706 is comprised to rotate in the counterclockwise direction.

In reference to FIG. 18, FIG. 18 shows a state in which the date indicator feeding portion 733 of the date indicator driving finger 730 is rotated along with the date indicator driving wheel 706 and is just brought into contact with the inner teeth portion 720*a* of the date indicator 720. The state is defined as a state in which a date indicator rotating angle is 0 degree in FIG. 17, that is, "state at point A".

The inner teeth portion 720*a* of the date indicator 720 includes 31 pieces of triangular teeth. A tooth disposed on a preceding side in view of the rotating direction of the date indicator 720 in the inner teeth portion 720*a* of the date indicator 720 with which the date indicator setting portion 742 of the date jumper 740 is brought into contact is defined as a first tooth 720*f* and a tooth disposed on a succeeding side in the rotating direction is defined as a second tooth 720*g*. The first tooth 720*f* is a tooth disposed from the tooth of the inner teeth portion 720*a* of the date indicator 720 fed by the date indicator driving finger 730 on a succeeding side by two teeth in view from the rotating direction. The second tooth 720*g* is a tooth disposed from the tooth of the inner teeth portion 720*a* of the date indicator 720 fed by the date indicator driving finger 730 on the succeeding side by three teeth in view from the rotating direction.

A straight line connecting the rotating center 300 of the minute indicator 324 and the hour wheel 354 and a center of a circular arc of a tooth tip of the first tooth 720*f* is defined as a first tooth reference line 770. A straight line connecting the rotating center 300 of the minute wheel 324 and a center of a circular arc of a tooth tip of the second tooth 720*g* is defined as a second tooth tip reference line 771. An angle T1 made by the first tooth tip reference line 770 and the second tooth tip reference line 771 is (360/31) degrees. An angle S1 made by a face of the first tooth 720*f* of the date indicator 720 on a preceding side in view from the rotating direction and the first tooth tip reference line 770 is 40 degrees. An angle S2 made by a face of the first tooth 720*f* of the date indicator 720 on a succeeding side in view from the rotating direction and the first tooth tip reference line 770 is 5 degrees. An angle (S1+S2) made by the face of the first tooth 720*f* of the date indicator 720 on the preceding side in view from the rotating direction and the face of the first tooth 720*f* of the date indicator 720 on the succeeding side in view from the rotating direction is 45 degrees. It is preferable to provide a rounded portion having a radius of 0.05 mm through 0.15 mm at the tooth tip of the tooth of the date indicator 720.

The date indicator setting portion 742 of the date jumper 740 includes a first setting portion 742*a*, a second setting portion 742*b* and a third setting portion 742*c*. The second portion 742*b* is provided between the first setting portion 742*a* and the third setting portion 742*c*. Each of the first, second and third setting portions has a generally linear surface portion disposed at an angle relative one another. In a state shown by FIG. 18, the first setting portion 742*a* is brought into contact with the circular arc of the tooth tip of the first tooth 720*f* and the third setting portion 742*c* is brought into contact with the circular arc of the tooth tip of the second tooth 720*g*. An angle T2 made by a straight line 772 connecting an intersection of the first setting portion 742*a* and the second setting portion 742*b* and the rotating center 300 of the minute indicator 324 and the first tooth tip reference line 770 is 5.8 degrees. An angle T3 made by the straight line 772 connecting an intersection of the second setting portion 742*b* and the third setting portion 742*c* and the rotating center 300 of the minute indicator 324 and the first tooth tip reference line 770 is 9.3 degrees. An angle T4 made by the first setting portion 742*a* and the first tooth tip reference line 770 is 62 degrees. An angle T5 made by the second setting portion 742*b* and the first tooth tip reference line 770 is 63 degrees. An angle T6 made by the third setting portion 742*c* and the first tooth tip reference line 770 is 33 degrees.

In the date indicator setting portion 742 of the date jumper 740, an angle K1 made by the first setting portion 742*a* and the second setting portion 742*b* is 122.5 degrees. It is preferable that K1 falls in a range of 115 degrees through 130 degrees. Further, an angle K2 made by the second setting portion 742*b* and the third setting portion 742*c* is 150 degrees. It is preferable that K2 falls in a range of 140 degrees through 160 degrees.

In FIG. 18, it is preferable that (T1−T3) is comprised to be smaller than (T3−T2). It is preferable that (T3−T2) is comprised to be smaller than T2. By this construction, the indicator can firmly be fed in a short period of time and, after feeding the date indicator, the date indicator can firmly be set by the date jumper 740.

(11) Operation of Calendar Apparatus:

Next, operation of the calendar apparatus of the timepiece with calendar of the invention will be explained.

(11•1) Date Feeding:

First, operation of date feeding of the timepiece with calendar of the invention will be explained. In reference to FIG. 13 and FIG. 14, the hour wheel 354 is rotated by one rotation in 12 hours based on rotation of the top train wheel. The intermediate date indicator driving wheel A702 is rotated based on rotation of the hour wheel 354. The intermediate date indicator driving wheel B704 is rotated based on rotation of the intermediate date indicator driving wheel A702. The date indicator driving wheel 706 is rotated by one rotation in 24 hours based on rotation of the intermediate date indicator driving wheel B704. By rotating the date indicator driving finger 730 integral with the date indicator driving wheel 706, the date indicator 720 can be rotated by once per day, or by an amount of a date. The position in the rotating direction of the date indicator 720 is set by the date jumper 740.

Figure 17:
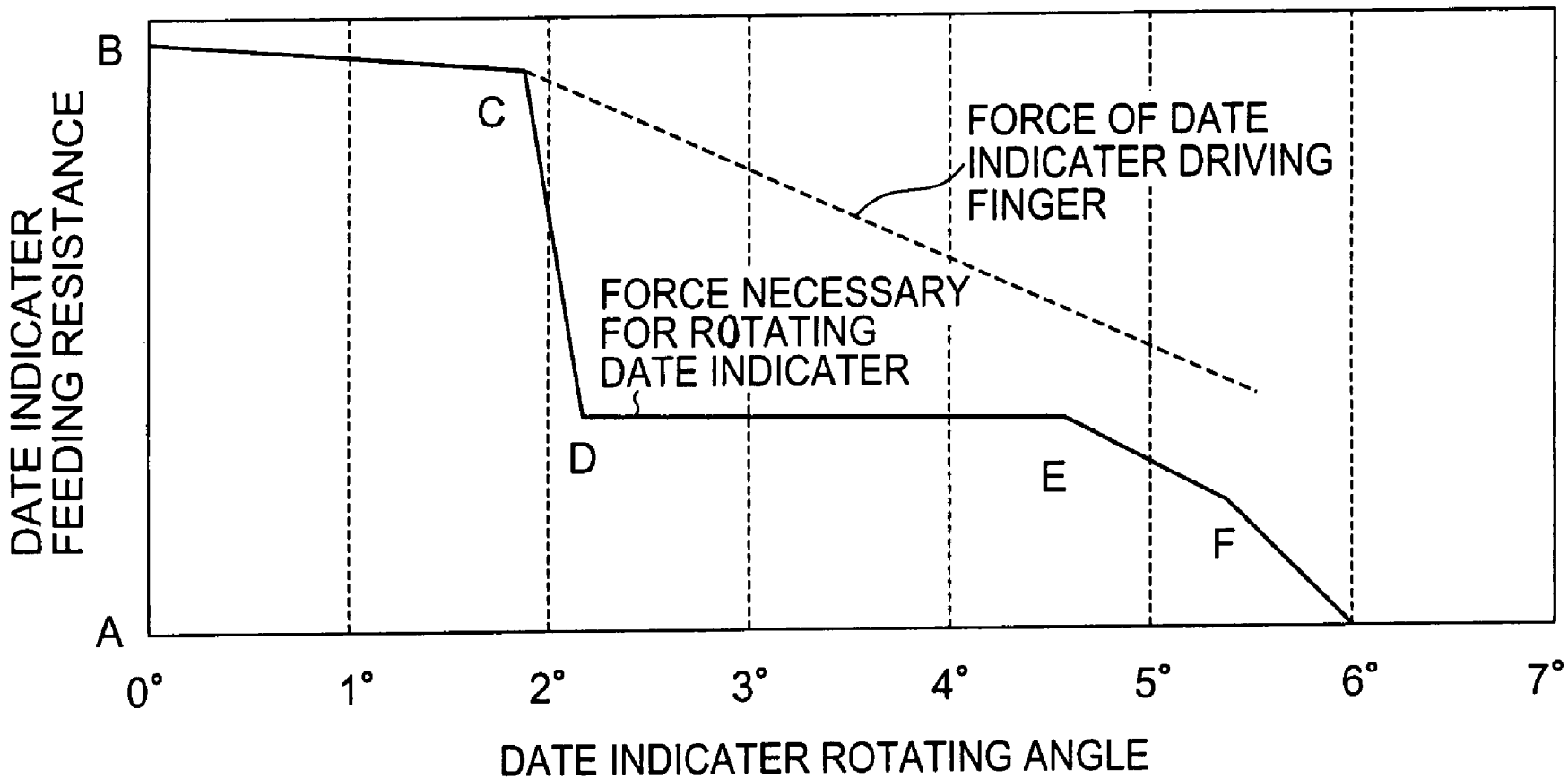
FIG. 17 is a graph showing a relationship between date indicator feeding resistance and a rotating angle of the date indicator in the embodiment of the timepiece with calendar according to the invention.
Figure 19:
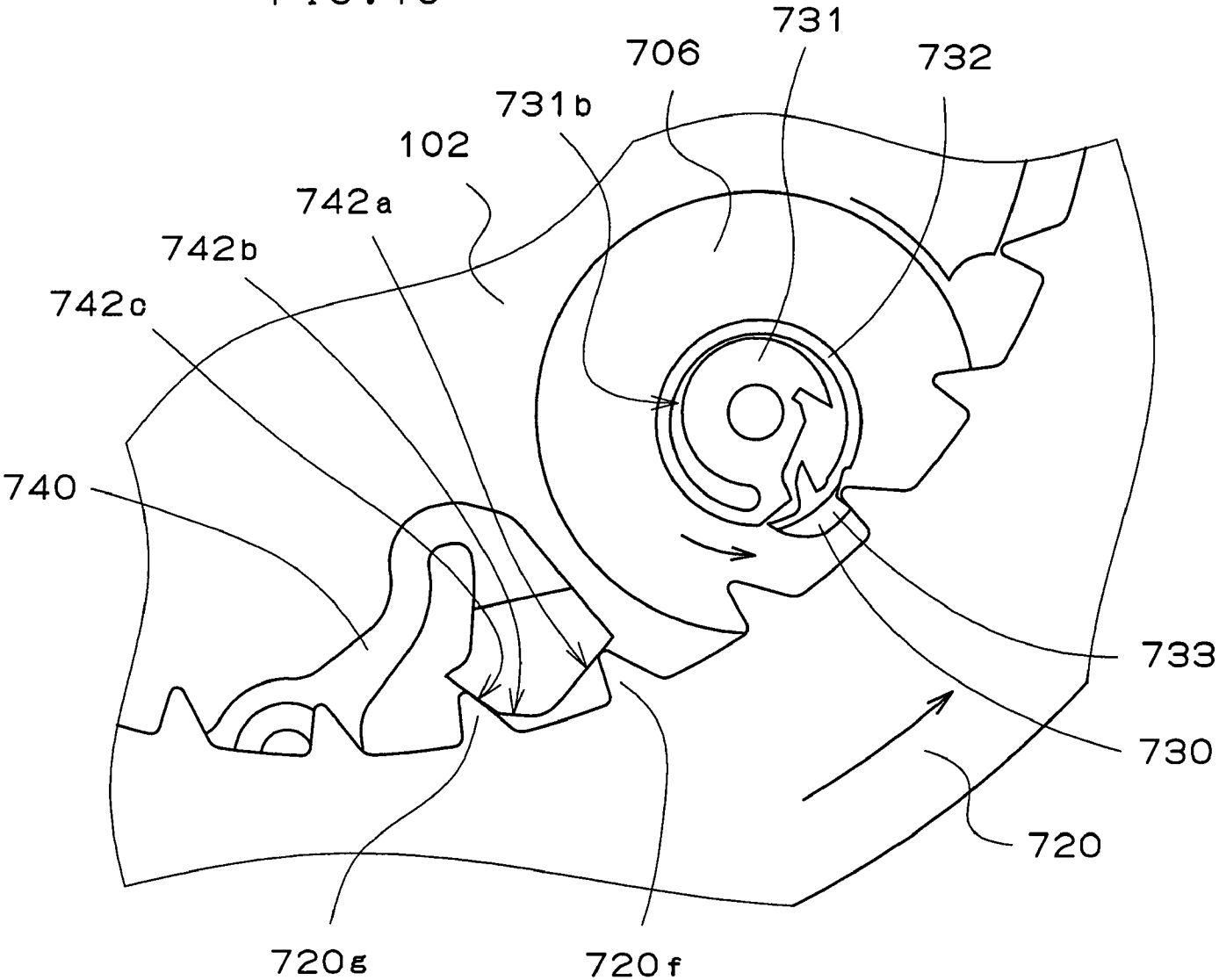
FIG. 19 is a partial plane view showing a relationship between the date indicator driving finger at point B of FIG. 17 and the date indicator in the embodiment of the timepiece with calendar according to the invention.

In reference to FIG. 18, FIG. 18 shows "state at point A" in FIG. 17 as described above. In the state shown by FIG. 18, the first setting portion 742*a* is brought into contact with the circular arc of the tooth tip of the first tooth 720*f* and the third setting portion 742*c* is brought into contact with the circular arc of the tooth tip of the second tooth 720*g*. When the date indicator driving wheel 706 and the date indicator driving finger 730 are further rotated from the state shown in FIG. 18, the clearance 731*b* between the inner peripheral portion of the spring portion 732 of the date indicator driving finger 730 and the outer peripheral portion of the central portion 731 is narrowed to bring about a state shown in FIG. 19. FIG. 19 shows "state of point B" in FIG. 17. From the state shown in FIG. 18 to the state shown in FIG. 19, the first setting portion 742*a* of the date jumper 740 stays to be brought into contact with the circular arc of the tooth tip of the first tooth 720*f* and the third setting portion 742*c* stays to be brought into contact with the circular arc of the tooth tip of the second tooth 720*g*. Therefore, from the state shown in FIG. 18 to the state shown in FIG. 19, the date indicator 720 is not rotated.

Figure 20:
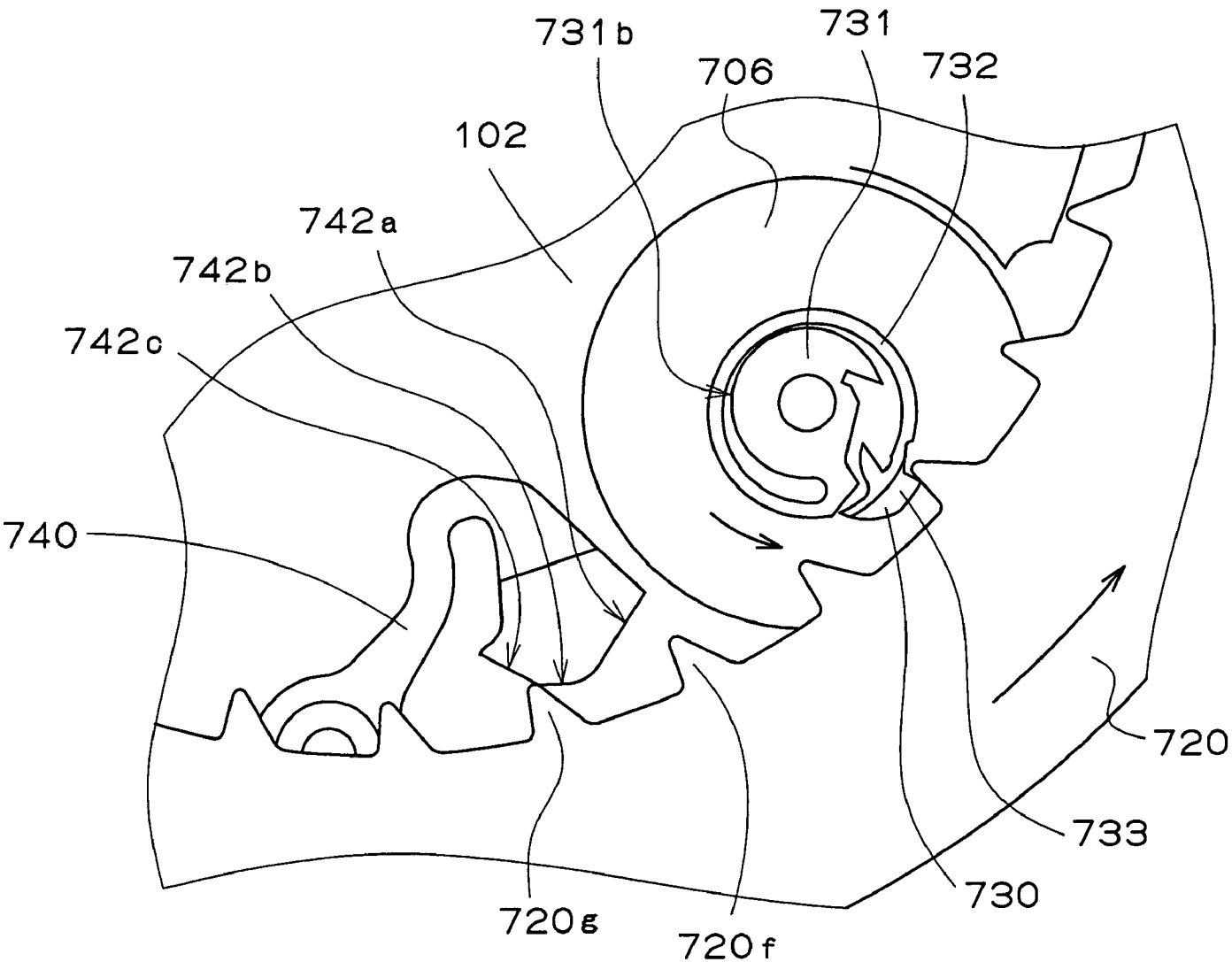
FIG. 20 is a partial plane view showing a relationship between the date indicator driving finger at point C of FIG. 17 and the date indicator in the embodiment of the timepiece with calendar according to the invention.

When the date indicator driving wheel 706 and the date indicator driving finger 730 are further rotated from the state shown in FIG. 19, the date indicator driving finger 730 rotates the date indicator 720 in a direction shown by an arrow mark to bring about a state shown in FIG. 20. FIG. 20 shows "state of point C" in FIG. 17. In the state shown by FIG. 20, the clearance 731*b* between the inner peripheral portion of the spring portion 732 of the date indicator driving finger 730 and the outer peripheral portion of the central portion 731 stays to be narrowed. From the state shown in FIG. 19 to the state shown in FIG. 20, the first setting portion 742*a* of the date jumper 740 leaves the tooth tip of the first tooth 720*f* and the circular arc of the tooth tip of the second tooth 720*g* slides along the third setting portion 742*c*. Therefore, in the state shown in FIG. 20, the circular arc of the tooth tip of the second tooth 720*g* is brought into contact with the third setting portion 742*c* immediately before the intersection of the second setting portion 742*b* and the third setting portion 742*c*. When the date indicator 720 is rotated from "state at point B" to "state at point C" in FIG. 17, the date indicator feeding resistance is slightly reduced.

Figure 21:
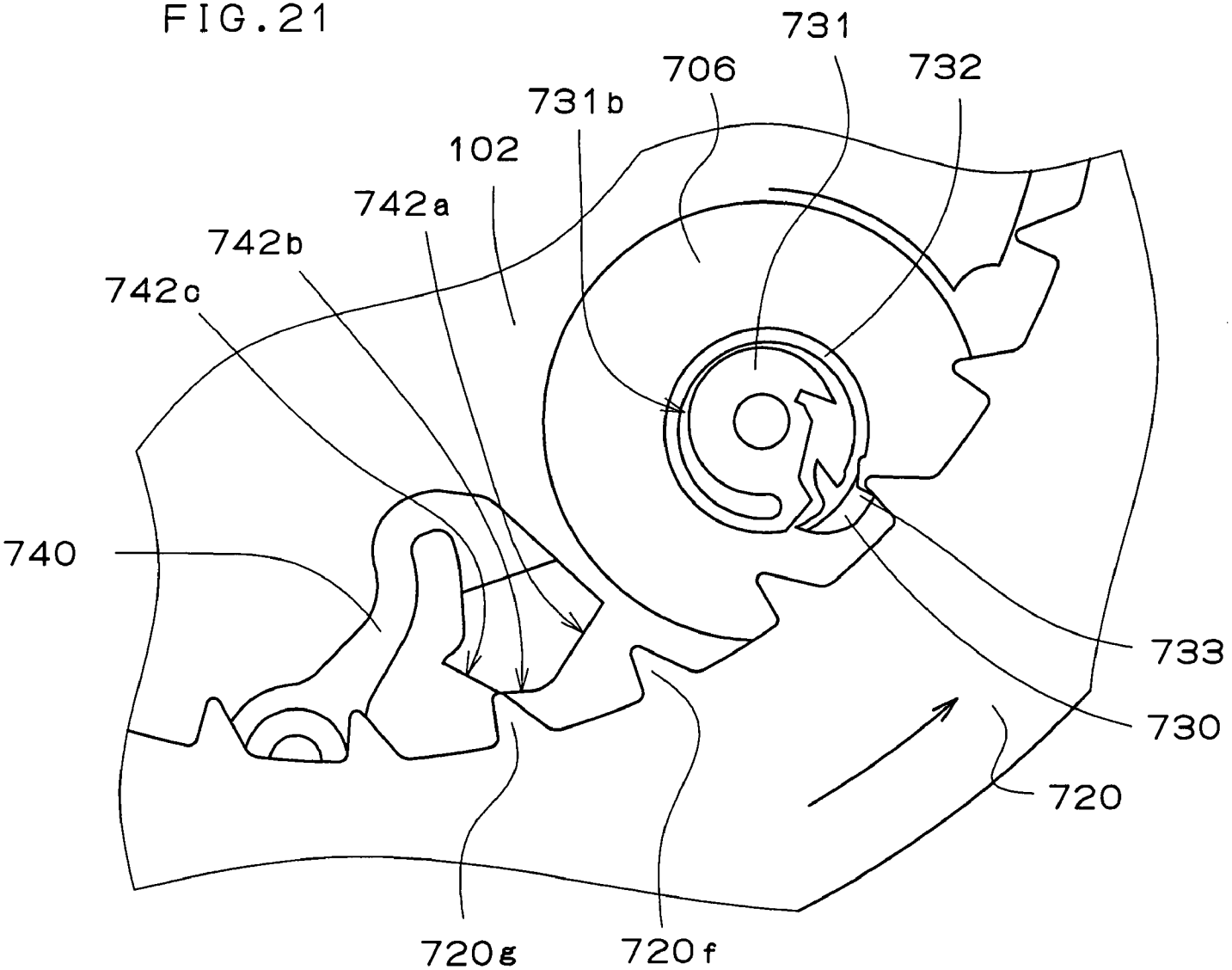
FIG. 21 is a partial plane view showing a relationship between the date indicator driving finger at point D of FIG. 17 and the date indicator in the embodiment of the timepiece with calendar according to the invention.

When the date indicator driving wheel 706 and the date indicator driving finger 730 are further rotated further from the state shown in FIG. 20, the date indicator driving finger 730 rotates the date indicator 720 in a direction shown by an arrow mark to bring about a state shown in FIG. 21. FIG. 21 shows "state at point D" in FIG. 17. In a state shown in FIG. 21, the clearance 731*b* between the inner peripheral portion of the spring portion 732 of the date indicator driving finger 730 and the outer peripheral portion of the central portion 731 stays to be narrowed. From the state shown in FIG. 20 to the state shown in FIG. 21, the first setting portion 742*a* of the date jumper 740 leaves the tooth tip of the first tooth 720*f* and the circular arc of the second tooth 720*g* slides to exceed the intersection between the second setting portion 742*b* and the third setting portion 742*c*. Therefore, in a state shown in FIG. 21, the circular arc of the tooth tip of the second tooth 720*g* is brought into contact with the second setting portion 742*b* immediately after the intersection of the second setting portion 742*b* and the third setting portion 742*c*.

When the date indicator 720 is rotated from "state at point C" to "state at point D" in FIG. 17, the state indicator feeding resistance is rapidly reduced. That is, between "state at point C" and "state at point D" in FIG. 17, a force for rotating the date indicator 720 stored in the date indicator driving finger 730 is much larger than a force necessary for rotating the date indicator 720 (that is, the date indicator feeding resistance) and the date indicator 720 rapidly starts rotating.

Figure 22:
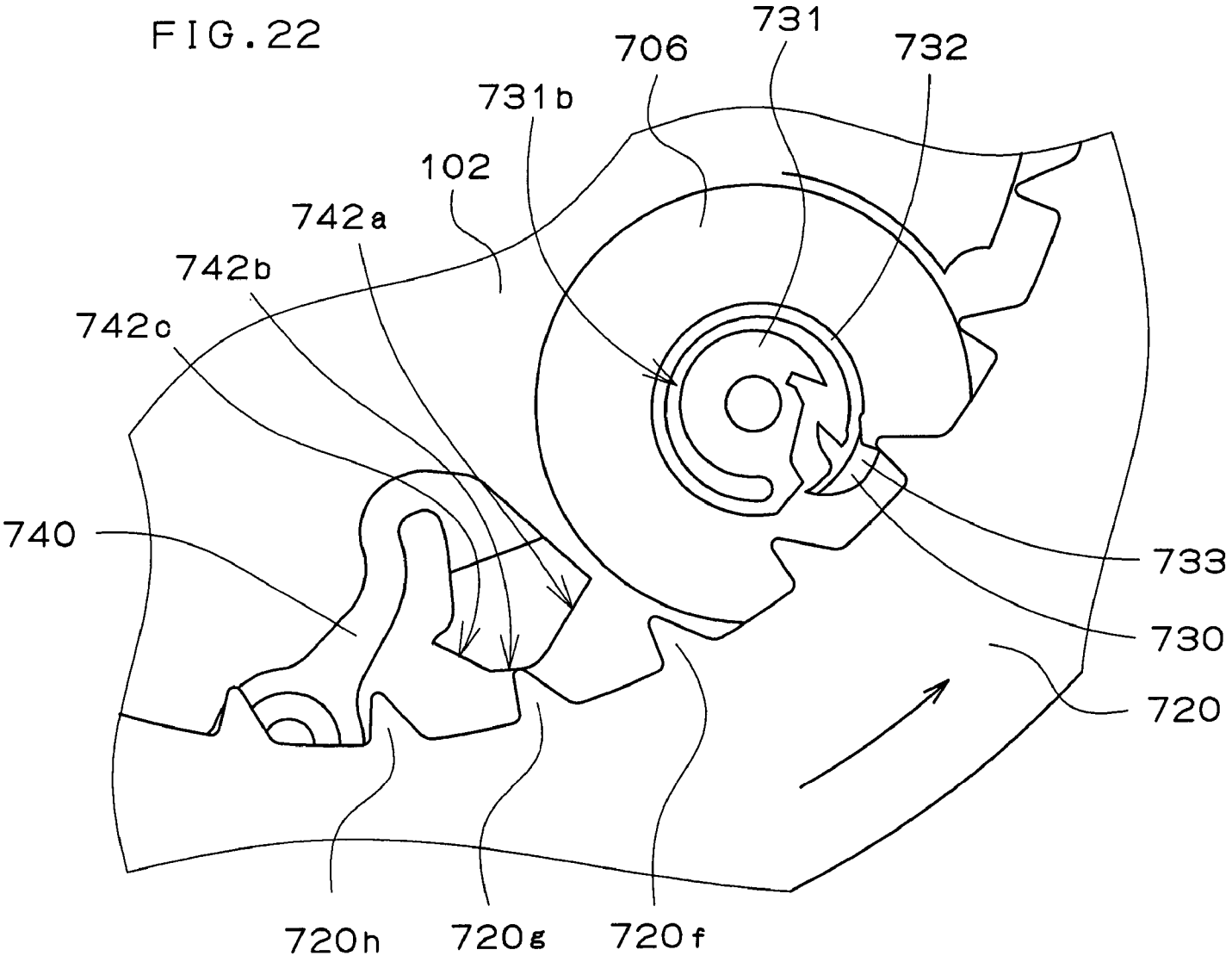
FIG. 22 is a partial plane view showing a relationship between the date indicator driving finger at point E of FIG. 17 and the date indicator in the embodiment of the timepiece with calendar according to the invention.

When the date indicator driving wheel 706 and the date indictor driving finger 730 are further rotated further from the state shown in FIG. 21, the date indicator driving finger 730 rotates the date indicator 720 in a direction shown by an arrow mark to bring about a state shown in FIG. 22. FIG. 22 shows "state at point E" in FIG. 17. The date indicator feeding resistance for rotating the date indicator 720 from "state at point D" to "state at point E" in FIG. 17 is the force necessary for rotating the date indicator 720. In the state shown by FIG. 22, the clearance 731*b* between the inner peripheral portion of the spring portion 732 of the date indicator driving finger 730 and the outer peripheral portion of the central portion 731 is widened. From the state shown in FIG. 21 to the state shown in FIG. 22, the first setting portion 742*a* of the date jumper 740 leaves the tooth tip of the first tooth 720*f* and the circular arc of the tooth tip of the second tooth 720*g* slides along the second setting portion 742*b*. Therefore, in the state shown in FIG. 22, the circular arc of the tooth tip of the second tooth 720*g* is brought into contact with the second setting portion 742*b* proximate to the intersection of the second setting portion 742*b* and the first setting portion 742*a*. When the date indicator 720 is rotated from "state at point D" to "state at point E" in FIG. 17, although the force of the date indicator driving finger 730 exerted to the date indicator 720 is reduced, the force for rotating the date indicator 720 stored in the date indicator driving finger 730 is much larger than the force necessary for rotating the date indicator 720 (that is, the date indicator feeding resistance) and therefore, rotation of the date indicator 720 is not stopped.

Figure 23:
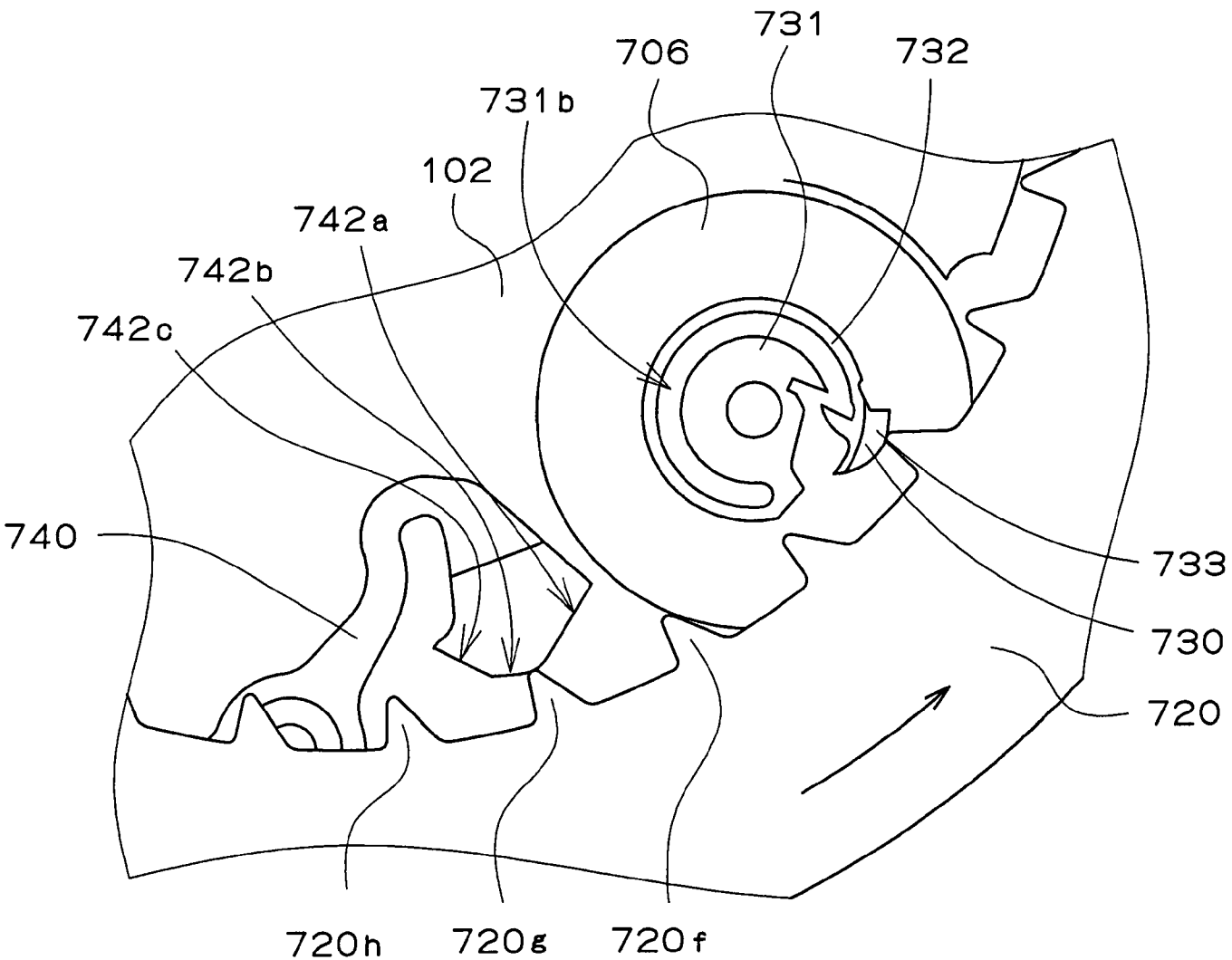
FIG. 23 is a partial plane view showing a relationship between the date indicator driving finger at point F of FIG. 17 and the date indicator in the embodiment of the timepiece with calendar according to the invention.
Figure 24:
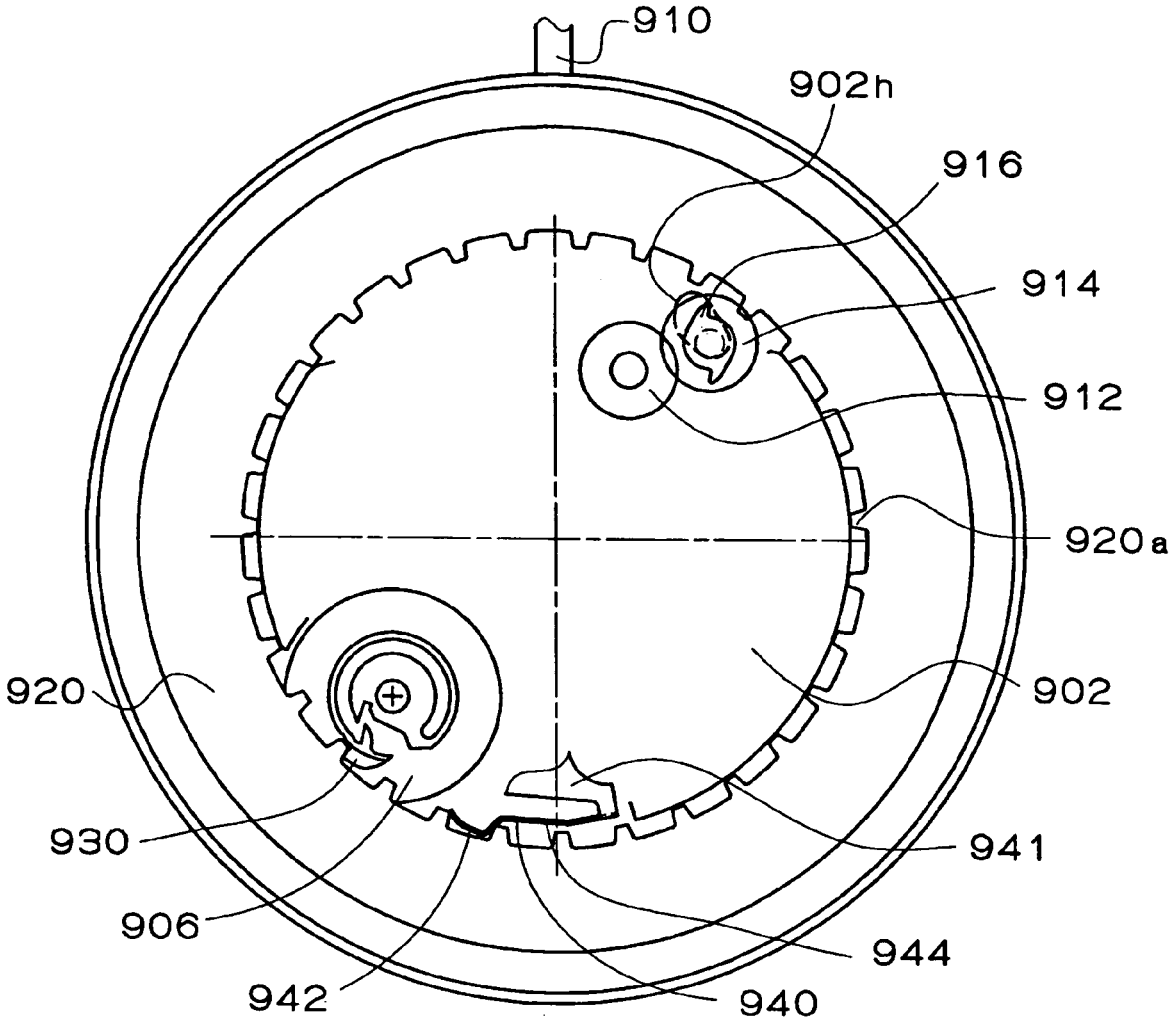
FIG.24 Prior Art
FIG. 24 is a plane view showing an outline shape of a back side of a movement in a state in which a winding stem is disposed at 0 stage and a date indicator starts feeding in a conventional timepiece with calendar.
Figure 25:
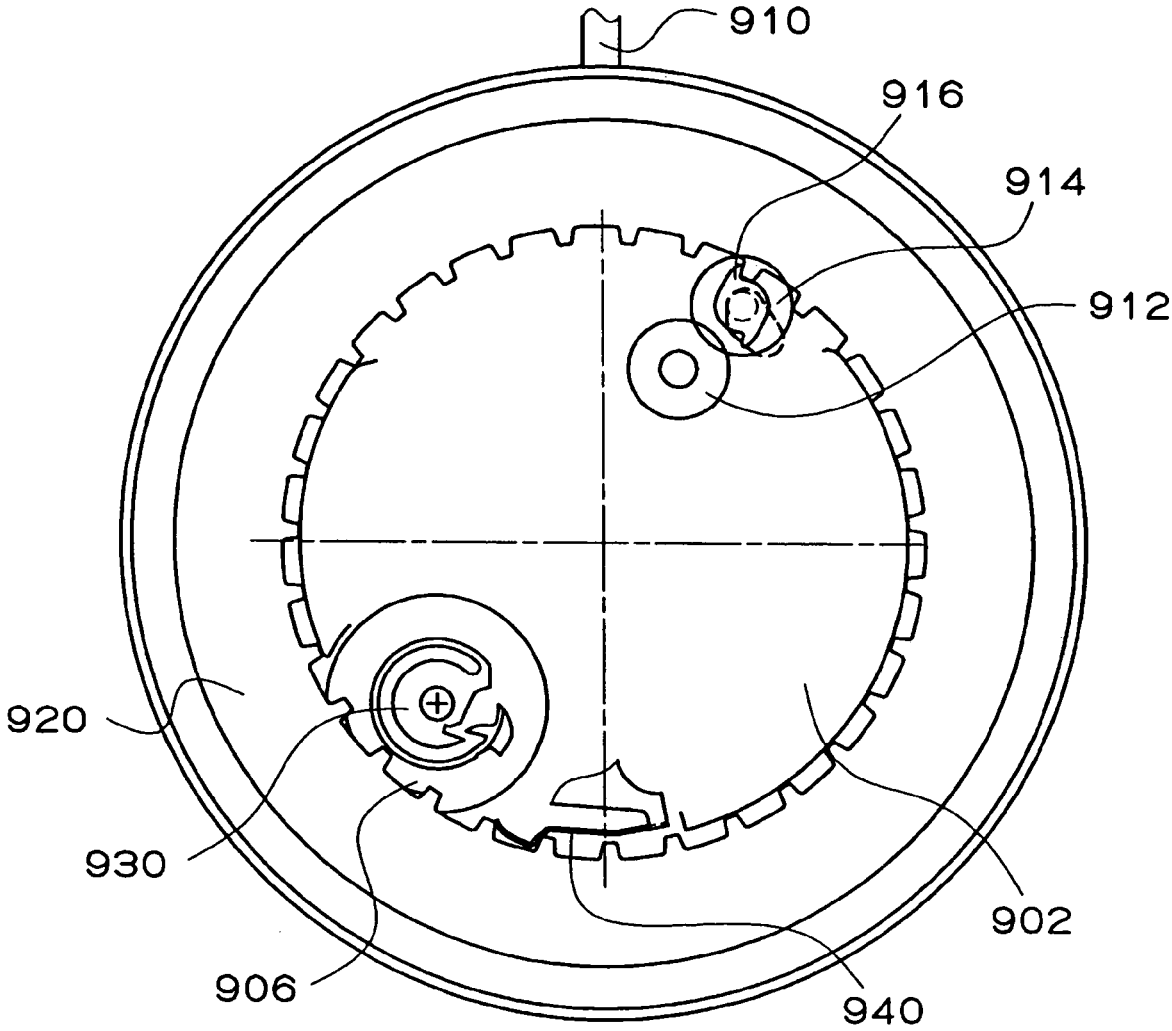
FIG.25 Prior Art
FIG. 25 is a plane view showing the outline shape of the back side of the movement in a state in which the winding stem is disposed at 1 stage and the date indicator starts correcting in the conventional timepiece with calendar.
Figure 26:
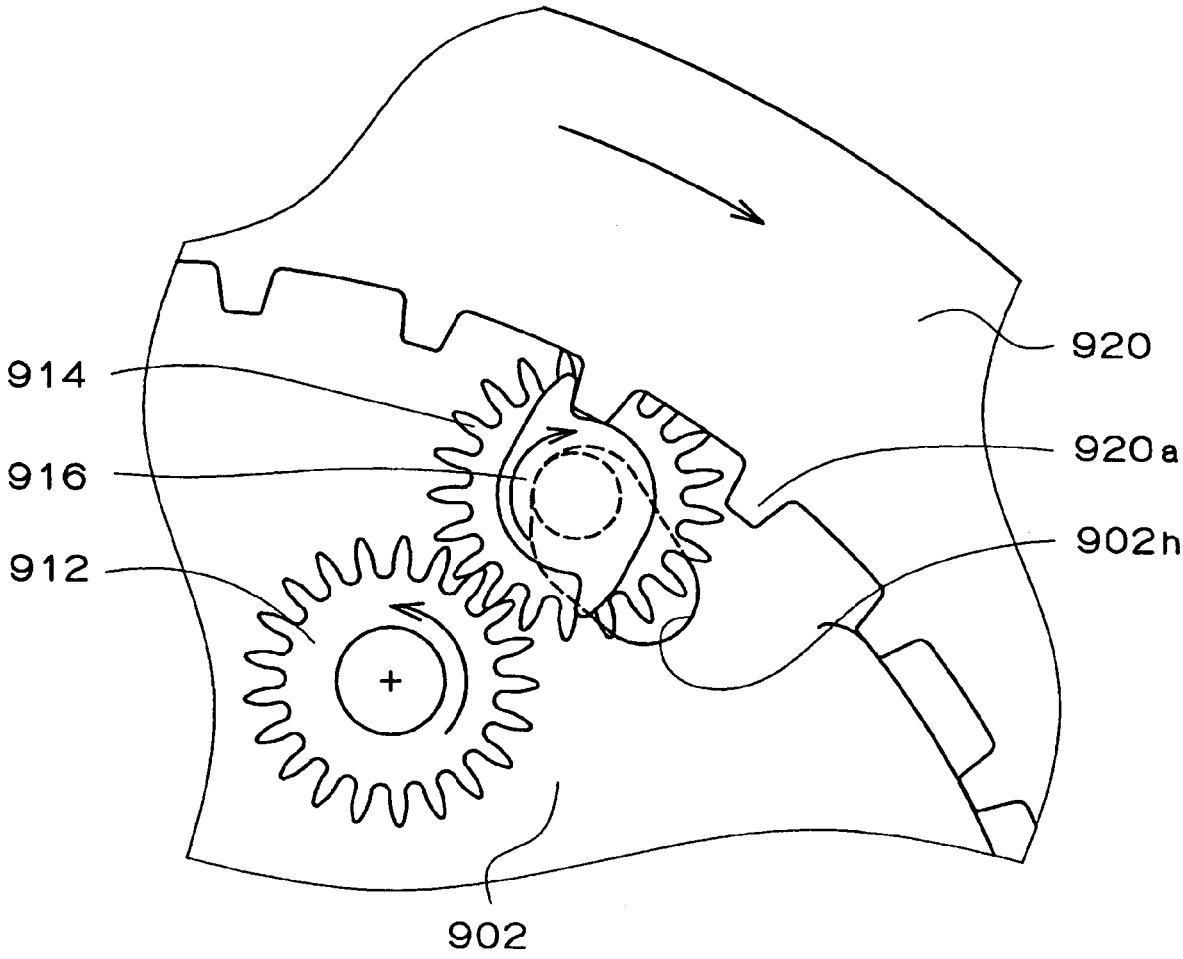
FIG.26 Prior Art
FIG. 26 is a partial plane view showing a date correcting mechanism in the state in which the winding stem is disposed at 1 stage and the date indicator starts correcting in the conventional timepiece with calendar.
Figure 27:
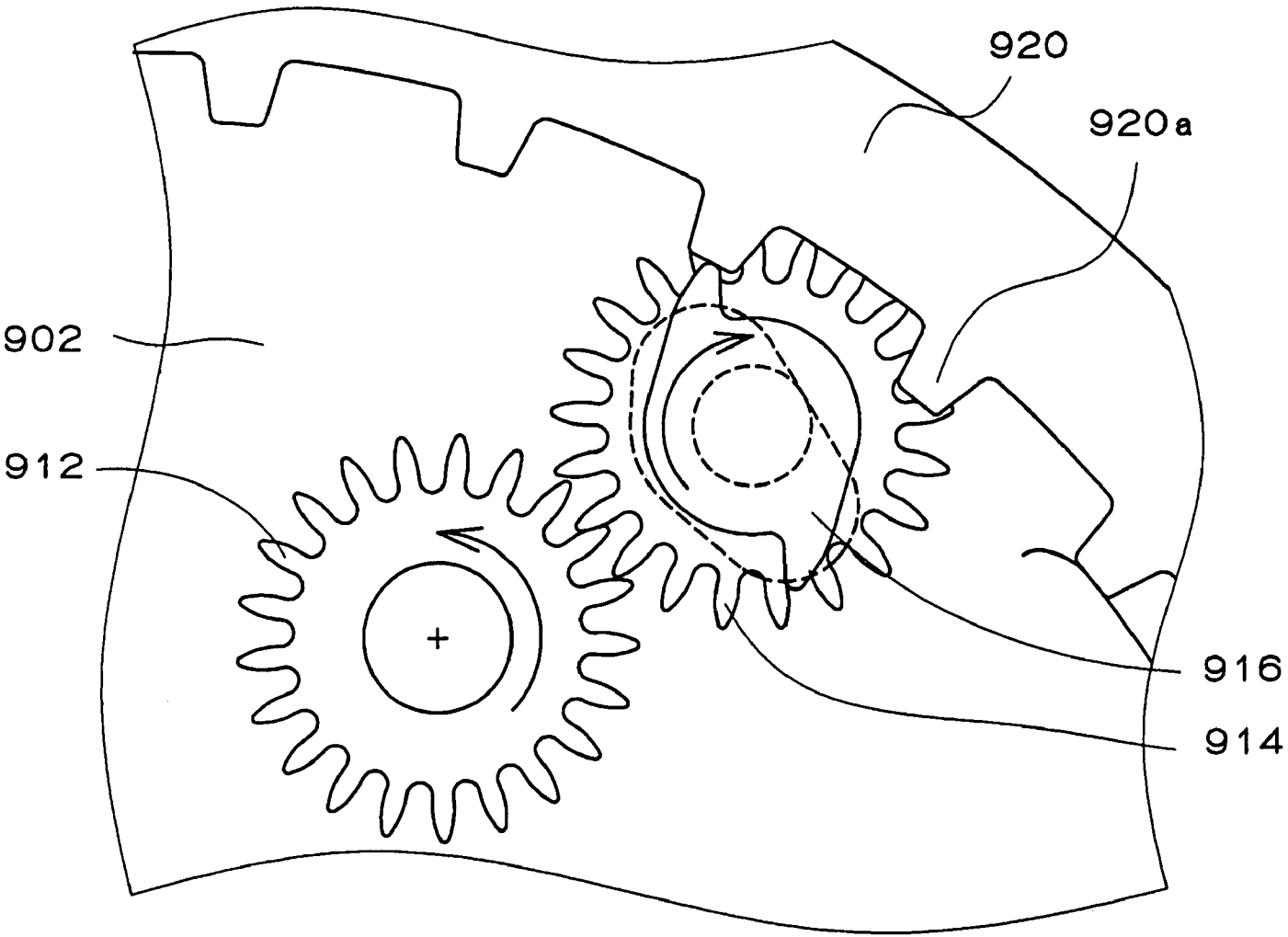
FIG.27 Prior Art
FIG. 27 is a partial plane view showing the state in which the winding stem is disposed at 1 stage and the date indicator starts correcting and in a state in which tooth tips of a date indicator corrector pinion and a date indicator are stretched to each other in the conventional timepiece with calendar.
Figure 28:
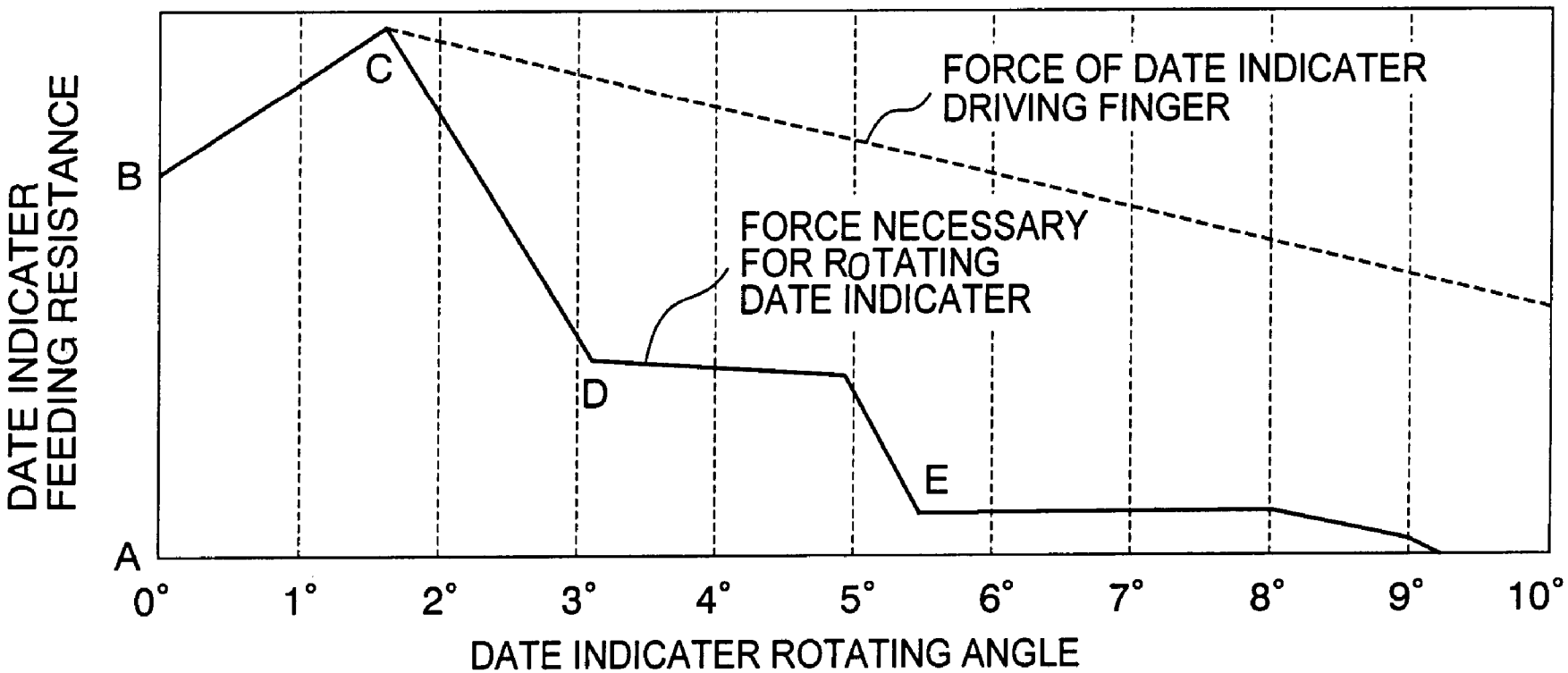
FIG. 28 Prior Art
FIG. 28 is a graph showing date indicator feeding resistance and a rotating angle of the date indicator in the conventional timepiece with calendar.
Figure 29:
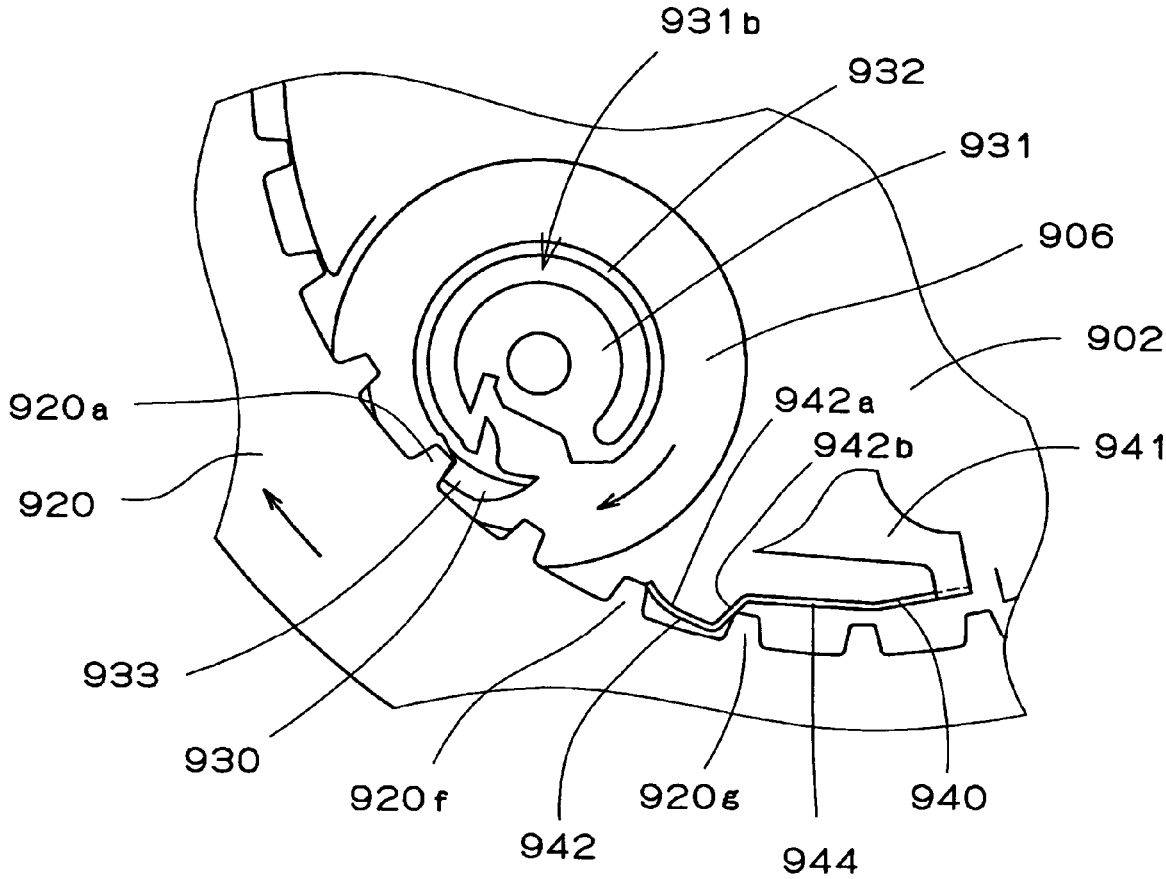
FIG.29 Prior Art
FIG. 29 is a partial plane view showing a relationship between a date indicator driving finger at point A of FIG. 28 and the date indicator in the conventional timepiece with calendar.
Figure 30:
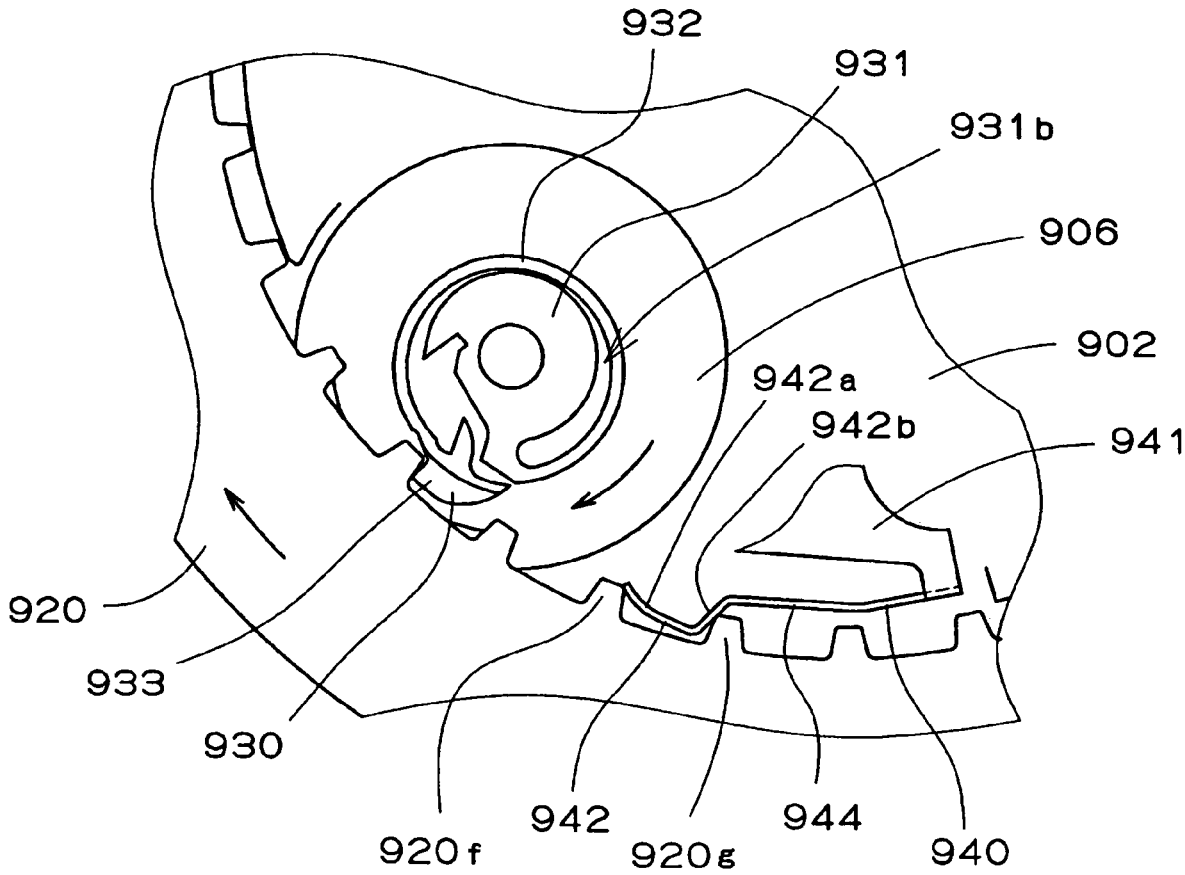
FIG.30 Prior Art
FIG. 30 is a partial plane view showing a relationship between the date indicator driving finger at point B of FIG. 28 and the date indicator in the conventional timepiece with calendar.
Figure 31:
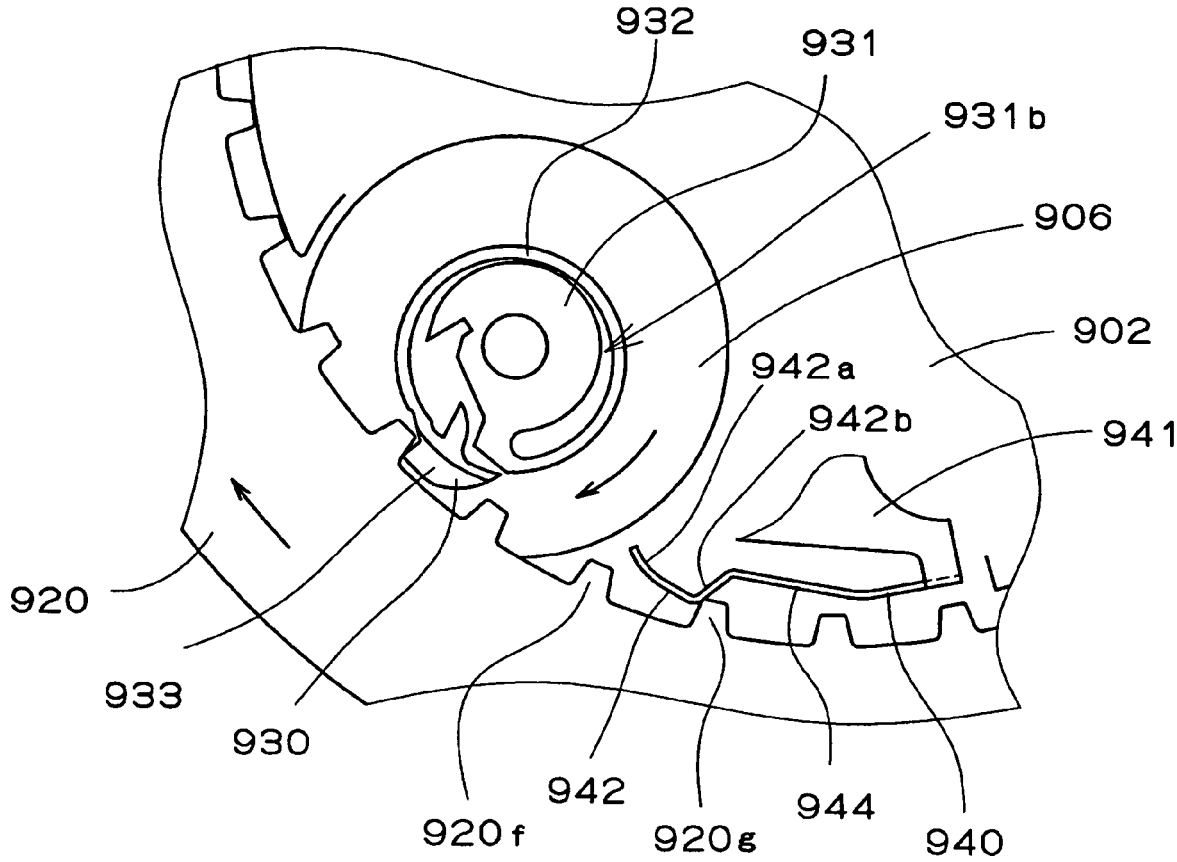
FIG.31 Prior Art
FIG. 31 is a partial plane view showing a relationship between the date indicator driving finger at point C of FIG. 28 and the date indicator in the conventional timepiece with calendar.
Figure 32:
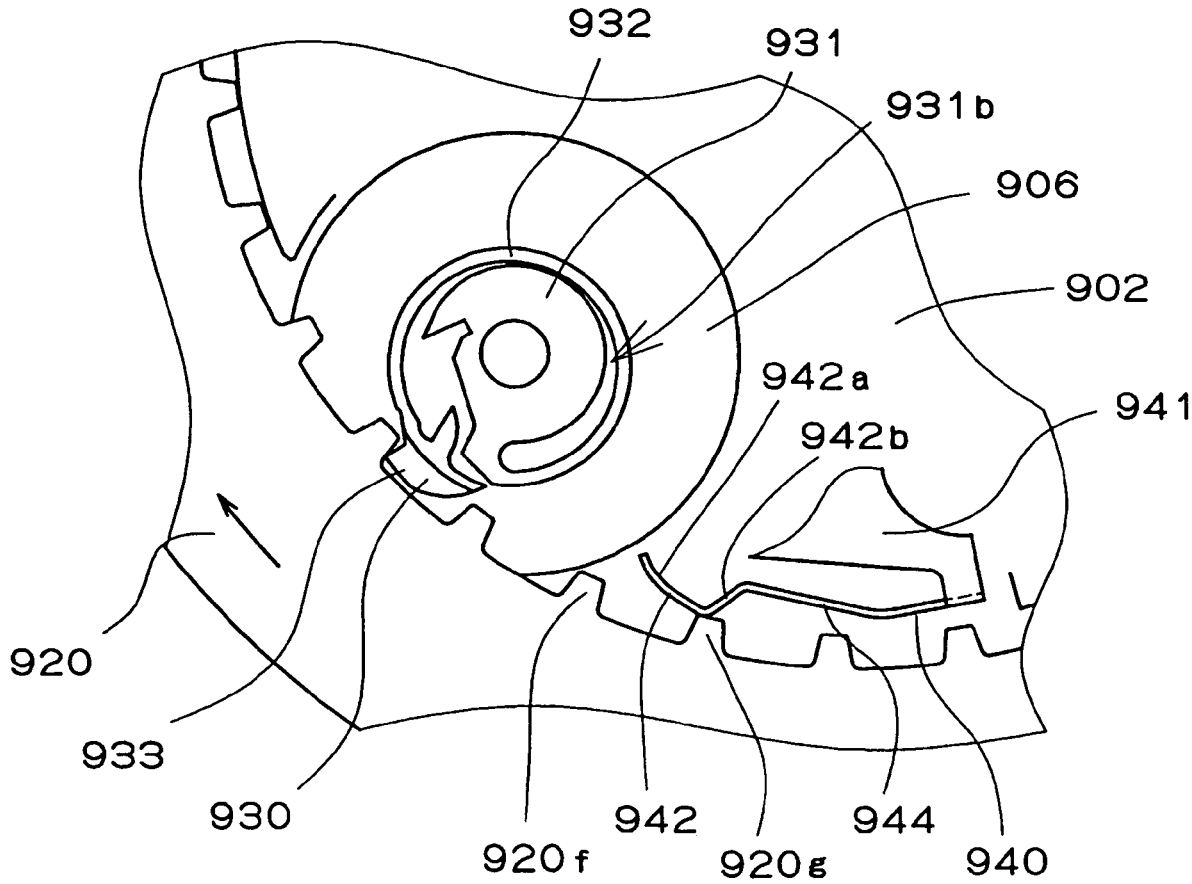
FIG.32 Prior Art
FIG. 32 is a partial plane view showing a relationship between the date indicator driving finger at point D of FIG. 28 and the date indicator in the conventional timepiece with calendar.
Figure 33:
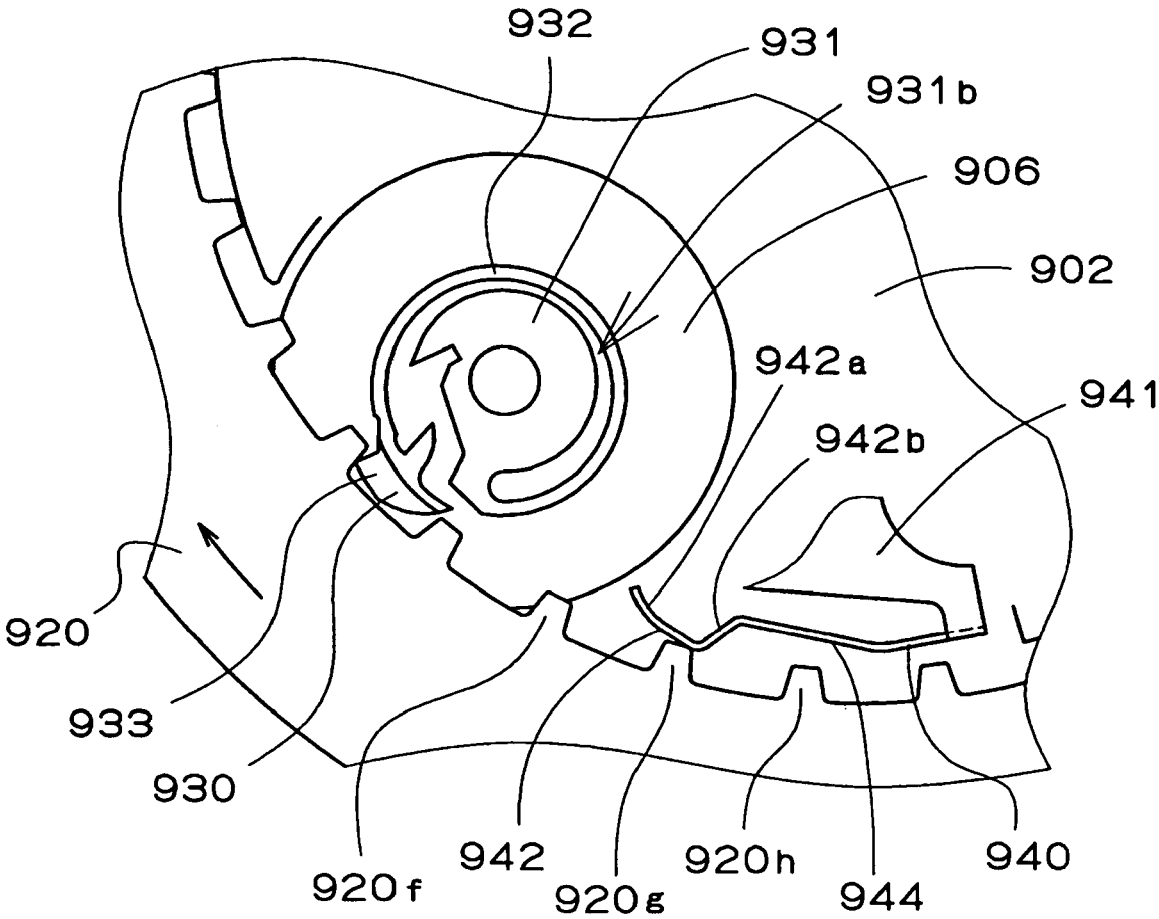
FIG.33 Prior Art
FIG. 33 is a partial plane view showing a relationship between the date indicator driving finger at point E of FIG. 28 and the date indicator in the conventional timepiece with calendar.

When the date indicator driving wheel 706 and the date indicator driving finger 730 are further rotated further from the state shown in FIG. 22, the date indicator driving finger 730 rotates the date indicator 720 in a direction shown by an arrow mark. Under the state, the clearance 731*b* between the inner peripheral portion of the spring portion 732 of the date indicator driving finger 730 and the outer peripheral portion of the central portion 731 stays to be widened. From the state shown in FIG. 22, the circular arc of the tooth tip of the second tooth 720*g* advances to the intersection between the second setting portion 742*b* and the first setting portion 742*a* as shown in FIG. 23. Such an operation corresponds to the case of rotating the date indicator 720 from "state at point E" to "state at point F" in FIG. 17. When "state at point F" in FIG. 17 is reached the date indicator driving finger 730 is disengaged from the date indicator 720 and the force of the date indicator driving finger 730 for rotating the date indicator 720 becomes null (0). In "state at the point F" in FIG. 17, the force necessary for rotating the date indicator 720 is considerably reduced, further, the date indicator 720 is rotating. Therefore, by inertia of the date indicator 720, rotation of the date indicator 720 is not stopped and the date indicator 720 can continue rotating until a successive stop position.

Next, the circular arc of the tooth tip of the second tooth 720*g* is brought into contact with the first setting portion 742*a*. Then, by the spring force of the date jumper spring portion 744 of the date jumper 740, there is brought about a state in which the date indicator 720 is further rotated in the direction shown by the arrow mark, the first setting portion 742*a* is brought into contact with the circular arc of the tooth tip of the second tooth 720*g*, further, the third setting portion 742*c* is brought into contact with a circular arc of a tooth tip of a third tooth 720*h*.

According to the embodiment of the invention, by rotating the date indicator driving wheel 706 by 10.3 degrees, the date indicator 720 can be rotated by the amount of one date. Therefore, according to the embodiment of the invention, the date feeding time period is about 40 minutes. By the constitution, the date indicator 720 can be rotated by the amount of one date in a short period of time.

Figure 16:
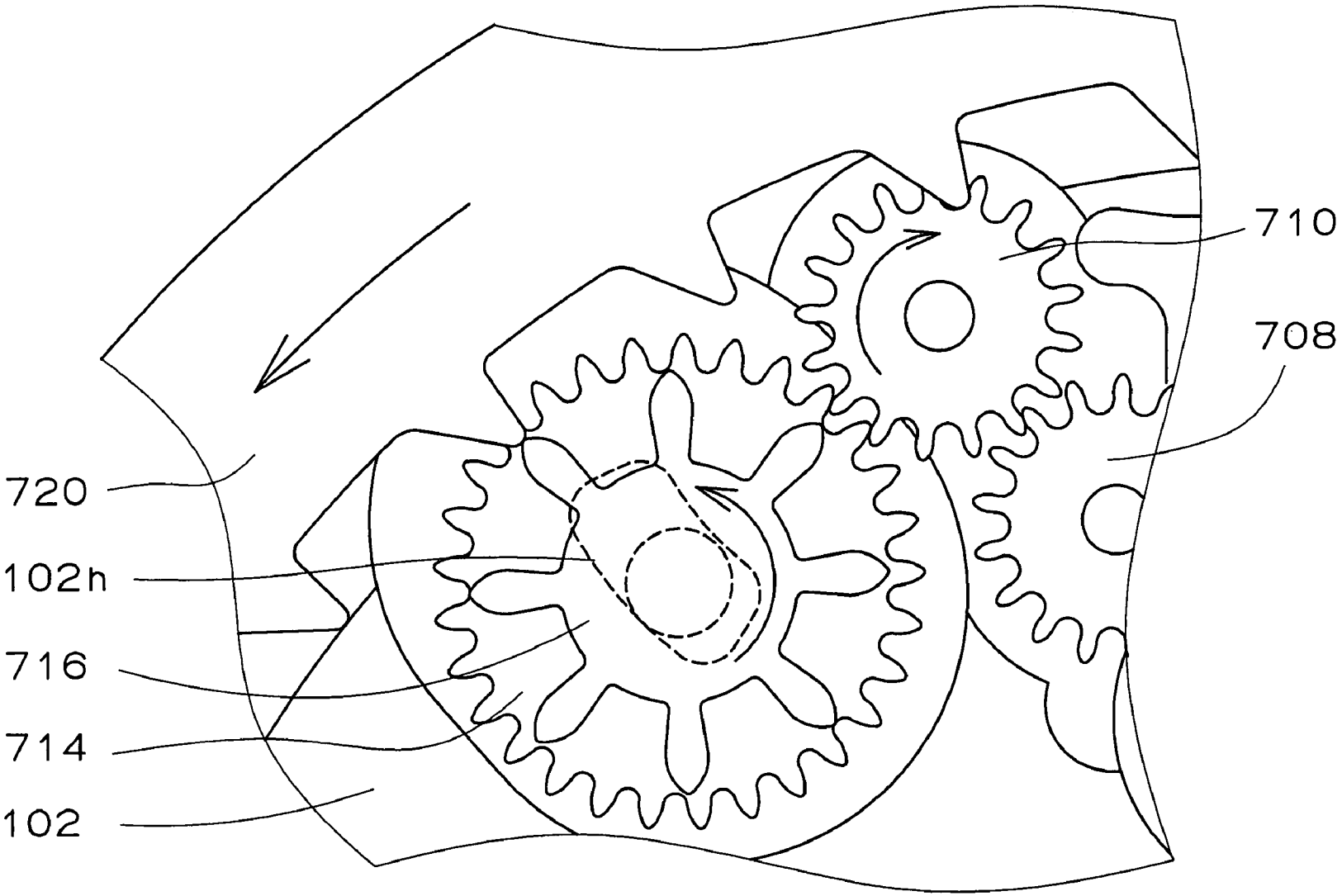
FIG. 16 is a partial plane view showing a state in which the winding stem is disposed at 1 stage and a date indicator starts correcting and in a state in which tooth tips of a date indicator corrector pinion and a date indicator are stretched to each other in the embodiment of the timepiece with calendar according to the invention.

(11•2) Date Correction:

Next, operation of date correction of the timepiece with calendar of the invention will be explained. In reference to FIG. 14 and FIG. 16, when date correction is carried out, the winding stem 310 is pulled to 1 stage. Then, teeth of the clutch wheel 462 are brought in mesh with those of the setting wheel 464. When the winding stem 310 is rotated in a first direction in a state in which the winding stem 310 is set to 1 stage, the setting wheel 464 is rotated and the date correction setting transmission wheel B710 is rotated in the direction shown by the arrow mark via rotation of the date corrector setting transmission wheel A708. When the date corrector setting transmission wheel B710 is rotated in the direction shown by the arrow mark, the date corrector setting wheel 714 is moved to the first position pivoted in one direction (position at which date corrector setting transmission pinion 716 is brought in mesh with the inner teeth portion 720*a* of the date wheel 720). When the date corrector setting wheel 714 is disposed at the first position pivoted in one direction, the date corrector setting pinion 716 is brought in mesh with the inner teeth portion 720*a* of the date wheel 720. By rotating the winding stem 310 in the first direction under the state, date correction can be carried out by rotating the date wheel 720 in the direction shown by the arrow mark. As shown by FIG. 16, the front end of the date corrector pinion 716 is sharpened., the front end of the inner teeth portion 720*a* of the date indicator 720 is sharpened and therefore, there is almost no concern of interfering the front end of the date corrector pinion 716 with the front end of the inner teeth portion of the date indicator 720.

When the winding stem 310 is rotated in a second direction opposed to the first direction in the state in which the winding stem 310 is set to 1 stage, the setting wheel 464 is rotated and the date corrector setting transmission wheel B710 is rotated in the direction opposed to the direction shown by the arrow mark via rotation of the date corrector setting transmission wheel A708. When the date corrector setting transmission wheel B710 is rotated in the direction opposed to the direction shown by the arrow mark, the date corrector setting wheel 714 is moved to the second position pivoted in other direction (position at which the date corrector setting pinion 716 is not brought in mesh with the inner teeth portion 720*a* of the date wheel 720). Even when the winding stem 310 is rotated in the second direction under the state, the date indicator 720 is not rotated and date correction cannot be carried out.

The date corrector setting transmission wheel A708 is brought in mesh with the date corrector setting transmission wheel B710. The date corrector setting transmission wheel B710 is brought in mesh with the date corrector setting wheel 714. The date corrector setting wheel 714 is pivotably integrated to the circular arc long hole 102*h* of the main plate 102. The date corrector setting pinion 716 is provided integrally with the date corrector setting wheel 714. In reference to FIG. 14 and FIG. 15, when the date corrector setting wheel 714 is disposed at the second position pivoted in other direction, the date corrector setting pinion 716 is comprised not to be brought in mesh with the inner teeth portion 720*a* of the date wheel 720. When the winding stem 310 is rotated in the state in which the winding stem 310 is set to 1 stage, the date corrector setting transmission wheel A708 is comprised to rotate via the clutch wheel 462 and the setting wheel 464. The inner teeth portion 720*a* of the date wheel 720 is comprised to rotate by the date corrector setting pinion 716 by rotating the date corrector setting wheel 714 and the date corrector setting pinion 716 via rotation of the date corrector setting transmission wheel B by rotation of the date corrector setting transmission wheel A708 under the state.

(12) Operation of Train Wheel Apparatus:

Next, operation of the train wheel apparatus of the timepiece with calendar of the invention will be explained. In reference to FIG. 7 through FIG. 9, by force of the mainspring 322, the movement barrel complete 320 is rotated. The center wheel & pinion 325 is rotated by rotation of the movement barrel complete 320. The third wheel & pinion 326 is rotated by rotation of the center wheel & pinion 325. The second wheel & pinion 328 is rotated by rotation of the third wheel & pinion 326. Further, the minute indicator 324 is simultaneously rotated by rotation of the third wheel & pinion 326. The minute wheel 348 is rotated by rotation of the minute indicator 324. The hour wheel 354 is rotated by rotation of the minute wheel 348. Rotating speeds of the respective train wheels are controlled by operation of the balance with hairspring 340, the pallet fork 342 and the escape wheel & pinion 330. As a result, the second wheel & pinion 328 is rotated by one rotation in 1 minute. The minute indicator 324 is rotated by one rotation in 1 hour. The hour wheel 354 is rotated by one rotation in 12 hours.

"Second" is indicated by the second hand 358 attached to the second wheel & pinion 328. "Minute" is indicated by the minute hand 352 attached to the hour pinion 324*a*. "Hour" is indicated by the hour hand 356 attached to the hour wheel 354. That is, the second wheel & pinion 328, the minute indicator 324 and the hour wheel 354 constitute indicating wheels for indicating time information. Time is read by graduation or the like of the dial 104.

(13) Operation of Switching Apparatus:

Next, operation of the switching apparatus of the timepiece with calendar of the invention will be explained. In reference to FIG. 13, the setting lever 420, the yoke 430, the yoke holder 440 and the operating lever 450 are integrated to the back side of the main plate 102. The setting wheel 464 is rotatably attached to the operating lever 450. The clutch wheel 462 is coaxially attached to the winding stem 310. The hat-like portion 442 of the yoke holder 440 is engaged with the positioning pin of the setting lever 420 to position the setting lever 420 and set switching weight of the winding stem 310. By rotating the setting lever 420, the operating lever positioning pin is moved in the operating lever guide hole. Thereby, when the winding stem 310 is set from 0 stage to 1 stage, the operating lever 450 is not rotated and when the winding stem 310 is set from 1 stage to 2 stage, the operating lever 450 is rotated.

In reference to FIG. 13, when the winding stem 310 is rotated in the state in which the winding stem 310 is set to 0 stage, although the clutch wheel 462 is rotated, the setting wheel 464 is not rotated since the clutch wheel 462 is not brought in mesh with the setting wheel 464. In reference to FIG. 14, when the winding stem 310 is rotated in the state in which the winding stem 310 is set to 1 stage, the clutch wheel 462 is rotated, the clutch wheel 462 is brought in mesh with the setting wheel 464 and when the winding stem 310 is rotated, the setting wheel 464 is rotated via rotation of the clutch wheel 462. Although not illustrated, when the winding stem 310 is set from 1 stage to 2 stage, by rotating the operating lever 450, the clutch wheel 462 is brought in mesh with setting wheel 464 and the setting wheel 464 is brought in mesh with the minute wheel 348. When the winding stem 310 is rotated under the state, the minute wheel 348 can be rotated via rotation of the clutch wheel 462 and the setting wheel 464. Therefore, in the state in which the winding stem 310 is set to 2 stage, by rotating the winding stem 310, hands of the timepiece can be set by rotating the hour wheel 354 and the minute indicator 324 via rotation of the clutch wheel 462, the setting wheel 464 and the minute wheel 348.

(14) Example of other Structure of Timepiece with Calendar of the Invention:

Although an explanation has been given of a mechanical time timepiece, a self-winding wrist watch, a center three hands type timepiece, a timepiece having only a calendar mechanism and a time piece of structure of 2 stage pull winding stem according to the embodiment of the timepiece with calendar of the invention, the invention is applicable to timepieces having structures shown below and the like.

(a) Hand Winding Timepiece:

The above-described explanation, the timepiece with calendar according to the invention can be comprised to delete the self-winding mechanism and include only a hand winding mechanism. In this case, by rotating the winding stem 310 in the state in which the winding stem 310 is set to 0 stage or in the state in which the winding stem 310 is set to 0 stage and 1 stage, by a hand winding mechanism including a winding pinion, a crown wheel or the like, a mainspring may be comprised to wind up by rotating the winding stem 310.

(b) Two Hands Type Timepiece:

In the above-described explanation, the timepiece with calendar of the invention can be comprised to delete the second hand and include only the hour hand and the minute hand.

(c) Timepiece Having Week Indication:

In the above-described explanation, the timepiece with calendar of the invention can be comprised to further include a day indicating mechanism. In this case, the timepiece with calendar of the invention can be comprised to further include a day feeding finger rotated by one rotation per day based on rotation of the date indicator driving wheel 706 and a day wheel rotated by (360/7) degrees per day based on rotation of the day feeding finger. Further, when needed, the timepiece with calendar of the invention may be comprised to include a day correcting mechanism for correcting the day wheel via rotation of a day corrector transmission wheel based on rotation of the date corrector setting wheel 714.

(d) Electronic Timepiece, Electric Timepiece:

In the above-described explanation, the timepiece with calendar according to the invention can be comprised to include a battery and a motor in place of a mainspring as a drive source. According to the constitution, a step motor, a direct current motor or the like may be comprised to rotate by a driving circuit (IC etc).

(e) Timepiece of Winding Stem 1 Stage Pull Structure:

Although according to the above-described explanation, an explanation has been given of the timepiece with calendar according to the invention as a timepiece having a winding stem 2 stage pull structure, the timepiece with calendar according to the invention can be comprised such that when a date correcting mechanism is deleted, or when a date correcting mechanism having other structure (for example, a winding stem push time date correcting mechanism) is used, in the state in which the winding stem 310 is set to 1 stage, by rotating the winding stem 310, hands of the timepiece can be set by rotating the hour wheel 354 and the minute indicating wheel 324 via rotation of the clutch wheel 462, the setting wheel 464 and the minute wheel 348.

By the invention, there can be realized a timepiece with calendar capable of shortening a time period for feeding a date indicator more than that of the conventional example and capable of firmly setting the date indicator by a date jumper after feeding the date indicator.

Further, by the invention, there can be realized a timepiece with calendar in which shapes of parts are simple and fabrication, assembling and adjustment of the parts are facilitated.

Further, by the invention, there can be realized a timepiece with calendar in which there is hardly a concern that a corrector tooth of a date corrector setting wheel interferes with a straight portion of a tooth of a date indicator even when a date correcting mechanism of a pivoting type is used.

What is claimed is:

1. A calendar timepiece comprising: a main plate; a minute indicator mounted on the main plate for undergoing rotational movement to indicate time information; a correcting apparatus for correcting the time information; a dial for displaying the time information; a date indicator mounted on the main plate for undergoing rotation to indicate date information, the date indicator having an inner teeth portion comprised of a plurality of teeth; a date indicator driving wheel mounted on the main plate to undergo rotation for rotating the date indicator; a date indicator driving finger integrally connected to the date indicator driving wheel for rotation therewith, the date indicator driving finger having a central portion integral with the date indicator driving wheel, a spring portion extending from the central portion, and a date indicator feeding portion disposed at a front end of the spring portion for rotating the date indicator; and a date jumper disposed on aside of the main plate and having a train wheel comprised of a date indicator setting portion for controlling rotation of the date indicator by engagement with the inner teeth portion of the date indicator, the date indicator setting portion having a first setting portion, a second setting portion and a third setting portion, the second setting portion being disposed between the first setting portion and the third setting portion so that when the date indicator setting portion controls the rotation of the date indicator, the first setting portion is brought into contact with a tip of a first tooth of the inner teeth portion of the date indicator and the third setting portion is brought into contact with a tip of a second tooth of the inner teeth portion of the date indicator contiguous with the first tooth; wherein the tip of each of the first tooth and the second tooth of the inner teeth portion of the date indicator has a portion shaped in the form of a circular arc with which the first setting portion and the third setting portion are respectively brought into contact when the date indicator setting portion controls the rotation of the date indicator; wherein a first reference line is defined by a straight line connecting a rotational center of the date indicator and a center of the circular arc of the tooth tip of the first tooth, a second reference line is defined by a straight line connecting a rotational center of the minute indicator and a center of the circular arc of the tooth tip of the second tooth, T1 represents an angle formed by the first reference line and the second reference line, T2 represents an angle formed by a straight line connecting an intersection of the first setting portion and the second setting portion and the rotational center of the minute indicator and the first reference line, and T3 represents an angle formed by a straight line connecting an intersection of the second setting portion and the third setting portion and the rotational center of the date indicator and the first reference line; and wherein (T1−T3) is less than (T3−T2) and (T3−T2) is less than T2.

2. A calendar timepiece according to claim 1; further comprising a calendar corrector setting wheel mounted on the main plate for undergoing pivotal movement to correct date information indicated by the date indicator.

3. A calendar timepiece according to claim 2; wherein the first setting portion and the second setting portion of the date indicator setting portion of the date jumper are disposed at an angle in the range of 115 degrees through 160 degrees; and wherein the second setting portion and the third setting portion of the date indicator setting portion of the date jumper are disposed at an angle in the range of 120 degrees through 170 degrees.

4. A calendar timepiece according to claim 1; wherein the first setting portion and the second setting portion of the date indicator setting portion of the date jumper are disposed at an angle in the range of 115 degrees through 160 degrees; and wherein the second setting portion and the third setting portion of the date indicator setting portion of the date jumper are disposed at an angle in the range of 120 degrees through 170 degrees.

5. A calendar timepiece according to claim 1; wherein the inner teeth portion of the date indicator comprises thirty-one teeth.

6. A calendar timepiece according to claim 5; wherein each tooth of the inner teeth portion of the date indicator is generally triangular-shaped.

7. A calendar timepiece according to claim 1; wherein the spring portion of the date indicator driving finger is shaped in the form of a circular arc.

8. A calendar timepiece comprising:

a main plate;

a time indicator mounted on the main plate for undergoing rotational movement to indicate time information;

a date indicator mounted for undergoing rotation to indicate date information, the date indicator having an inner teeth portion comprised of a plurality of teeth;

a date indicator driving wheel mounted on the main plate for undergoing rotation;

a date indicator driving finger integral with the date indicator driving wheel for rotation therewith for rotationally driving the date indicator; and a date jumper disposed on the main plate and having a train wheel comprised of a date indicator setting portion for controlling rotation of the date indicator by engagement with the inner teeth portion of the date indicator, the date indicator setting portion having a first setting portion for contacting a tip of a first tooth of the inner teeth portion of the date indicator, a second setting portion, and a third setting portion for contacting a tip of a second tooth of the inner teeth portion of the date indicator, the first setting portion and the second setting portion of the date indicator setting portion of the date jumper being disposed at an angle in the range of 115 degrees through 160 degrees, and the second setting portion and the third setting portion of the date indicator setting portion of the date jumper being disposed at an angle in the range of 120 degrees through 170 degrees.

9. A calendar timepiece comprising:

a main plate;

a time indicator mounted on the main plate for undergoing rotational movement to indicate time information;

a date indicator mounted for undergoing rotation to indicate date information, the date indicator having an inner teeth portion comprised of a plurality of teeth;

a date indicator driving wheel mounted on the main plate for undergoing rotation;

a date indicator driving finger integral with the date indicator driving wheel for rotation therewith for rotationally driving the date indicator; and a date jumper disposed on the main plate and having a train wheel comprised of a date indicator setting portion for controlling rotation of the date indicator by engagement with the inner teeth portion of the date indicator, the date indicator setting portion having a first setting portion for contacting a tip of a first tooth of the inner teeth portion of the date indicator, a second setting portion, and a third setting portion for contacting a tip of a second tooth of the inner teeth portion of the date indicator, each of the first, second, and third setting portions having a generally linear surface disposed at an angle relative to one another;

wherein the tip of each of the first tooth and the second tooth of the inner teeth portion of the date indicator has a portion shaped in the form of a circular arc with which the first setting portion and the third setting portion are respectively brought into contact when the date indicator setting portion controls the rotation of the date indicator; wherein a first reference line is defined by a straight line connecting a rotational center of the date indicator and a center of the circular arc of the tooth tip of the first tooth, a second reference line is defined by a straight line connecting a rotational center of the time indicator and a center of the circular arc of the tooth tip of the second tooth, T1 represents an angle formed by the first reference line and the second reference line, T2 represents an angle formed by a straight line connecting an intersection of the first setting portion and the second setting portion and the rotational center of the time indicator and the first reference line, and T3 represents an angle formed by a straight line connecting an intersection of the second setting portion and the third setting portion and the rotational center of the date indicator and the first reference line; and wherein (T1−T3) is less than (T3−T2) and (T3−T2) is less than T2.

* * * * *